US012330822B2

(12) United States Patent
Cornett et al.

(10) Patent No.: US 12,330,822 B2
(45) Date of Patent: Jun. 17, 2025

(54) SYSTEM AND APPARATUS FOR STRAPPING PACKAGING ARTICLES OR PACKAGING MATERIALS, AND METHODS OF USE

(71) Applicant: EAM-MOSCA CORPORATION, Hazle Township, PA (US)

(72) Inventors: Michael Eugene Cornett, Hazle Township, PA (US); Christopher Edmund Grymko, Forty Fort, PA (US); Michael Anthony Hoover, Sugarloaf, PA (US)

(73) Assignee: EAM-MOSCA CORPORATION, Hazle Township, PA (US)

( * ) Notice: Subject to any disclaimer, the term of this patent is extended or adjusted under 35 U.S.C. 154(b) by 0 days.

(21) Appl. No.: 18/246,711

(22) PCT Filed: Jan. 29, 2021

(86) PCT No.: PCT/US2021/015642
§ 371 (c)(1),
(2) Date: Mar. 27, 2023

(87) PCT Pub. No.: WO2022/164438
PCT Pub. Date: Aug. 4, 2022

(65) Prior Publication Data
US 2023/0373673 A1 Nov. 23, 2023

(51) Int. Cl.
*B65B 13/18* (2006.01)
*B65B 13/14* (2006.01)
(Continued)

(52) U.S. Cl.
CPC ..... *B65B 13/14* (2013.01); *B65B 13/16* (2013.01); *B65B 13/187* (2013.01); *B65B 27/08* (2013.01); *B65B 35/56* (2013.01)

(58) Field of Classification Search
CPC ..... B65B 13/184; B65B 13/06; B65B 13/02; B65B 13/04; B65B 13/14
See application file for complete search history.

(56) References Cited

U.S. PATENT DOCUMENTS 3,943,608 A 3/1976 Farkus
4,271,655 A * 6/1981 Nagayoshi ..... B65B 13/06 53/589
(Continued)

FOREIGN PATENT DOCUMENTS

CL 2017003253 A1 6/2018
CN 107719735 A 2/2018
(Continued)

OTHER PUBLICATIONS

International Search Report for corresponding application PCT/US2021/015642 dated Oct. 26, 2021.
(Continued)

*Primary Examiner* — Andrew M Tecco
(74) *Attorney, Agent, or Firm* — Norris McLaughlin, P.A.

(57) ABSTRACT

Apparatus, system and process useful for bundling packaging articles particularly in a stack thereof. The apparatus and system includes at least a first bundling apparatus and second bundling apparatus, wherein the relative linear displacement of the first bundling apparatus and the at least second bundling apparatus is variable, and which further includes a reconfigurable bridge between the first bundling apparatus and the second bundling apparatus. A process of utilizing the apparatus and system is also disclosed. Also disclosed is a bidirectional strap magazine which may be used with one or more of the bundling apparatus.

16 Claims, 36 Drawing Sheets

(51) Int. Cl.

| | |
|---|---|
| ***B65B 13/16*** | (2006.01) |
| ***B65B 27/08*** | (2006.01) |
| ***B65B 35/56*** | (2006.01) |

(56) References Cited

U.S. PATENT DOCUMENTS

| | | | | | |
|---|---|---|---|---|---|
| 4,559,767 | A * | 12/1985 | Takami | B65B 13/22 | 100/32 |
| 4,651,944 | A * | 3/1987 | Bader, Jr. | B65B 13/184 | 242/417 |
| 5,078,057 | A * | 1/1992 | Pearson | B65B 27/086 | 100/29 |
| 5,236,329 | A * | 8/1993 | Sylvester | B65B 13/18 | 100/32 |
| 5,289,668 | A * | 3/1994 | Meyer | B65B 13/181 | 53/410 |
| 5,560,180 | A * | 10/1996 | Rodriguez | B65B 27/12 | 53/399 |
| 6,546,696 | B2 * | 4/2003 | Cranston, III | B65B 13/32 | 53/399 |
| 7,765,778 | B2 * | 8/2010 | Schuttler | B65B 13/184 | 53/399 |
| 7,770,369 | B2 * | 8/2010 | Doyle | B65B 13/184 | 53/399 |
| 10,669,085 | B2 | 6/2020 | Gahleitner | | |
| 2002/0116900 | A1 * | 8/2002 | Cranston, III | B65B 13/32 | 53/399 |
| 2004/0250697 | A1 * | 12/2004 | Devine | B65B 13/18 | 100/26 |
| 2005/0044821 | A1 * | 3/2005 | Schuttler | B65B 13/06 | 53/589 |
| 2018/0148943 | A1 | 5/2018 | Itagaki et al. | | |
| 2019/0255761 | A1 | 8/2019 | Gahleitner | | |

FOREIGN PATENT DOCUMENTS

| | | | |
|---|---|---|---|
| CN | 110683085 | A | 1/2020 |
| CN | 110683095 | A | 1/2020 |
| DE | 202014101844 | U1 | 4/2014 |
| EP | 1479611 | A2 | 11/2004 |

OTHER PUBLICATIONS

Written Opinion of the International Searching Authority for corresponding application PCT/US2021/015642 dated Oct. 26, 2021.
European Search Report in corresponding EP application 24199709 dated Dec. 11, 2024.
International Search Report and Written Opinion of the international Search Authority in related application PCT/US2024/044024 dated Dec. 10, 2024.
Letter reporting Office Action in corresponding CL application CL 202301591 dated Nov. 19, 2024.

* cited by examiner

SYSTEM AND APPARATUS FOR STRAPPING PACKAGING ARTICLES OR PACKAGING MATERIALS, AND METHODS OF USE

This is an application filed under 35 USC 371 based on PCT/2021/015642 filed 29 Jan. 2021. The present application claims the full priority benefit of all prior applications and incorporates by reference their full disclosures as if set forth herein.

The system and apparatus of the present invention relates to an apparatus, system and process useful for bundling loads/products; such loads/products include discrete articles which may be used in forming packaging materials, which may be individual packages articles as well as a plurality of individual packaging articles such as may be provided in a vertical stack layered in register, which are thereafter bundled. Various embodiments of the system and apparatus are disclosed herein.

The present invention also relates one or more methods related to the use of the system and apparatus of the present invention, as well as to discrete component parts thereof.

The packaging and thereafter transport of goods via courier, or other shipping modes has become ubiquitous in our modern society. Such packaging is often an underappreciated aspect of modern commerce as, such packaging is typically disposed of, preferably recycled after use. In the storage, and shipment of materials, packaging is frequently provided by the use of packaging articles based on fibrous based materials such as paper, paperboard, sheet, and especially corrugated cardboard. Such materials are readily formed into sheets which can thereafter be cut, and formed to provide a three-dimensional receptacle, i.e, a packaging article, useful for the containment of goods. Advantageously, such packaging articles provide durability, rigidity, and frequently may also be reused a number of times. Non-limiting examples of such packaging articles are boxes or other containers having three dimensions, which are assembled from a generally flat, generally two dimensional form, i.e, a sheet of a fibrous material such as corrugated cardboard or other foldable sheet, or a collapsed form of a three dimensional packaging article, i.e. a collapsed packaging container. Advantageously, such fibrous materials are frequently successfully recyclable in whole, or in part thereby reducing waste, or the unnecessary harvesting of fiber sources, for example trees or other plants.

Typically, packaging articles are formed using a mechanical apparatus wherein supply source of a sheet or roll of the fibrous material is supplied to a cutting mechanism. Such cutting mechanism may include a die which punches out preformed patterns on an otherwise flat sheet which subsequently, may optionally be scored at certain points thereon in order to facilitate folding such that a three-dimensional, hollow packaging container, (viz., packaging article) is formed from the two-dimensional sheet. Such packaging containers typically will include sidewalls, top, and a bottom; the latter two may be formed from overlaid flap parts extending from the sidewalls. Frequently, packaging containers are partially assembled, or may be provided in a ready to assemble form in bundles which comprise a plurality of such packaging containers.

Providing such packaging containers in bundles is highly space efficient in that a flattened packaging container may be layered in register with other such packaging containers in order to form a stack thereof; the stack may they be strapped together to provide a uniform orientation of the plurality of flattened packaging containers. This facilitates shipping of such flattened packaging containers, which may be optimally loaded and palletized and shipped to end users who, at their facility may unbundle them and reconfigure them into three-dimensional hollow packaging containers ready for the receipt of goods therein.

Apparatus for bundling flattened packaging containers are not necessarily new, and are known to the art for at least several decades. These include those disclosed in U.S. Pat. No. 7,765,778. Machines which provide bundling of such containers are commercially available, such as from the present Applicant. These include 'bundler apparatus' including those which are sold under the tradename TRC6-SQ4A SoniXs Tandem® which is an apparatus which provides a pair of bundling machines which are essentially separately operable from each other, but which may be used to process to bundles of flattened packaging containers (or further packaging articles, including sheets) which is applied to the apparatus from an upstream source. The operation of this bundler apparatus is also relevant to the disclosure at FIG. 2 of U.S. Pat. No. 7,765,778 which also discusses the provision of two separate bundling machines which operate in tandem. Both of these apparatus operate whereby (a) two separate bundles of flattened packaging containers are passed into the apparatus whereon (b) the first, or downstream bundle is driven towards the second downstream bundling machine which positions the downstream bundle within while (c) the second, upstream bundle is positioned within the first bundling machine which also positions the upstream bundle within and, essentially simultaneously the second bundling machine and the first bundling machine operate to orient, compress and strap the separate bundles utilizing a compressive strap before (d) both the first machine in the second machine subsequently eject their formed bundles which continue in a downstream direction thereafter, they are ultimately collected for shipping to an end user. While this apparatus operating in tandem does provide some improved unit throughput of formed bundles per unit of time, there remains a plurality of disadvantages. It is to such disadvantages that the system, apparatus, and method of the present invention relates.

In a first aspect, the present invention provides a system and apparatus useful for bundling packaging articles. The system and apparatus comprises at least a first bundling apparatus and at least a second bundling apparatus, wherein the second bundling apparatus and the first bundling apparatus may be laterally displaced in a dynamic manner, and wherein the system and apparatus comprises a reconfigurable, or flexible bridge between the first bundling apparatus and the second bundling apparatus. The flexible bridge has a span which extends between an exit edge of the first bundling apparatus, (hereinafter which may also be referred to as the "upstream" bundling apparatus) and the entrance edge of the second bundling apparatus, (hereinafter which may also referred to as the "downstream" bundling apparatus). The flexible bridge may assume various configurations and dimensions depending upon the relative linear displacement of the first bundling apparatus with respect to the second bundling apparatus. In one embodiment, the first bundling apparatus, during operation, is generally retained in a static position whereas the second bundling apparatus may be dynamically moved toward, or away from the first bundling apparatus. Simultaneously, or subsequent to any such reconfiguration of the first bundling apparatus with respect to the second bundling apparatus, the span of the flexible bridge may also be re-dimensioned in order to maintain a substantially contiguous and continuous transport surface between the exit edge of the first bundling apparatus and the entrance edge of the second bundling apparatus.

Such a configuration provides for variability in the size of the packaging article(s) to be bundled by the system and apparatus. Advantageously, the span of the flexible bridge is sufficiently rigid such that it provides a horizontal supporting surface for packaging articles passing between the first (upstream) bundling apparatus and the second (downstream) bundling apparatus. Such a configuration and mode of operation is not provided by the prior art, tandem apparatus.

A second aspect of the present invention is the flexible bridge apparatus. The flexible bridge apparatus provides for reconfigurable upper transport surface whose dimensions can be varied in response to the lateral positioning and changes thereto between the first bundling apparatus and the second bundling apparatus. In certain embodiments, the flexible bridge apparatus is nonpowered, namely in that it provides a generally planar upper surface which is preferably substantially coplanar and coincident with the stage of the first bundling apparatus as well as the stage of the second bundling apparatus, but provides no propulsive effects to packaging articles present thereon. In other embodiments however, the flexible bridge apparatus provides a propulsive effect to packaging articles, i.e., stacks of individual packaging articles which may be present on its generally planar upper surface. Such a propulsive effect may be used in transporting packaging articles thereon between the first bundling apparatus and the second bundling apparatus. The flexible bridge apparatus may take a variety of forms and configurations depending upon its embodiments. For example, a part of the flexible bridge apparatus which provides the generally planar upper surface may be provided by a belt, or moving mesh surface, or plurality of cylindrical wheels or segments upon one or more common axes. In a particular preferred embodiments the flexible bridge apparatus comprises a plurality of parallel generally cylindrical rollers whose central axes are parallel with respect to one another.

The flexible bridge apparatus also includes a support structure, and when the flexible bridge apparatus provides a propulsive effect, a motor and/or other drive means in order to provide the propulsive effect.

Optionally, but preferably the system and apparatus of the invention also comprises a second reconfigurable, flexible bridge apparatus which is located downstream of the second bundling apparatus. Such a second flexible bridge apparatus provides and includes a reconfigurable upper transport surface which is preferably substantially coplanar and coincident with the stage of the second bundling apparatus, opposite to the side of the stage which is coincident with the aforesaid flexible bridge apparatus which spans between the first bundling apparatus and the second bundling apparatus. Provision of such a second flexible bridge apparatus provides for convenient configuration of the overall system and apparatus which facilitates the downstream transport of bundled packaging articles subsequent to their bundling within the system and apparatus.

A third aspect of the present invention relates to the configuration of one or both of the first bundling apparatus and/or the second bundling apparatus. In a preferred embodiment, as the second bundling apparatus is necessarily linearly displaceable from the first bundling apparatus, is necessary to provide a transport system having a transport track which can be used to displace the latter apparatus from the former apparatus. This ideally also ensures that the parallel relationship between the first bundling apparatus and the second bundling apparatus is retained throughout its range of motion, including at their maximum distal displacement, or maximum spaced apart distance position possible, as well as the most proximate displacement, or minimum spacing position possible wherein the first bundling apparatus and the second bundling apparatus are physically least spaced apart and in which the span of the flexible bridge extant is reduced to its minimum surface area. In this third aspect of the invention, at least the second bundling apparatus is configured such that it may receive at either end thereof, the strapping material.

A fourth aspect of the invention is the provision of an "omnidirectional fed" bundling apparatus. As is known from the prior art, as the dynamic repositioning of a bundling apparatus is unnecessary following their installation upon a factory floor, typically the configuration of any such bundling apparatus includes only at one end thereof, a strap feed apparatus which feeds, often from an external stand a continuous supply of strapping material (which may also be referred to as 'banding', or more simply 'strap") which often is of a banding-like configuration. The strapping material includes a height or thickness, which is generally a small fraction of its transverse width, and the strapping material has a linear length which is frequently many times, generally an excess of 100, or 1000 times of its transverse width dimension. Once installed, there no need to configure or to have considered configuration of a bundling apparatus so that it could receive the strapping material from either end of the machine, as the bundling machine would have no need to be laterally repositionable. However, in accordance with the operating characteristics of the system and apparatus described herein, it is advantageous that at least one of the bundling apparatus present therein is configured o it may receive at either and thereof, the strapping material thus providing an "omnidirectional fed" bundling apparatus. Such an omnidirectional bundling apparatus may be the first bundling apparatus and/or the second bundling apparatus. Any such omnidirectional fed bundling apparatus may include one or more supply drive motors and associated component parts which are used to take up the strapping material and transport it to a bidirectional storage cassette. The bidirectional storage cassette is present within a bundling apparatus, and includes a container which is downstream of both the supply source of the strapping material, which may be exterior of the bundling apparatus, as well as the one or more supply drive motors which, up to that point typically retain a degree of tension within the strapping material. However, upon entry into the confines of the bidirectional storage cassette, the tension within the strapping tape is generally released, and a sufficient length of the strapping tape is retained in a loose, generally folded or curved configuration where a portion of it is subsequently taken up by a bundler supply drive motor and associated component parts which remove a portion or linear length of the un-tensioned strapping material from within the bidirectional storage cassette and direct it towards parts of the bundling apparatus, to encircle layered or stacked packaging articles which are to be acted upon by the bundling apparatus in order to provide a strapped bundle of product therefrom. In the prior art, such a bidirectional storage cassette having two entry ports for the insertion of strapping material, and one exit port for the withdrawal of strapping material is believed to be unknown. Thus, this bidirectional storage cassette, and methods for its use also comprise a further feature of the present invention.

An advantage of such an omnidirectional bundling apparatus as described in further detail hereinafter is that it provides for advanced flexibility in industrial installations. A further advantage of such an omindirectional bundling apparatus allows for the interchangeability of one such omnidirectional bundling apparatus by another omnidirectional bundling apparatus. Thus, should in a busy factory one such apparatus require servicing, it can be readily and swiftly taken off-line and a functional spare omnidirectional bundling apparatus can be quickly installed. In the system and apparatus of the present invention, preferably two or more of the bundling apparatus present are omnidirectional bundling apparatus as described herein. To facilitate such a feature, it is advantageous that the system and apparatus of the invention include one or more linearly movable transport pads which may traverse along the transport track each of which such transport pads may be used to support one, possibly more than one bundling apparatus as described here in. Again, in preferred embodiments only one omnidirectional bundling apparatus need be present but two or more may be provided, and each of these may be provided individually upon a separate transport pad. Advantageously, the transport system may have associated therewith drive motors, or linear actuators, or other operative transport devices which may be used to displace in a controlled manner the first bundling apparatus with at least the second bundling apparatus as described herein. Such a transport system may comprise a controller which may be used to provide suitable control signals to such drive motors, linear actuators, or other operative transport devices in order to provide automated or semiautomated linear displacement of the first bundling apparatus with the second bundling apparatus. Less advantageously, but still very technically feasible is the provision of a fully manually operable transport system wherein the first and second bundling apparatus may be pushed or pulled apart with respect to each other in order to establish a desired linear offset therebetween.

In certain preferred embodiments, the system and apparatus comprise a structural frame in addition to the first bundling apparatus, at least the second bundling apparatus, and the flexible bridge apparatus. The structural frame provides for physical support for further elements and apparatus which may be used in conjunction with one or more of the bundling apparatus and/or the flexible bridge apparatus.

In one configuration, the structural frame is used to support an orienting apparatus which comprises a plurality of paddles which are used during the operation of packaging articles within the apparatus in order to orient one or more packaging articles, particularly one or more stacks of discrete packaging articles immediately prior to their bundling within the system and apparatus. Such an orientation operation is generally practiced in order to ensure that there is consistent verticality to the packaging articles immediately prior to their being bundled using the strapping material which is typically under tension subsequent to bundling of the materials/packages. The tensioned bundling strap encircling the packaging articles typically retains the compressed state of the packaging articles, particularly a stack of packaging articles. In such a configuration, the orienting apparatus is separate from the first bundling apparatus and the second bundling apparatus. With such a configuration, the positioning and orientation of the plurality of paddles is also variable, and movable with respect to one or both of the bundling apparatus present. In such a manner, linear displacement and/or linear repositioning of the first bundling apparatus with respect to the second bundling apparatus may occur, without compromising the operation of the orienting apparatus which, can be suitably reconfigured such that parts thereof remain operative with respect to the first bundling apparatus, and remaining parts may be separately operative with respect to the second bundling apparatus, or where parts of the orienting apparatus are operable with both the first and second bundling apparatus.

In a second configuration, the orienting apparatus is present, but is independent of the structural frame. Rather, a part of the orienting apparatus is mounted upon a part of the first bundling apparatus, and a further part is mounted upon the second bundling apparatus, such that when the first bundling apparatus and the second bundling apparatus or linearly displaced with regard to each other, the positioning and orientation of the plurality of paddles is also variable and movable with respect to both apparatus presents. Again, linear displacement and/or linear repositioning of the first bundling apparatus with regard to the second bundling apparatus may take place, without compromising the operation of the orienting apparatus which can be suitably reconfigured such that parts thereof remain operative with respect to the first bundling apparatus, and remaining parts may be operative with respect to the second bundling apparatus, or both apparatus.

In a third configuration, it is conceivable that a part of the structural frame is present and is used to support a part of the orienting apparatus, while a further part of the orienting apparatus is supported by a part of one or both of the first and/or second bundling apparatus. Again however, linear displacement and/or linear repositioning of the first bundling apparatus with regard to the second bundling apparatus may take place, without compromising the operation of the orienting apparatus which, can be suitably reconfigured such that parts thereof remain operative with respect to the first bundling apparatus, and remaining parts may be operative with respect to the second bundling apparatus, or both apparatus.

When a system and apparatus comprises a structural frame in addition to the first bundling apparatus, a second bundling apparatus, and the flexible bridge apparatus, further component parts may also be present and affixed to the structural frame, and kept separate from the first bundling apparatus and/or the second bundling apparatus. Such may be advantageous wherein it is desired to separate functional features or components which provide specific functional features of the overall system and apparatus. For example, a system controller for monitoring and or controlling the operation of the system and apparatus may be provided as a part of the structural frame or as a unit affixed to a part of the structural frame. Such separation allows for convenient operator oversight and/or intervention if necessary. Various sensors may also be affixed to parts of the structural frame, or such are not necessarily required to be present as a part of any of the bundling apparatus or the flexible bridge apparatus. It is also contemplated that portions of the flexible bridge apparatus may, if desirable or necessary, be affixed to a part of the structural frame in order to provide an anchorage or support point thereto. The structural frame may also be used to support one or more panels which may be included from a safety perspective to obscure and provide a barrier to moving parts of the system and apparatus. In certain preferred embodiments, the dimensions of the structural frame are such that it encompasses within it parts of, or preferably all of, the one or both of the bundling apparatus present and/or the flexible bridge apparatus.

Further aspects of the invention will be apparent from a further consideration of the following specification, which discloses preferred embodiments, as well as alternative embodiments. In the various drawings, like numbered/labeled elements are shown throughout the various drawing figures.

FIG. 1(*b*) depicts a prior art tandem apparatus which includes a first bundling apparatus and a second bundling apparatus, in a second configuration.

FIG. 1(*c*) depicts a prior art tandem apparatus which includes a first bundling apparatus and a second bundling apparatus, in a third configuration.

FIG. 1(*d*) depicts a prior art tandem apparatus which includes a first bundling apparatus and a second bundling apparatus, in a fourth configuration.

FIG. 1(*e*) depicts a prior art tandem apparatus which includes a first bundling apparatus and a second bundling apparatus, in a fifth configuration.

FIG. 1(*f*) depicts a prior art tandem apparatus which includes a first bundling apparatus and a second bundling apparatus, in a sixth configuration.

FIG. 6(*a*) illustrates an embodiment of a flexible bridge apparatus.

Figure 9:
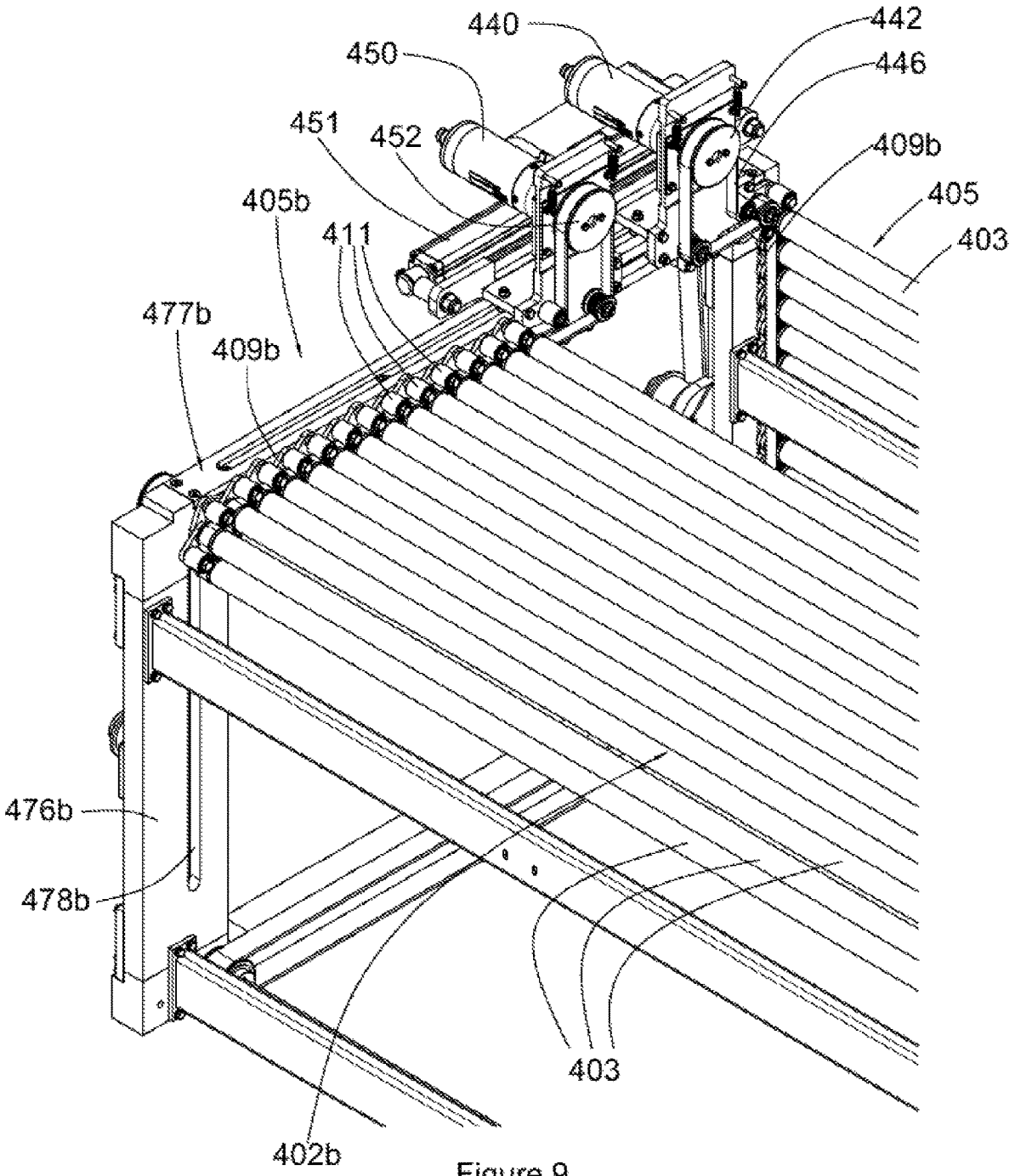

FIG. 9 provides a perspective view a part of a flexible bridge positioning apparatus.

Figure 10:
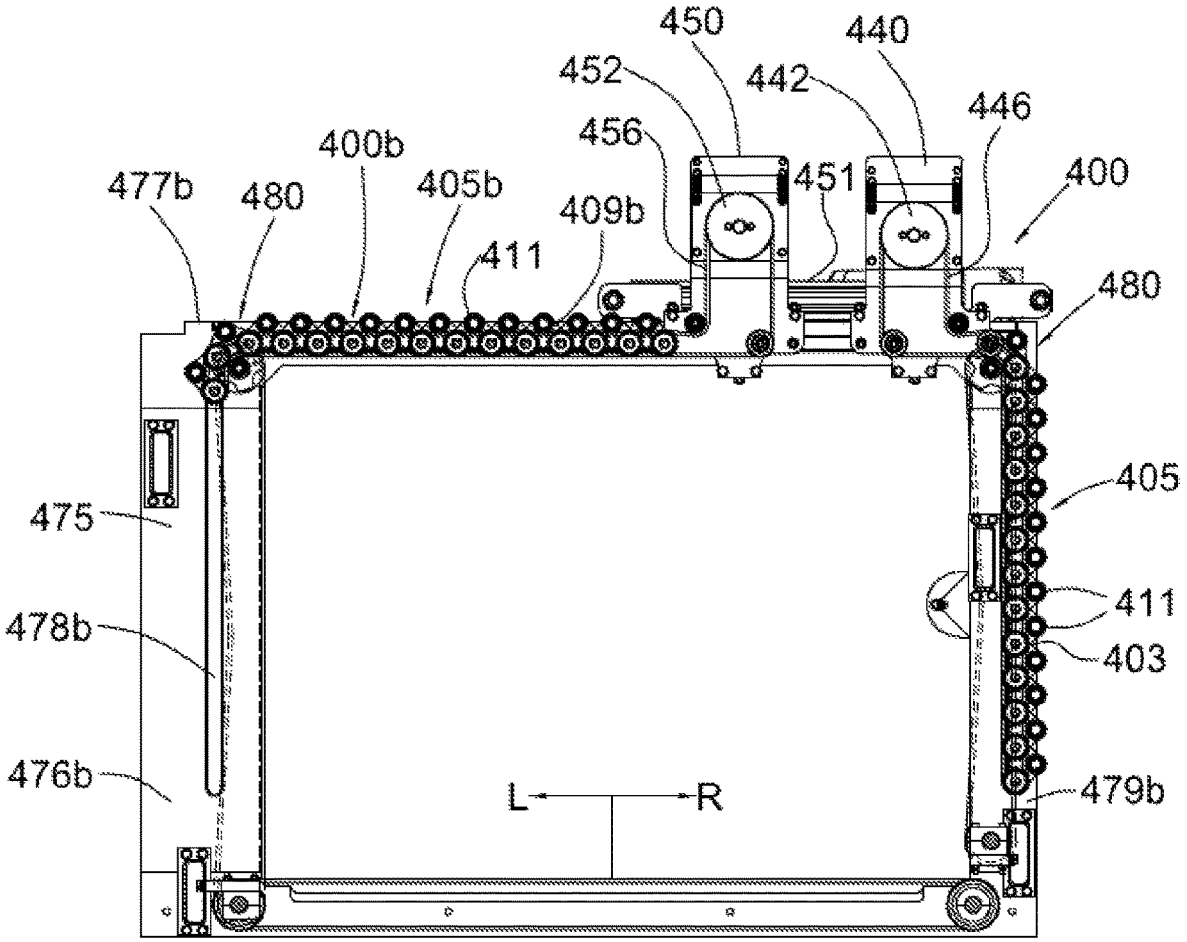

FIG. 10 illustrates an elevation view of a flexible bridge positioning apparatus in a first configuration.

Figure 11:
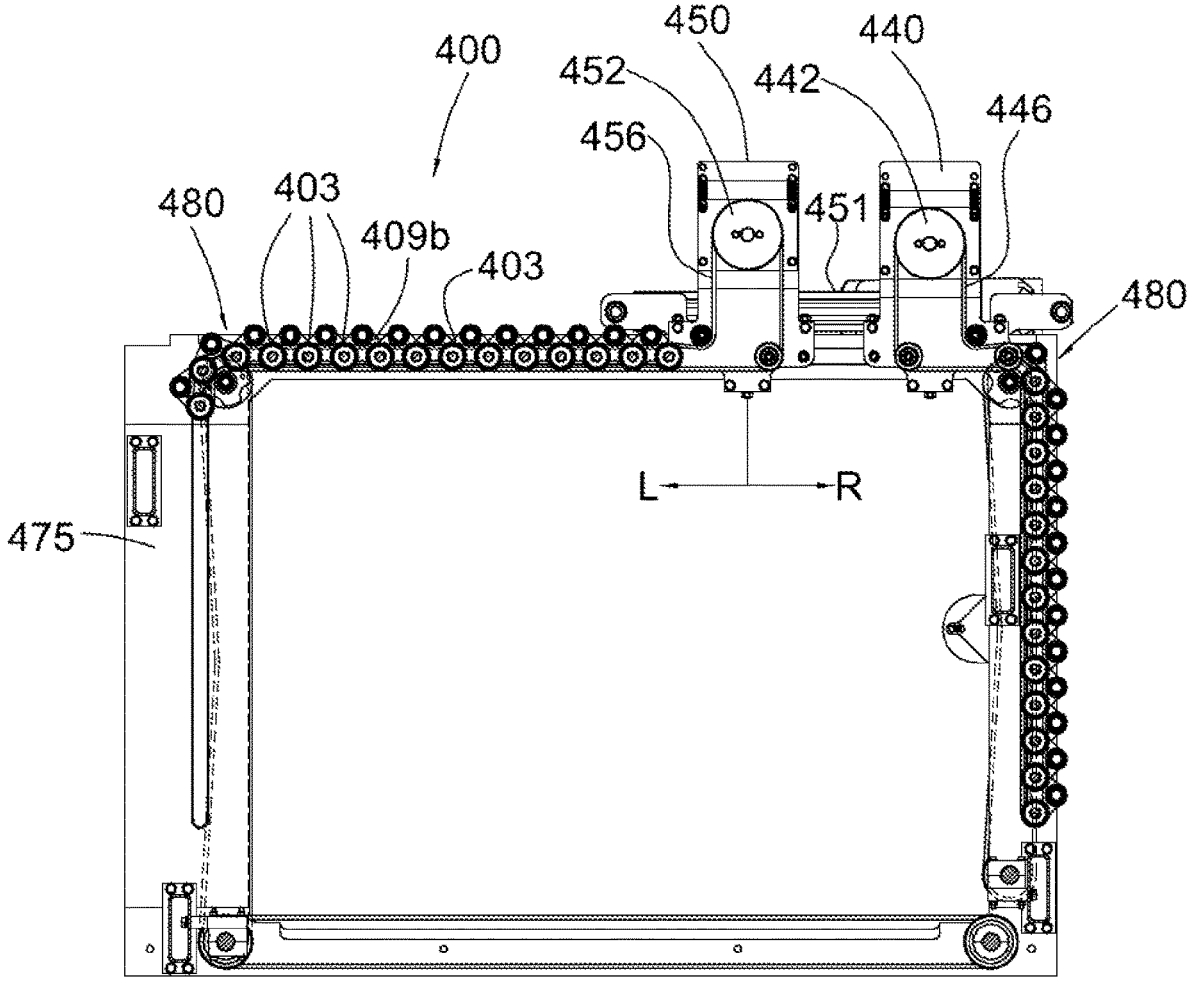

FIG. 11 shows an elevation view of a flexible bridge positioning apparatus in a second configuration.

Figure 12:
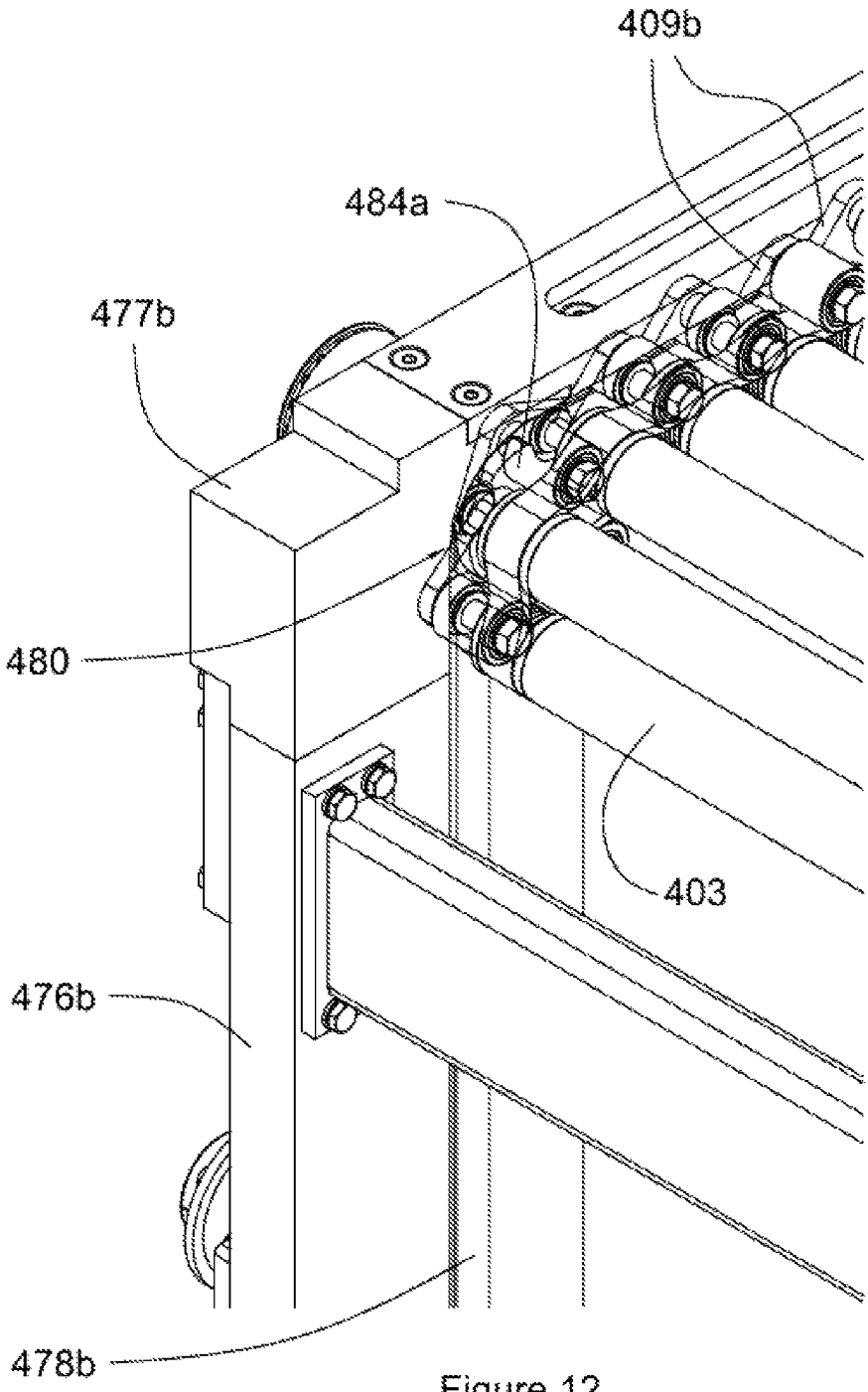

FIG. 12 depicts a perspective view of a part of a flexible bridge positioning apparatus in a third configuration.

Figure 13:
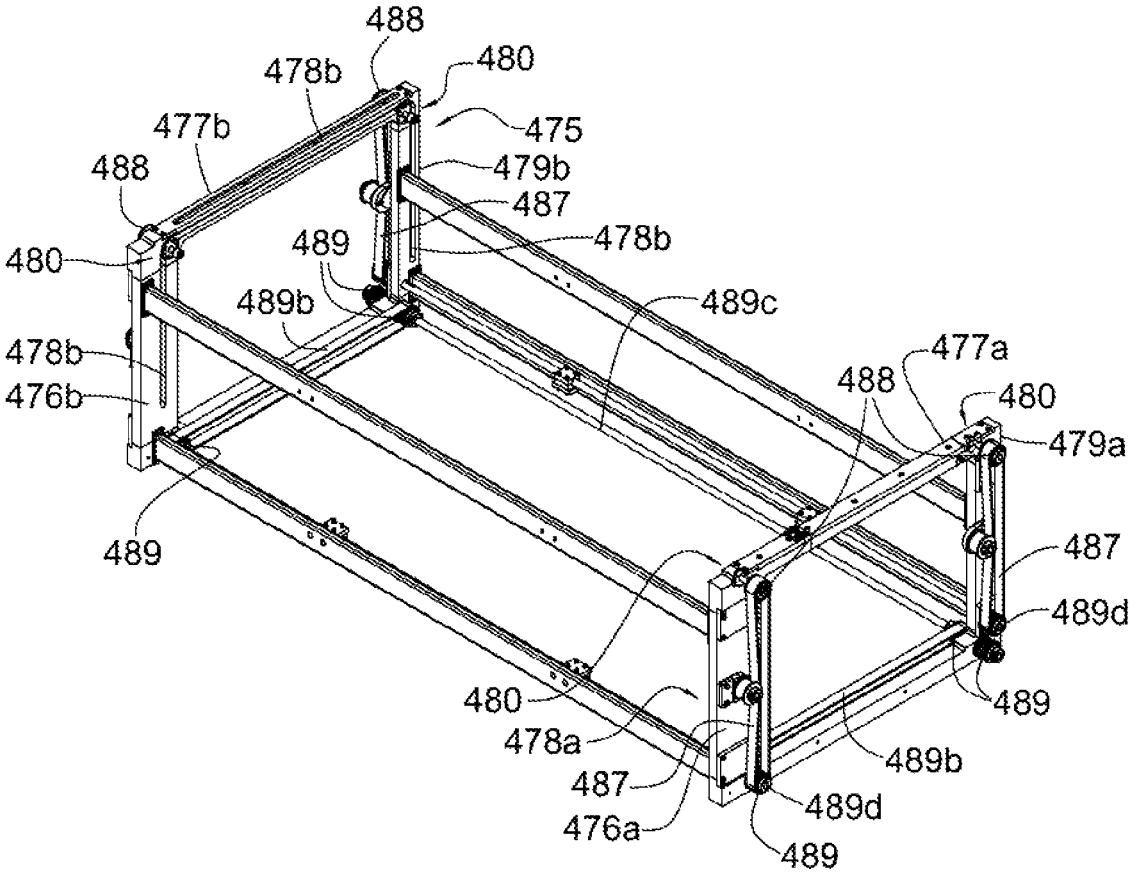

FIG. 13 provides a perspective view of an embodiment of a bridge support frame.

Figure 14A:
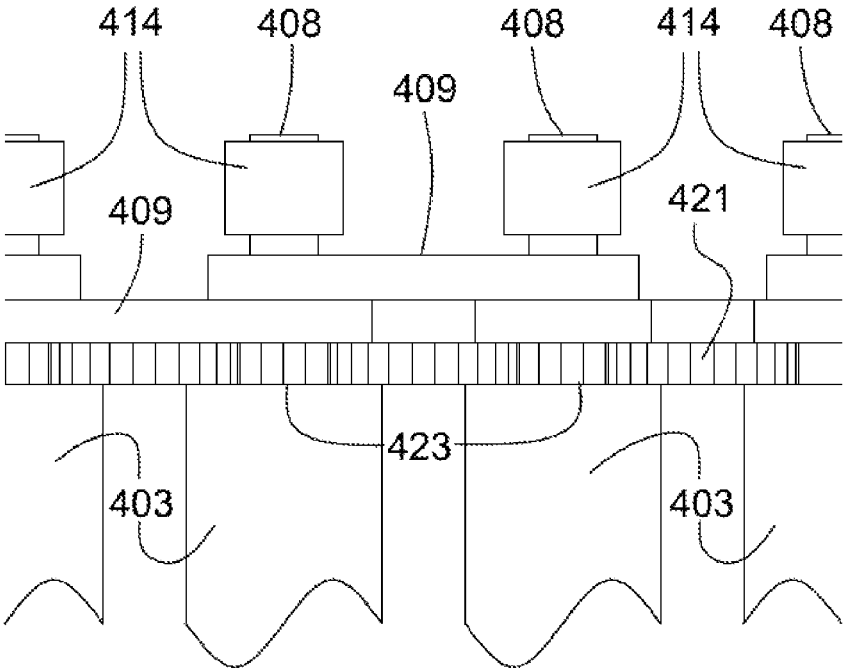
Figure 14B:
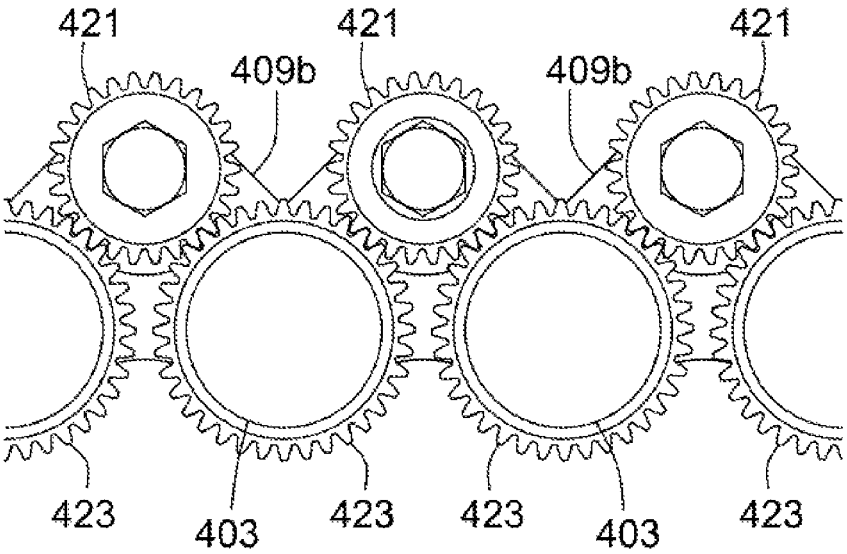

FIG. 14(*a*) illustrates a view of parts of rollers of an array in a top view.

FIG. 14(*b*) illustrates a view of rollers of an array in an elevation view.

Figure 15A:
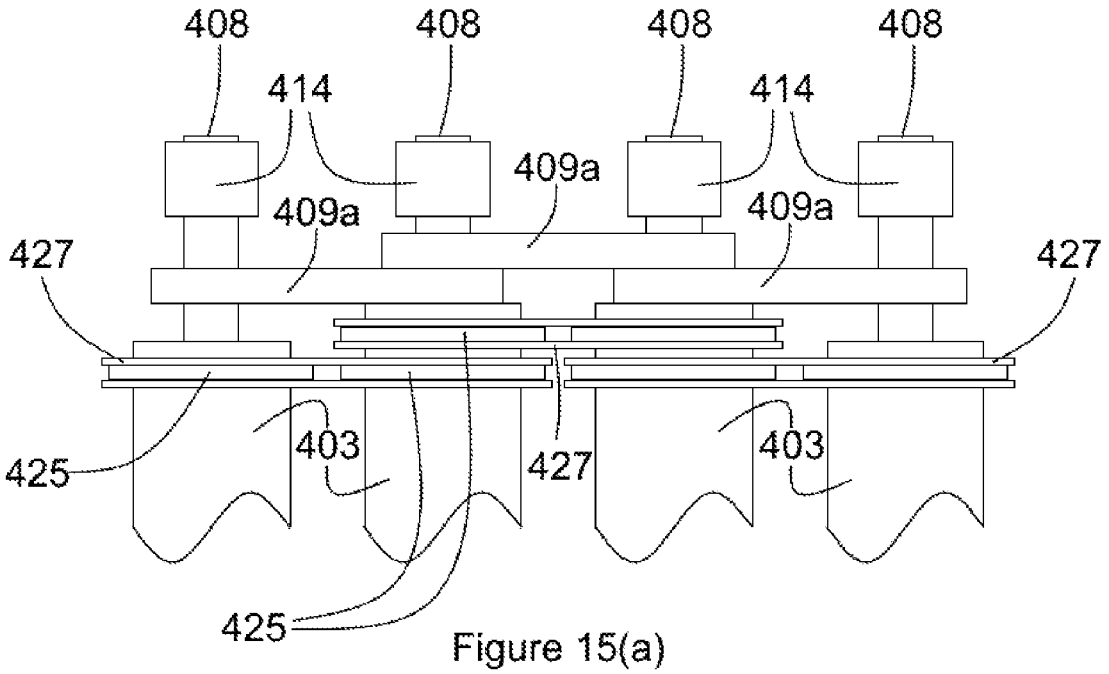
Figure 15B:
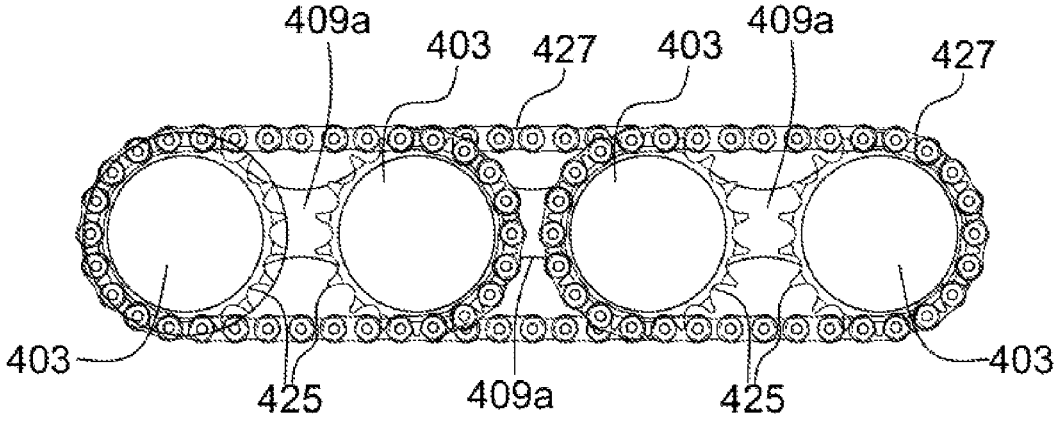

FIG. 15(*a*) depicts a tope view of parts of further rollers of an array.

FIG. 15(*b*) illustrates a view of further rollers of an array in an elevation view.

Figure 16A:
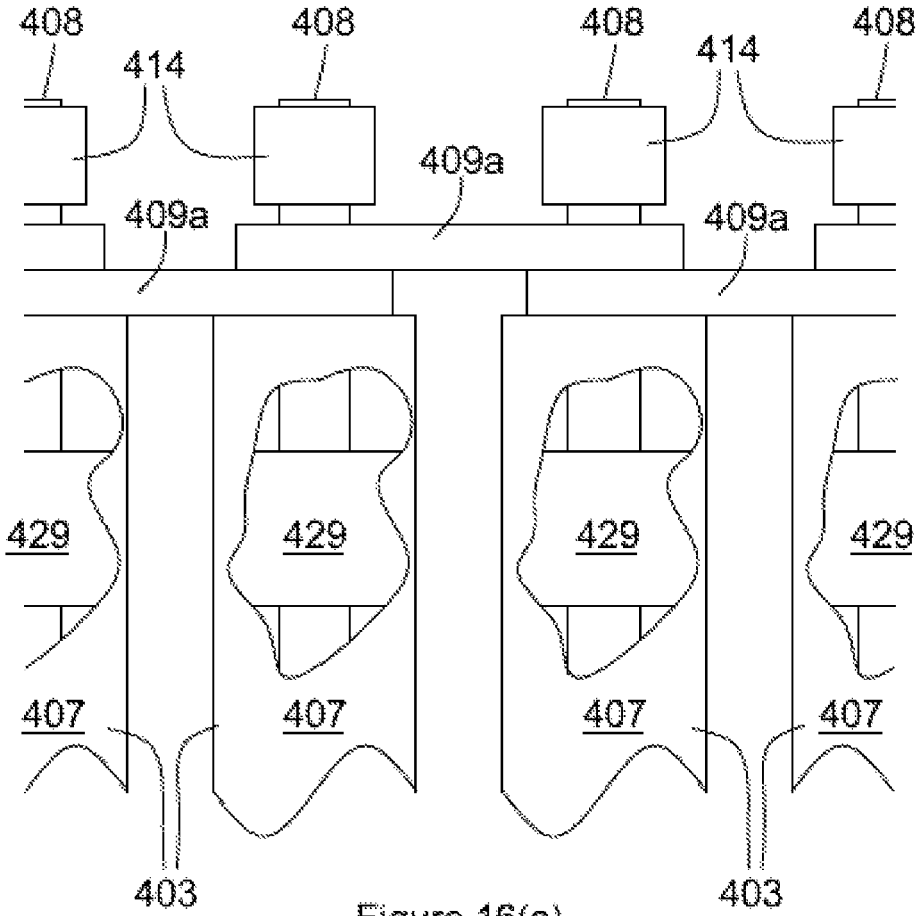
Figure 16B:
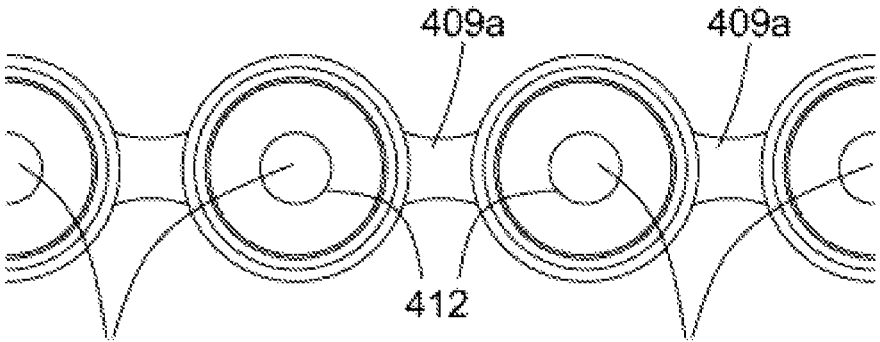

FIG. 16(*a*) depicts in top view, a part of the ends of rollers forming part of an array, the rollers mounted on interlinked support plates.

FIG. 16(*b*) illustrates a part of the ends of rollers forming part of an array, the rollers mounted on interlinked support plates, in an elevation view.

Figure 17A:
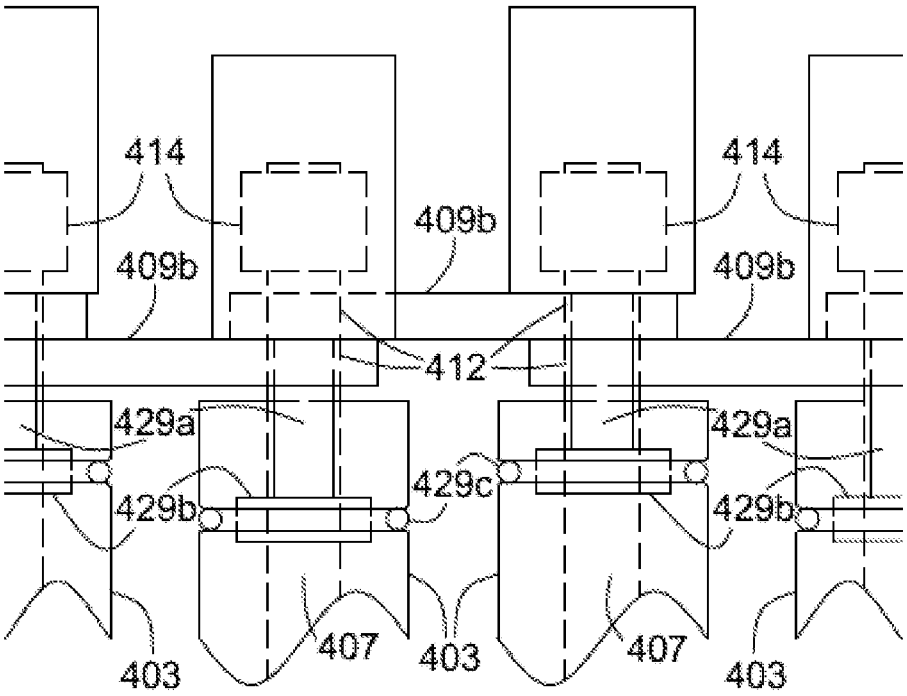
Figure 17B:
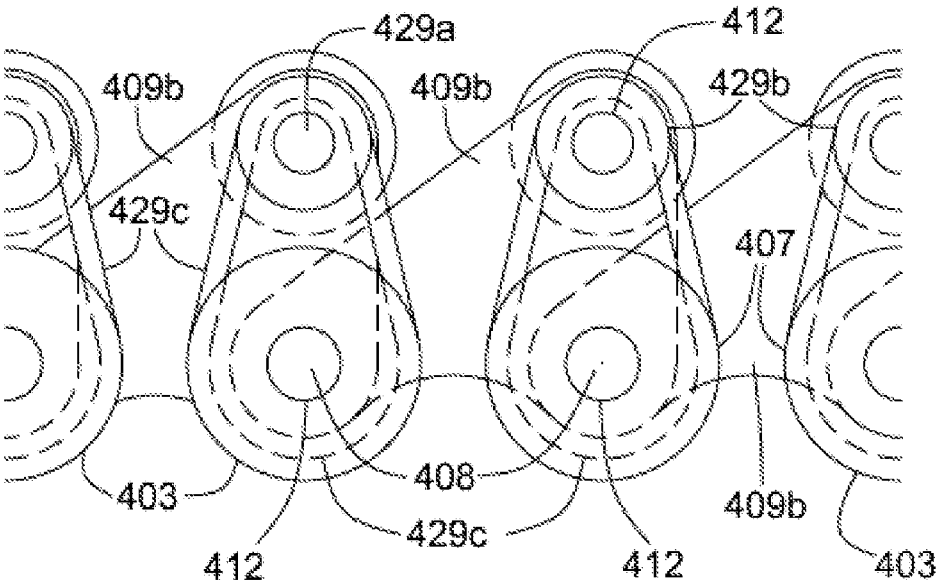

FIG. 17(*a*) depicts in top view, a part of the ends of rollers forming part of an array, the rollers mounted on trigonal support plates.

FIG. 17(*b*) illustrates a part of the ends of rollers forming part of an array, the rollers mounted on trigonal support plates, in an elevation view.

Figure 18:
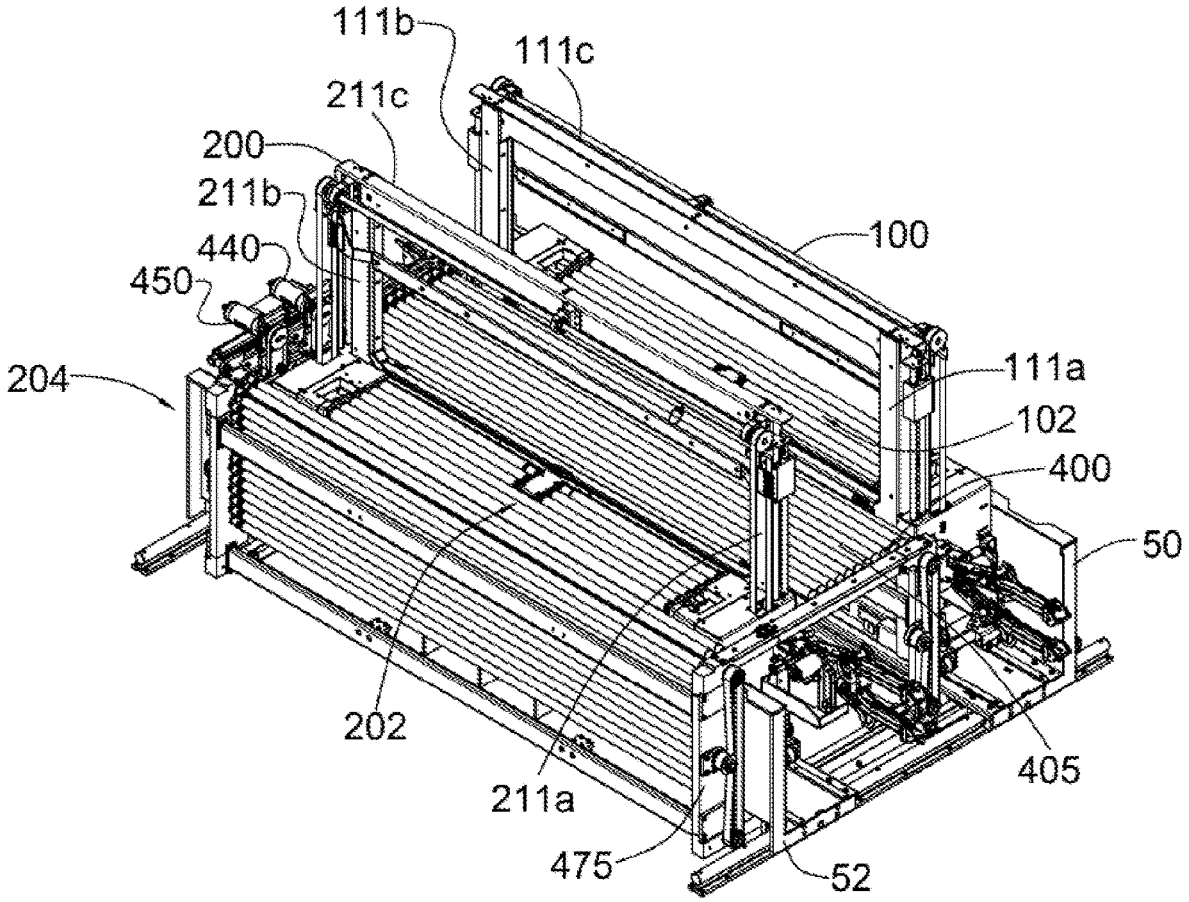

FIG. 18 a perspective view of a first bundling apparatus, a second bundling apparatus, a flexible bridge apparatus with an upper transport surface formed from part of the array spanning between stages of the first and second bundling apparatus.

Figure 19:
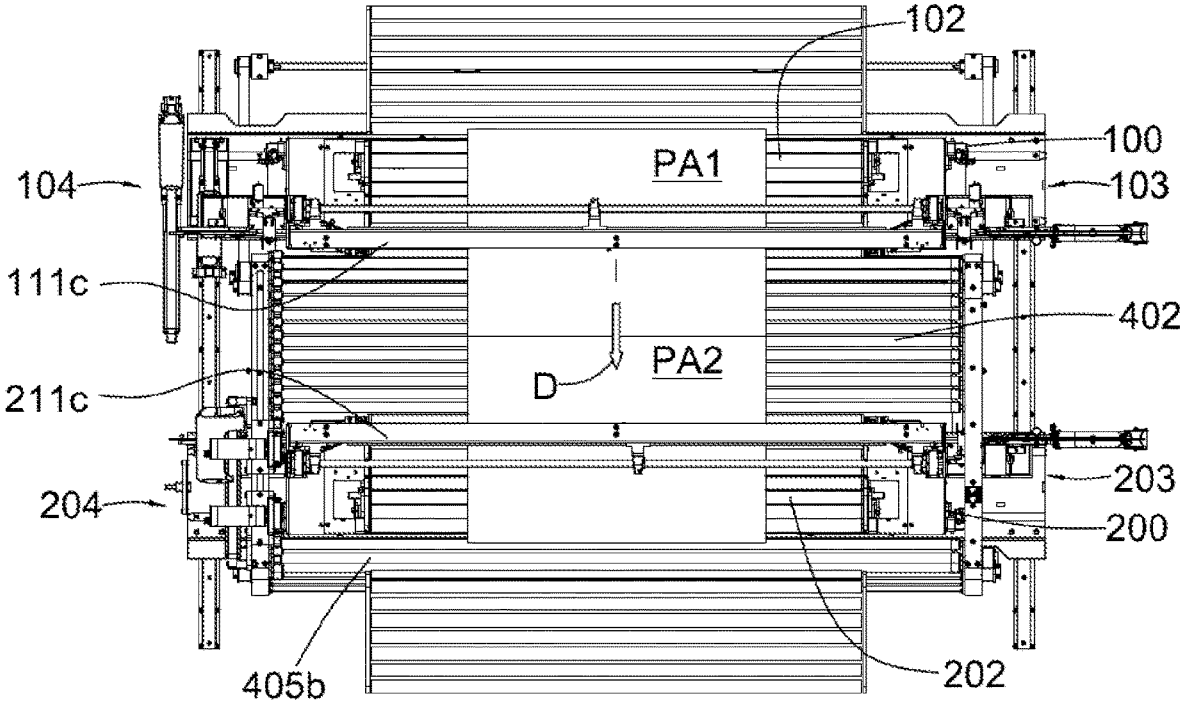
Figure 20A:
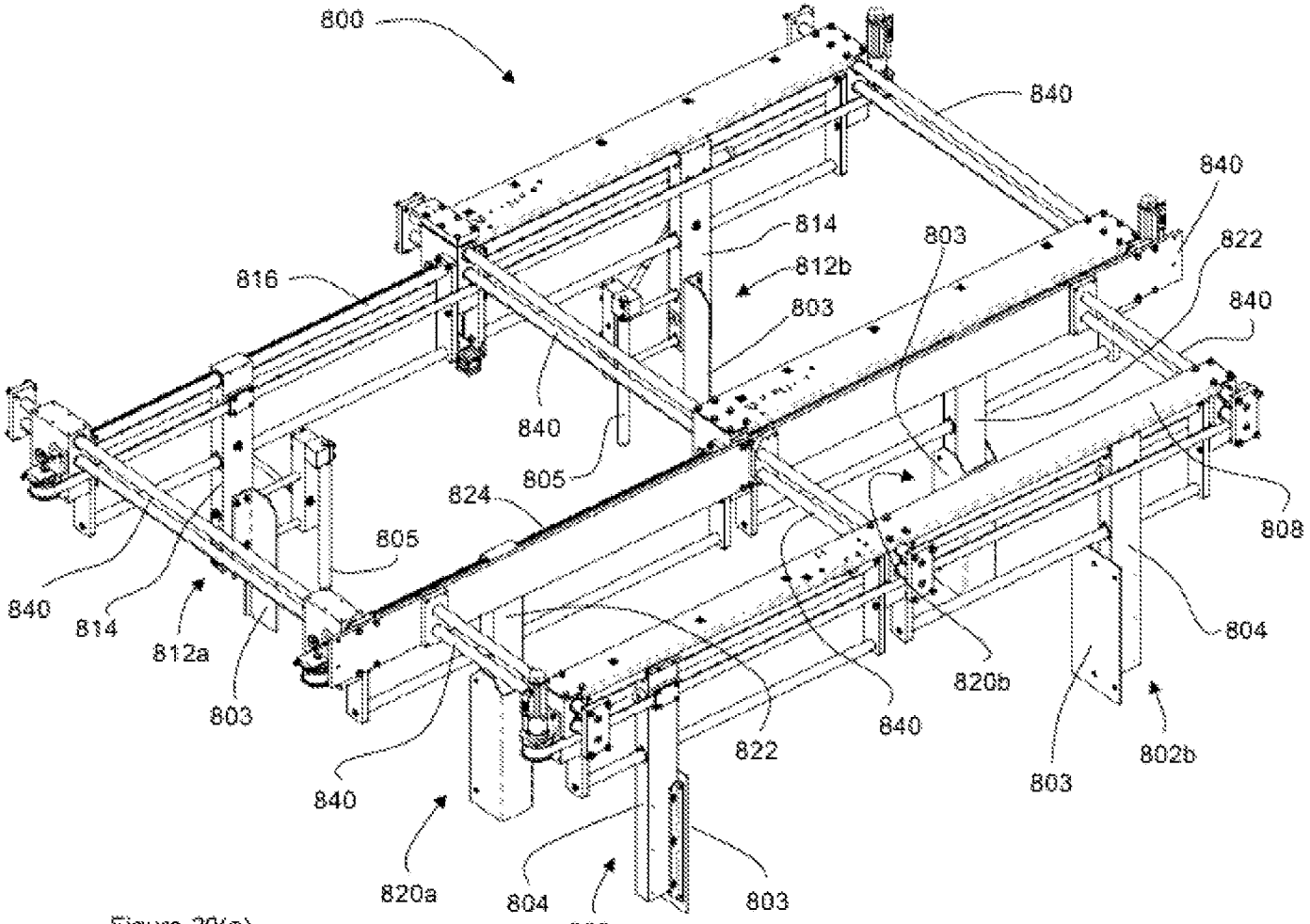
Figure 20B:
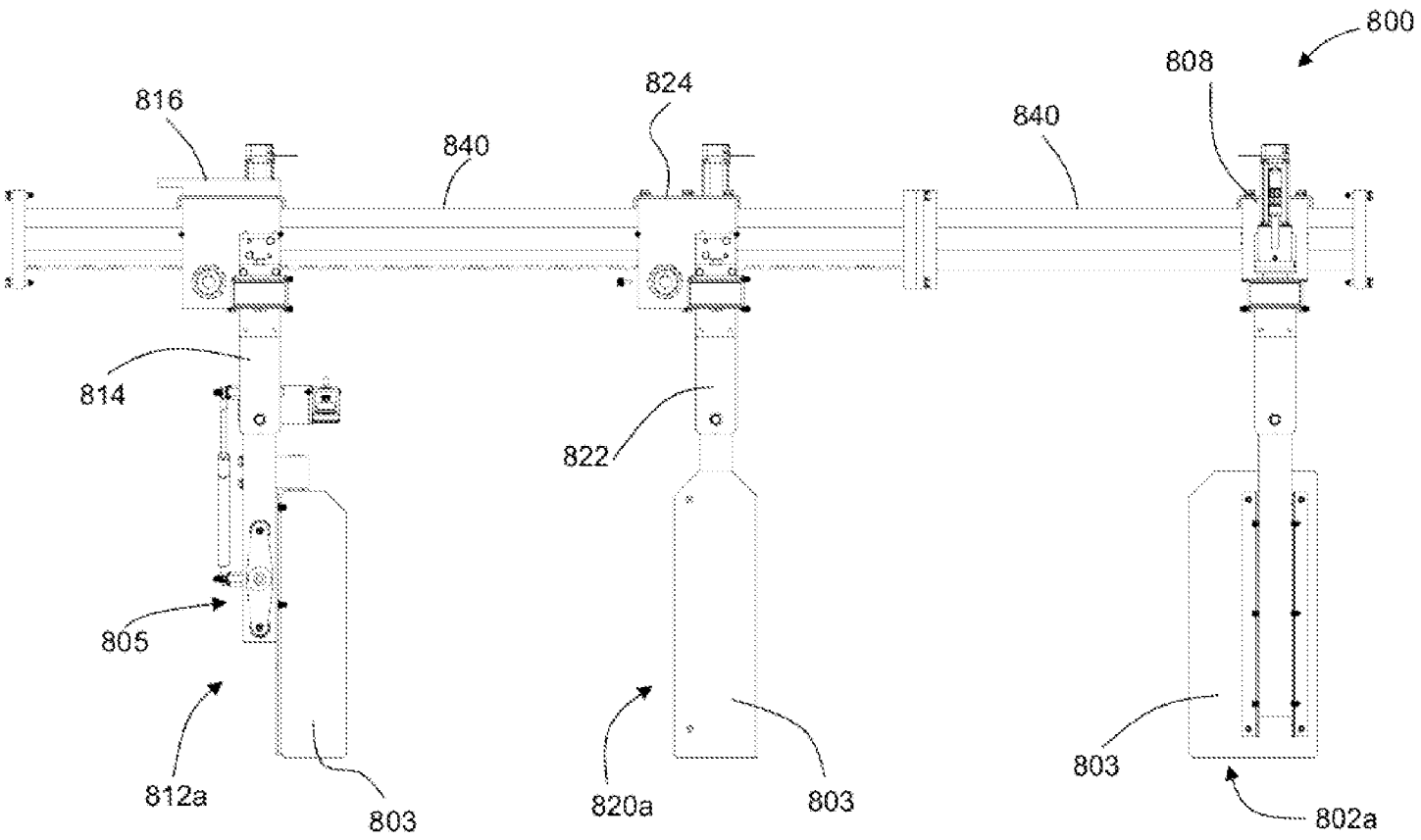
Figure 20C:
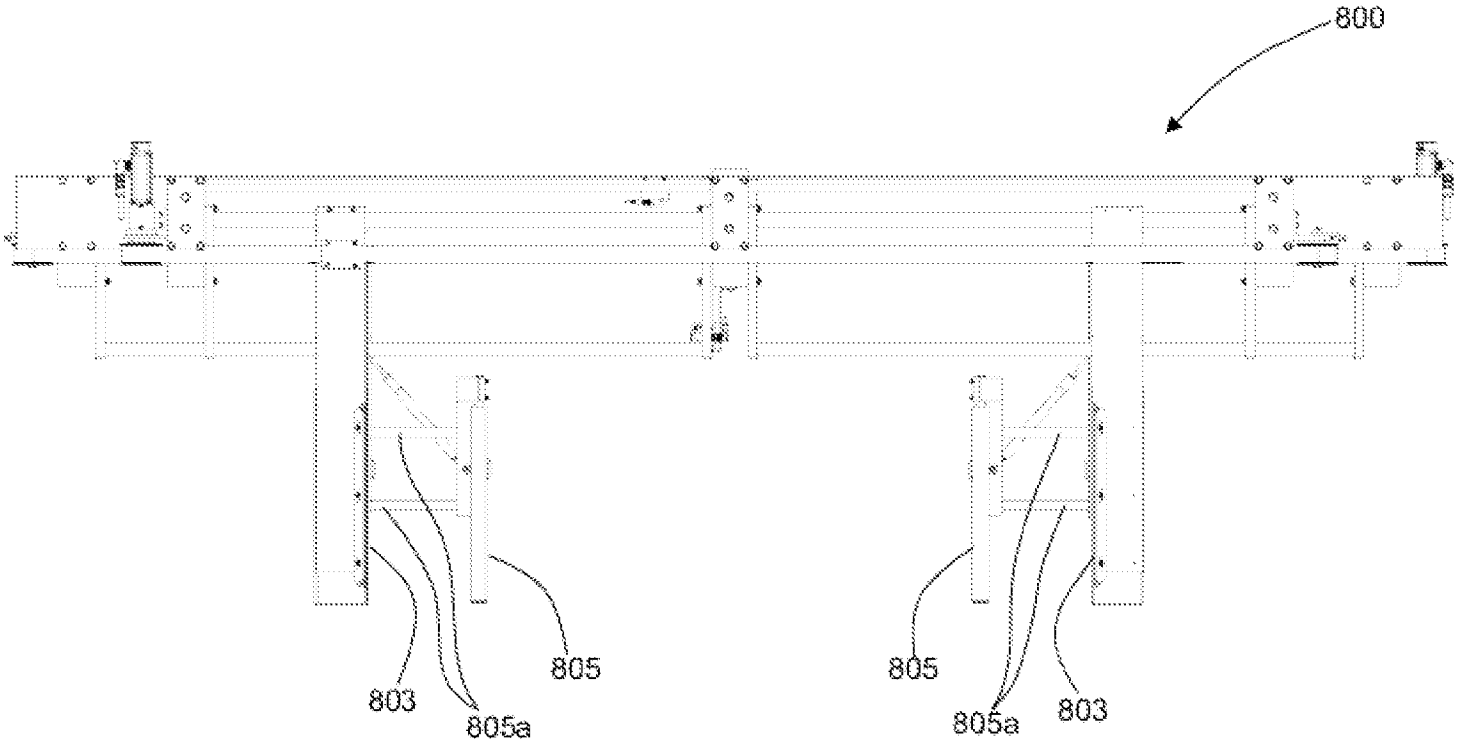
Figure 20D:
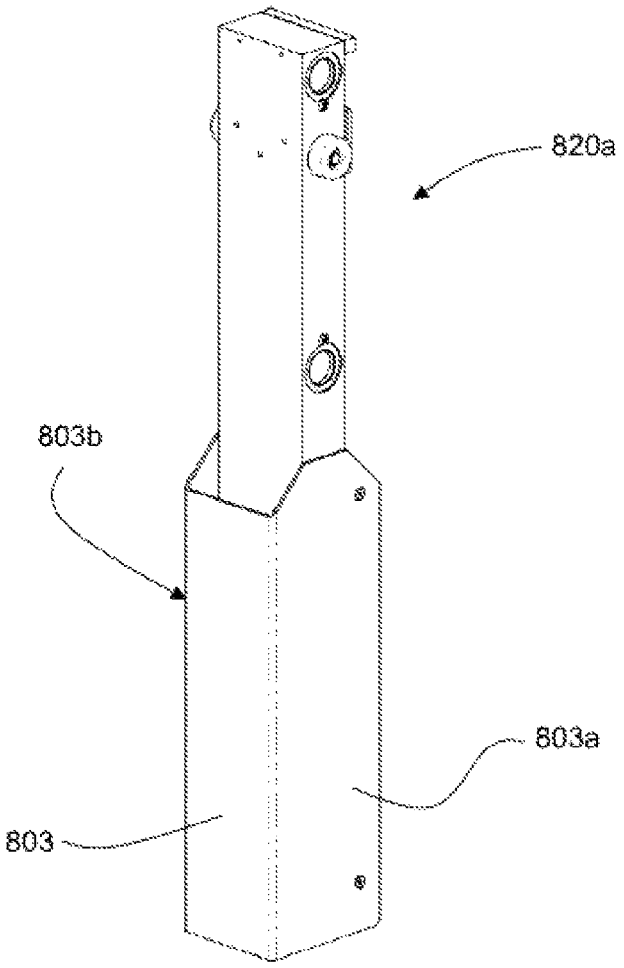

FIG. 19 depicts in a top view a part of a system and apparatus and two individual packaging articles.

FIG. 20(*a*) shows a perspective view of an orienting apparatus.

FIG. 20(*b*) depicts a side elevation view of an orienting apparatus.

FIG. 20(*c*) shows another side elevation view of an orienting apparatus.

FIG. 20(*d*) illustrates a perspective view of an intermediate paddle assembly.

Figure 21A:
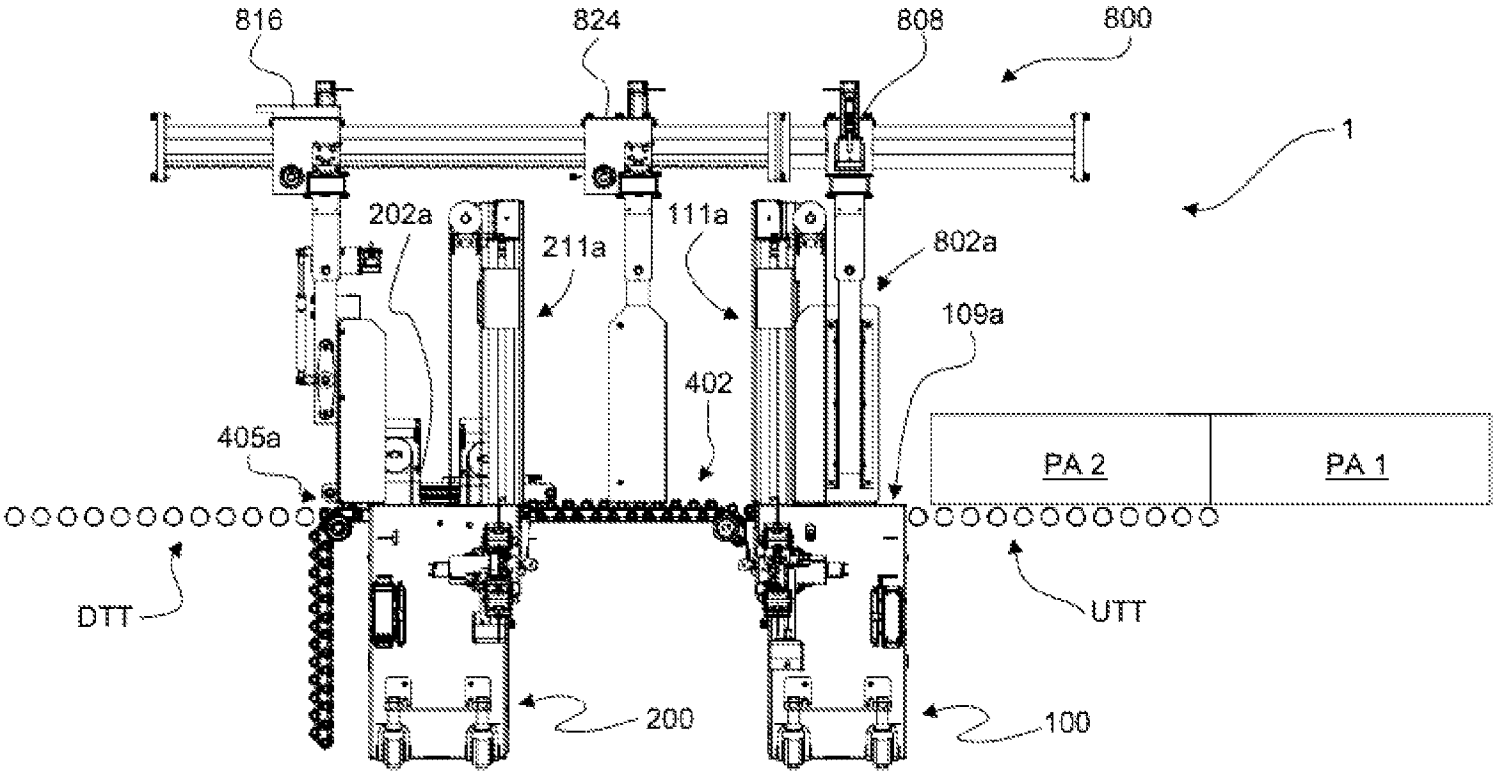
Figure 21B:
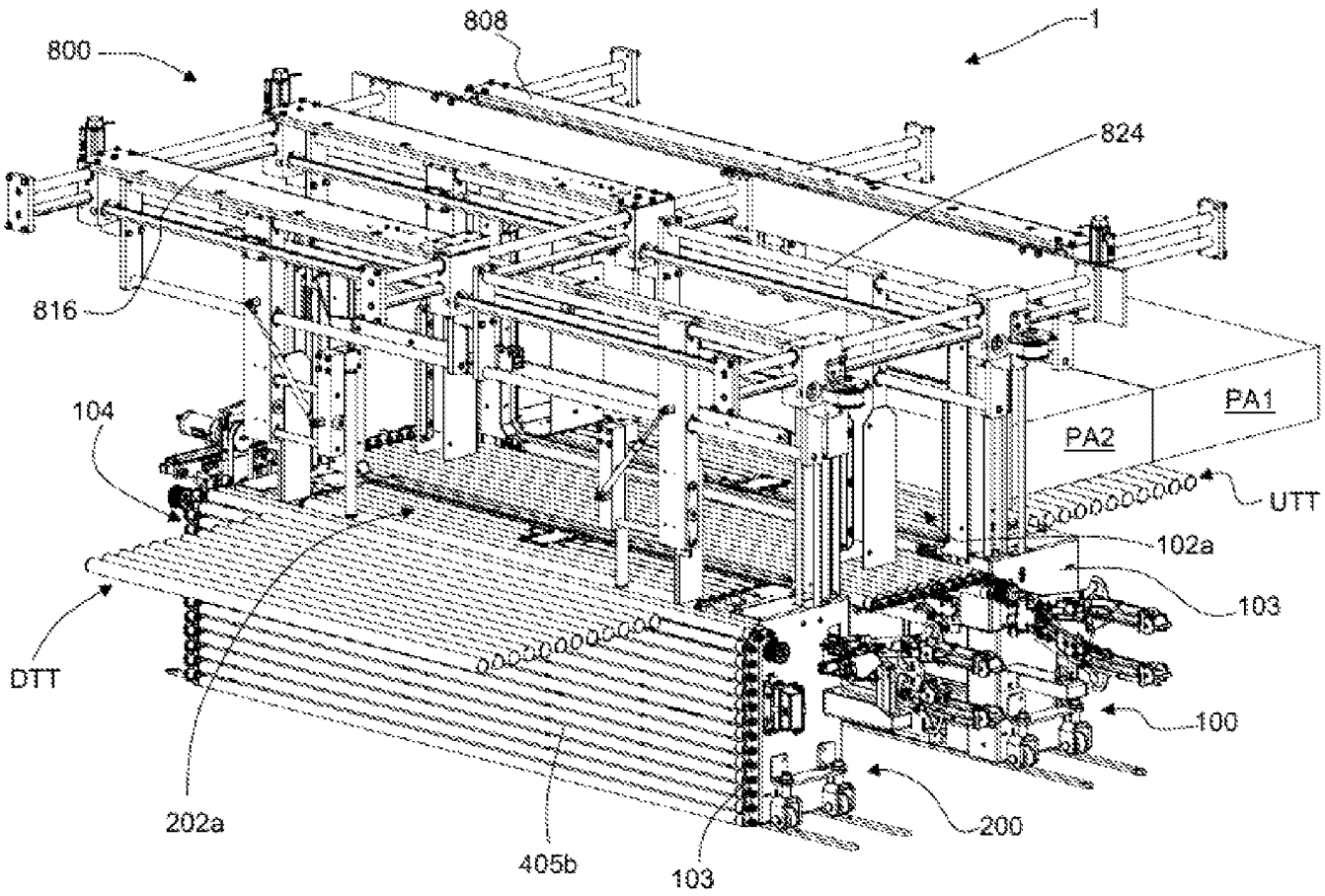

FIG. 21(*a*) depicts in an elevational view a system and apparatus according to an embodiment of the invention, in a first configuration.

FIG. 21(*b*) shows a perspective view a system and apparatus according to an embodiment of the invention.

Figure 1A:
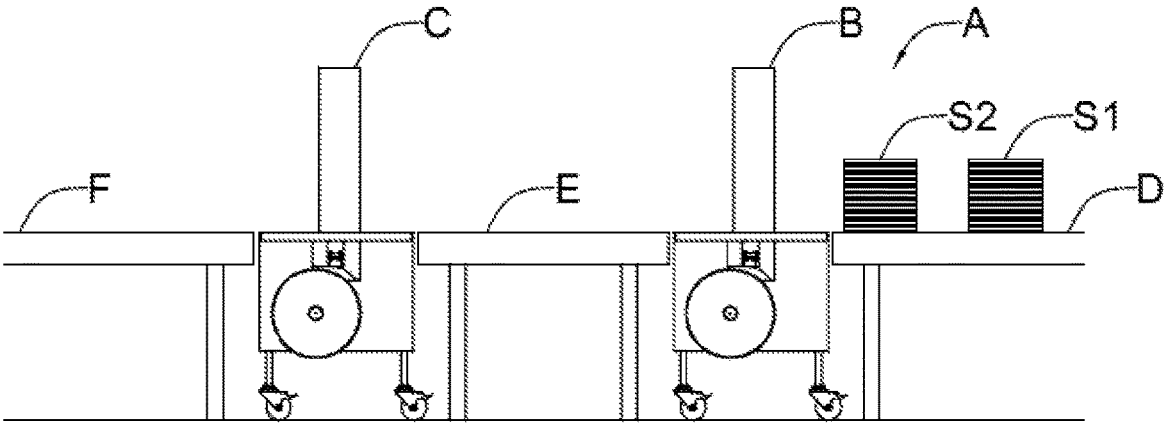
Figure 1(a) (prior art)
FIG. 1(*a*) depicts a prior art tandem apparatus which includes a first bundling apparatus and a second bundling apparatus, in a first configuration.
Figure 1B:
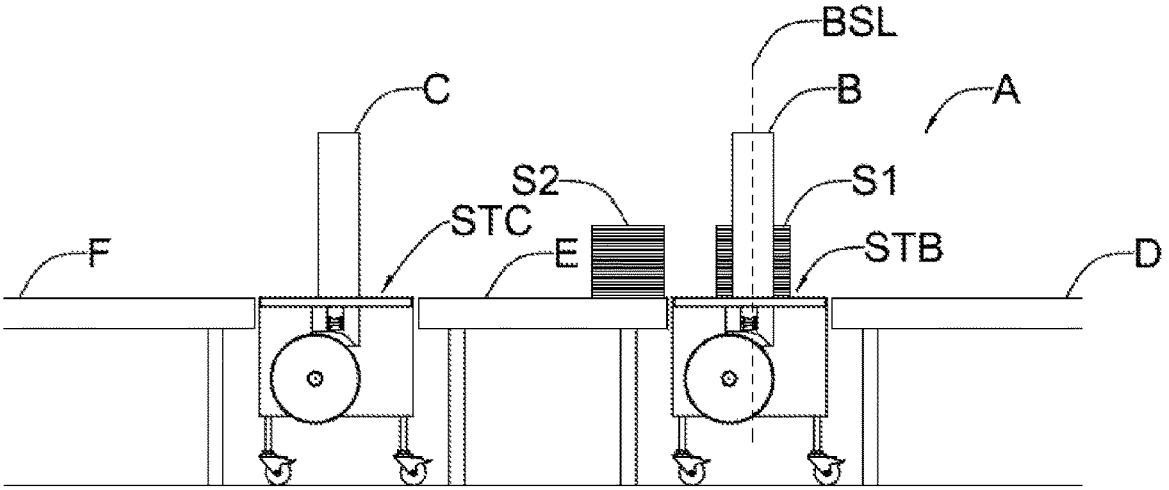
Figure 1(b) (prior art)
Figure 1C:
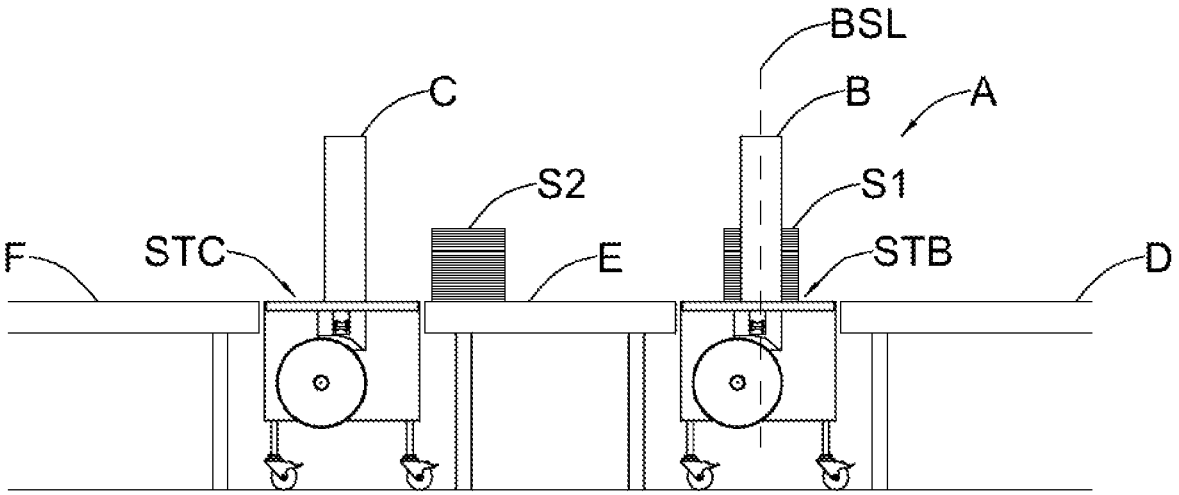
Figure 1(c) (prior art)
Figure 1D:
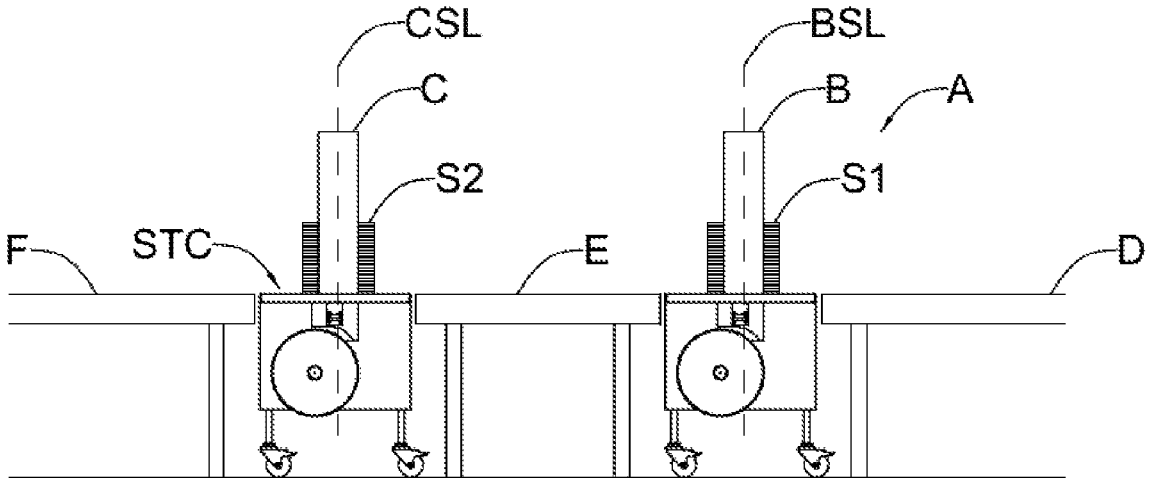
Figure 1(d) (prior art)
Figure 1E:
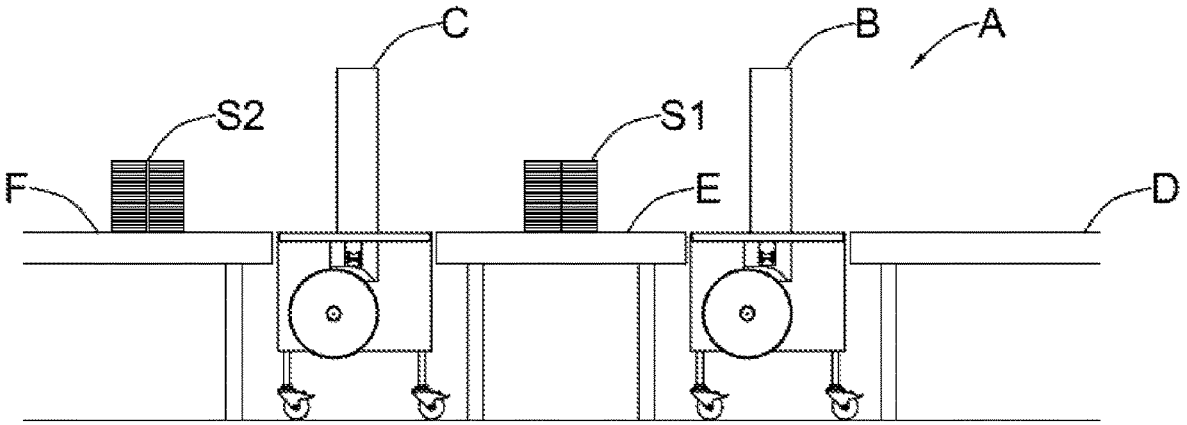
Figure 1(e) (prior art)
Figure 1F:
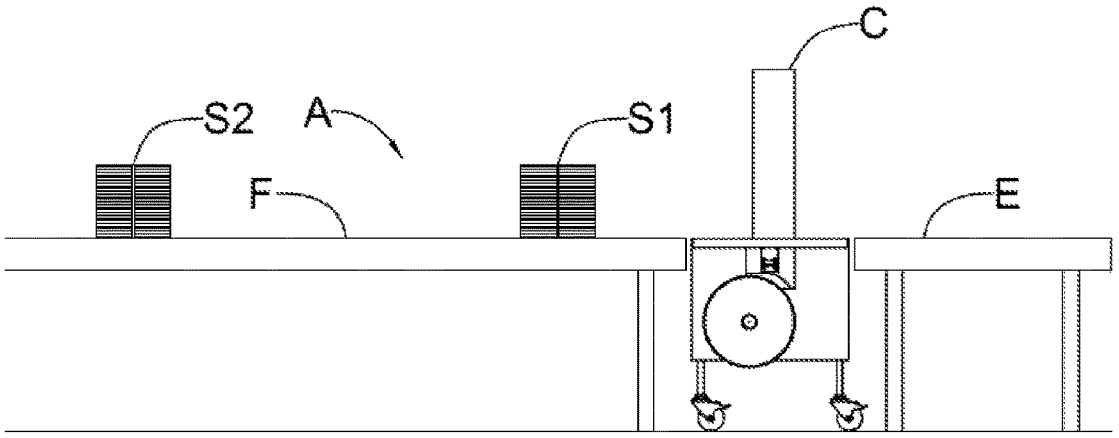
Figure 1(f) (prior art)
Figure 2:
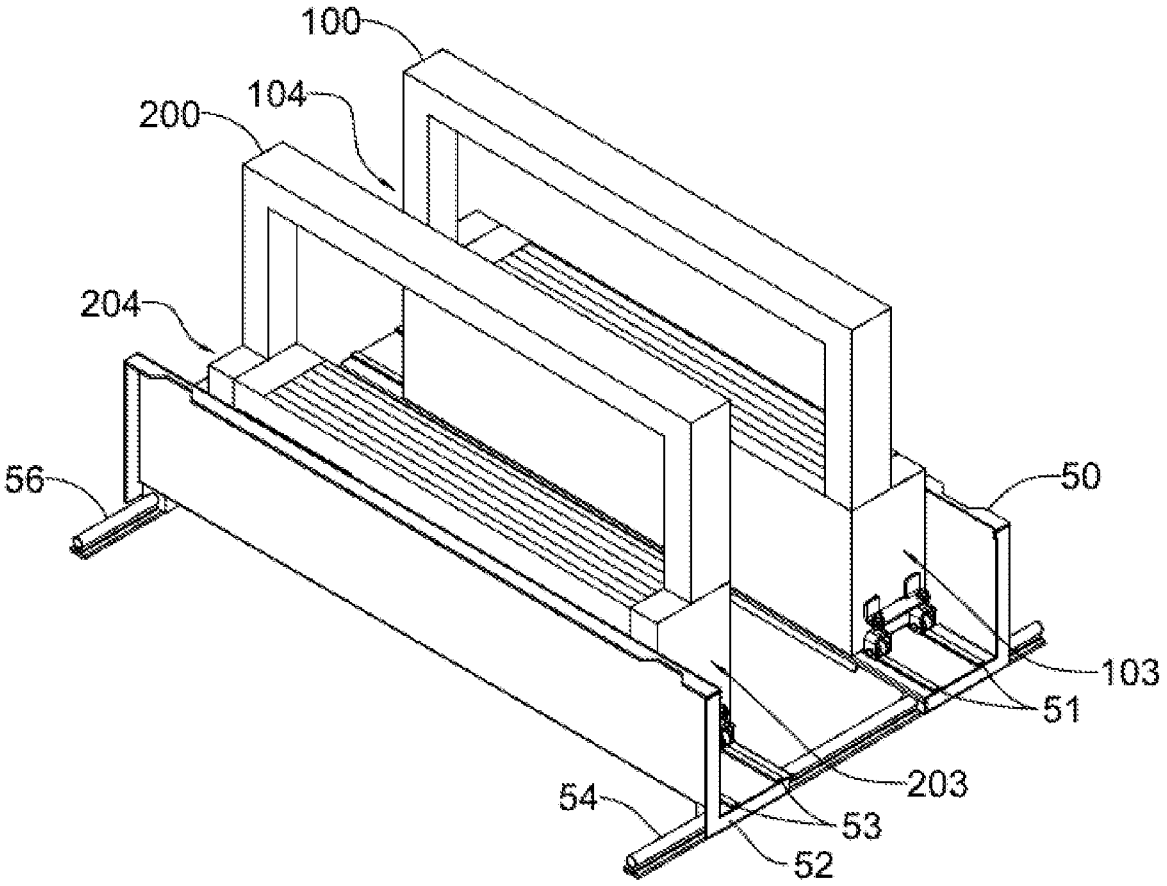
FIG. 2 is a perspective view a first bundling apparatus and a second bundling apparatus on separate moveable platforms movably afixed to spaced apart transport tracks.

FIG. 2(*a*) illustrates in an elevational view a system and apparatus according to an embodiment of the invention, in a second configuration.

Figure 22A:
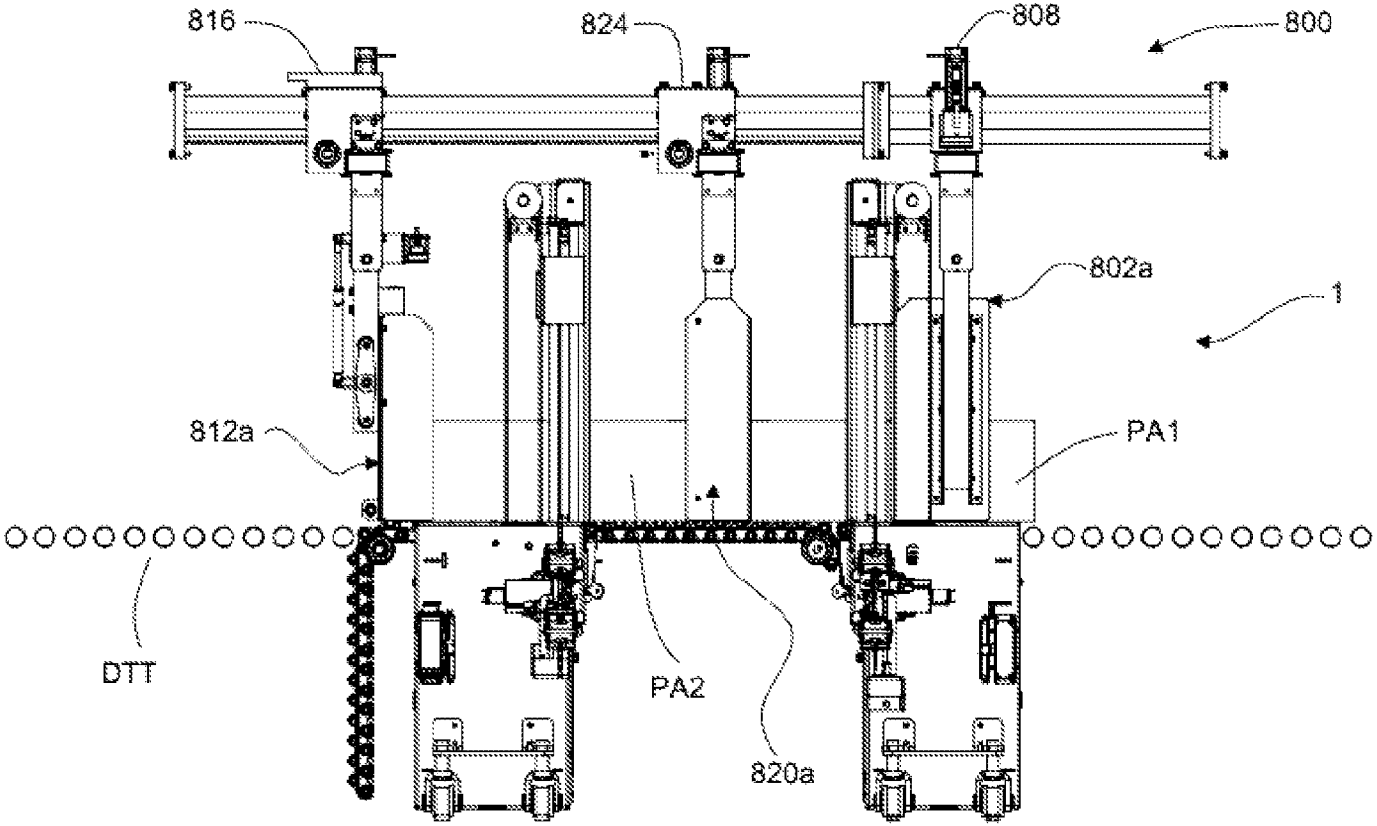
Figure 22B:
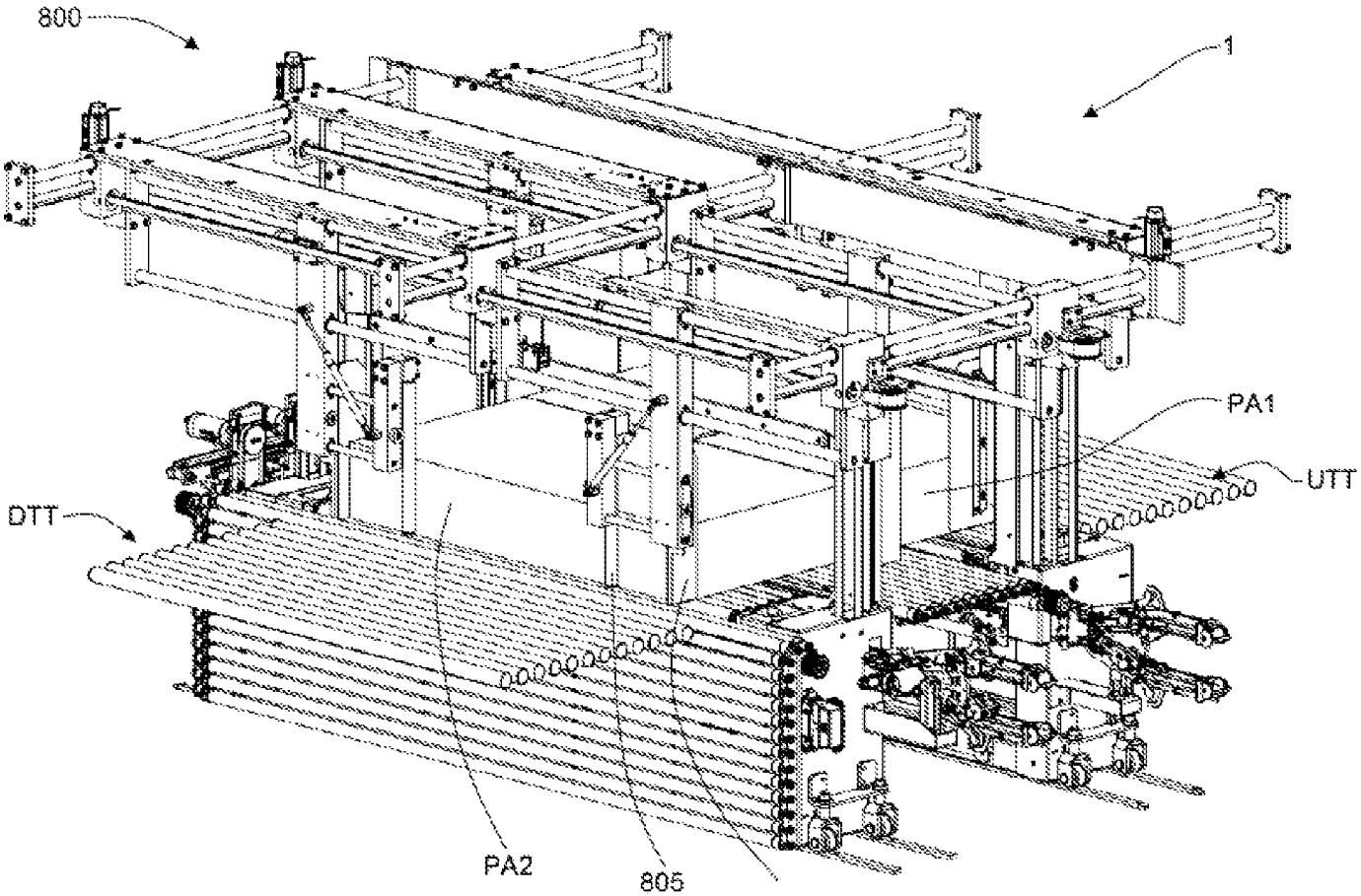

FIG. 22(*b*) shows a perspective view a system and apparatus according to an embodiment of the invention.

Figure 23A:
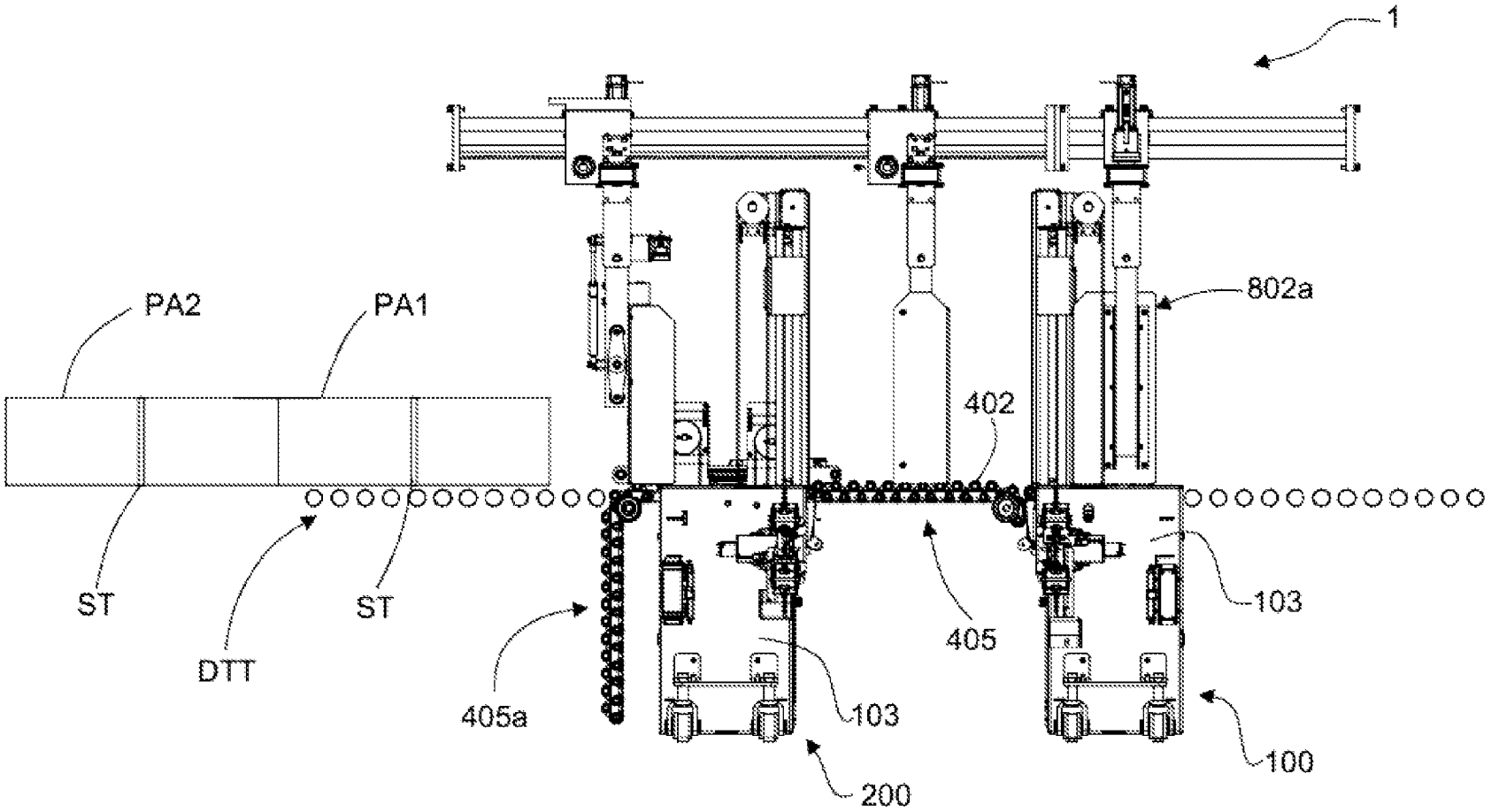
Figure 23B:
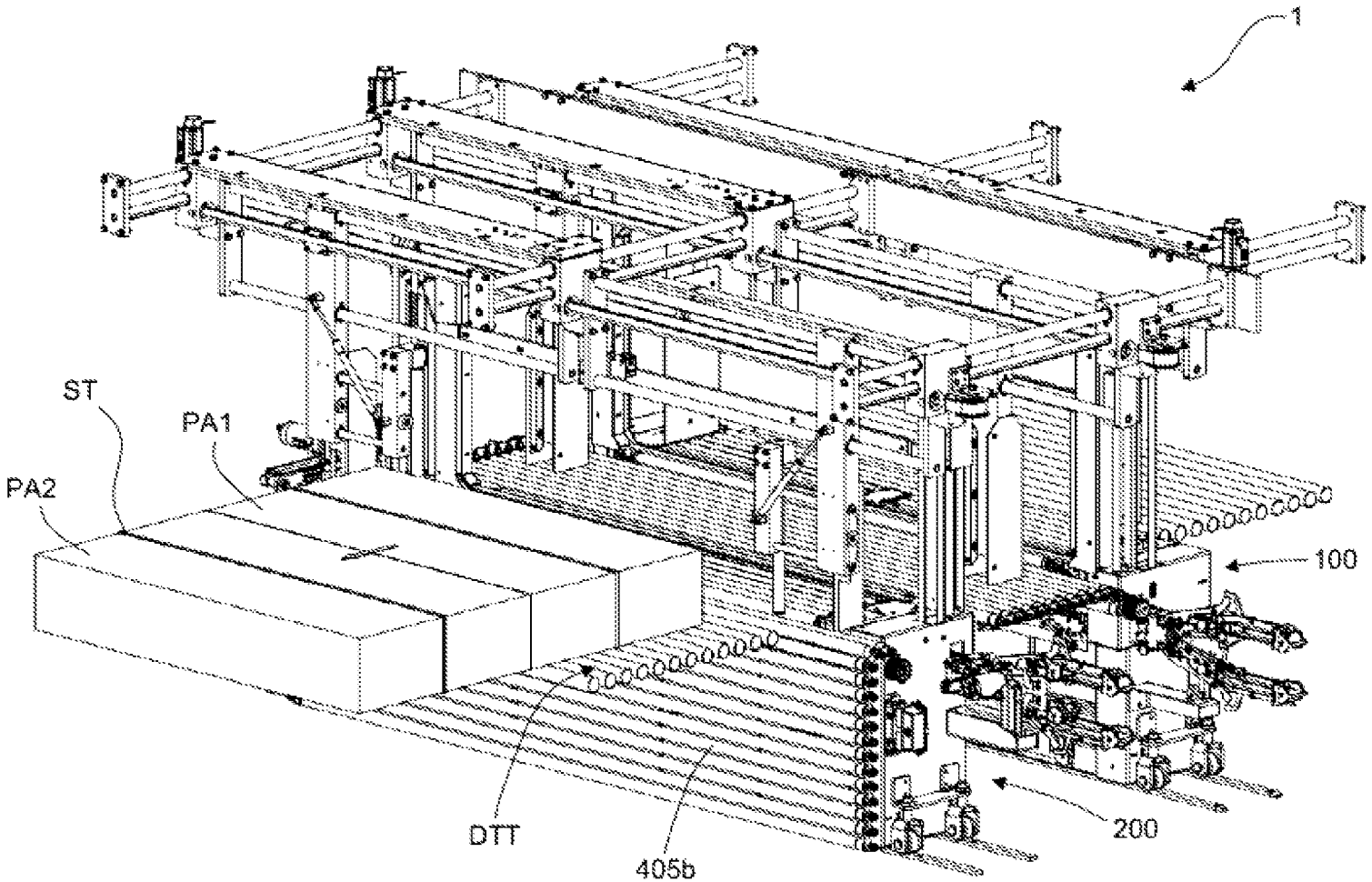

FIG. 23(*a*) illustrates in an elevational view a system and apparatus according to an embodiment of the invention, in a third configuration.

FIG. 23(*b*) depicts a perspective view of a system and apparatus according to an embodiment of the invention.

Figure 24:
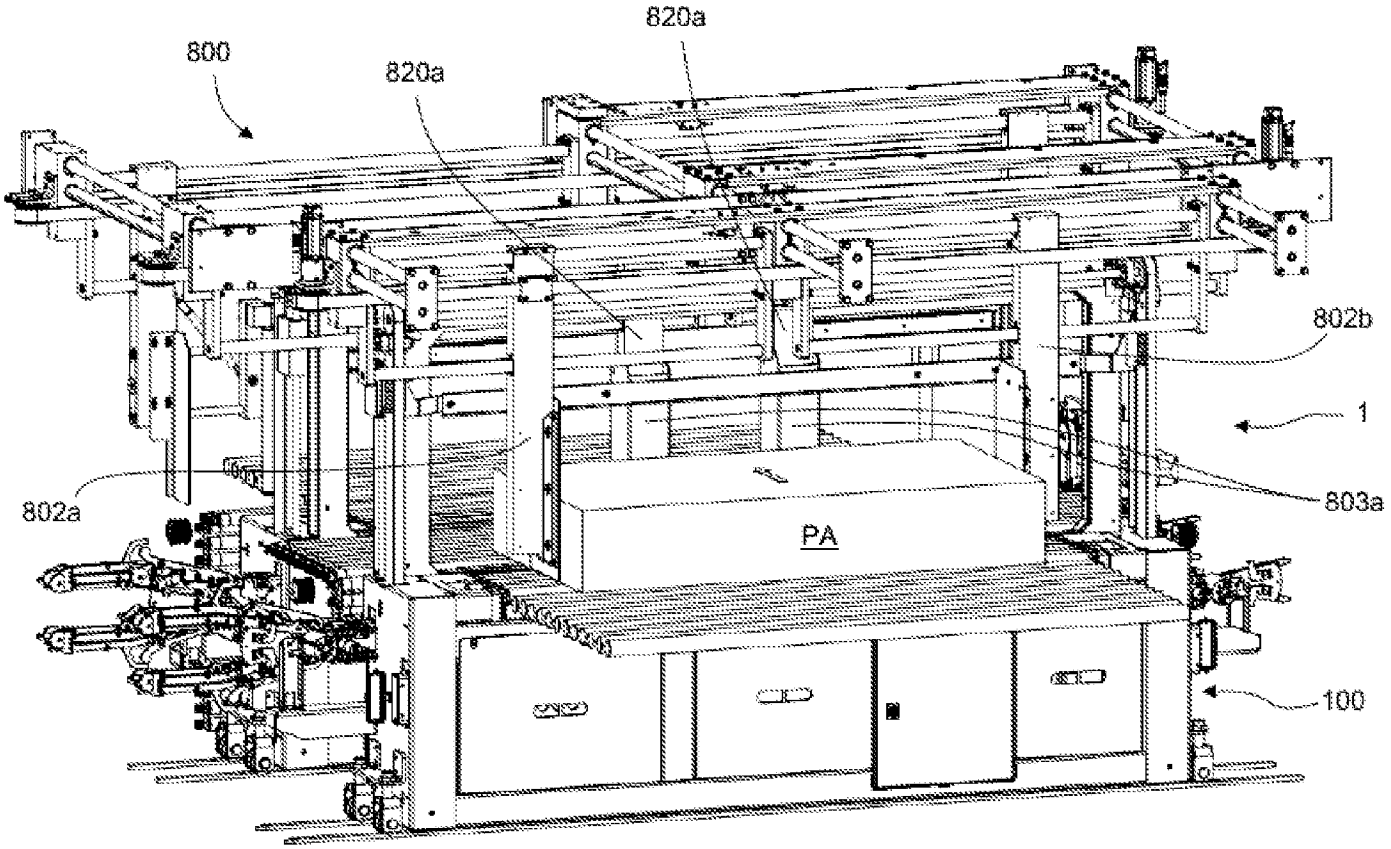

FIG. 24 is a perspective view an alternative process of the present invention operated by the system and apparatus, with a single packaging article.

Figure 25:
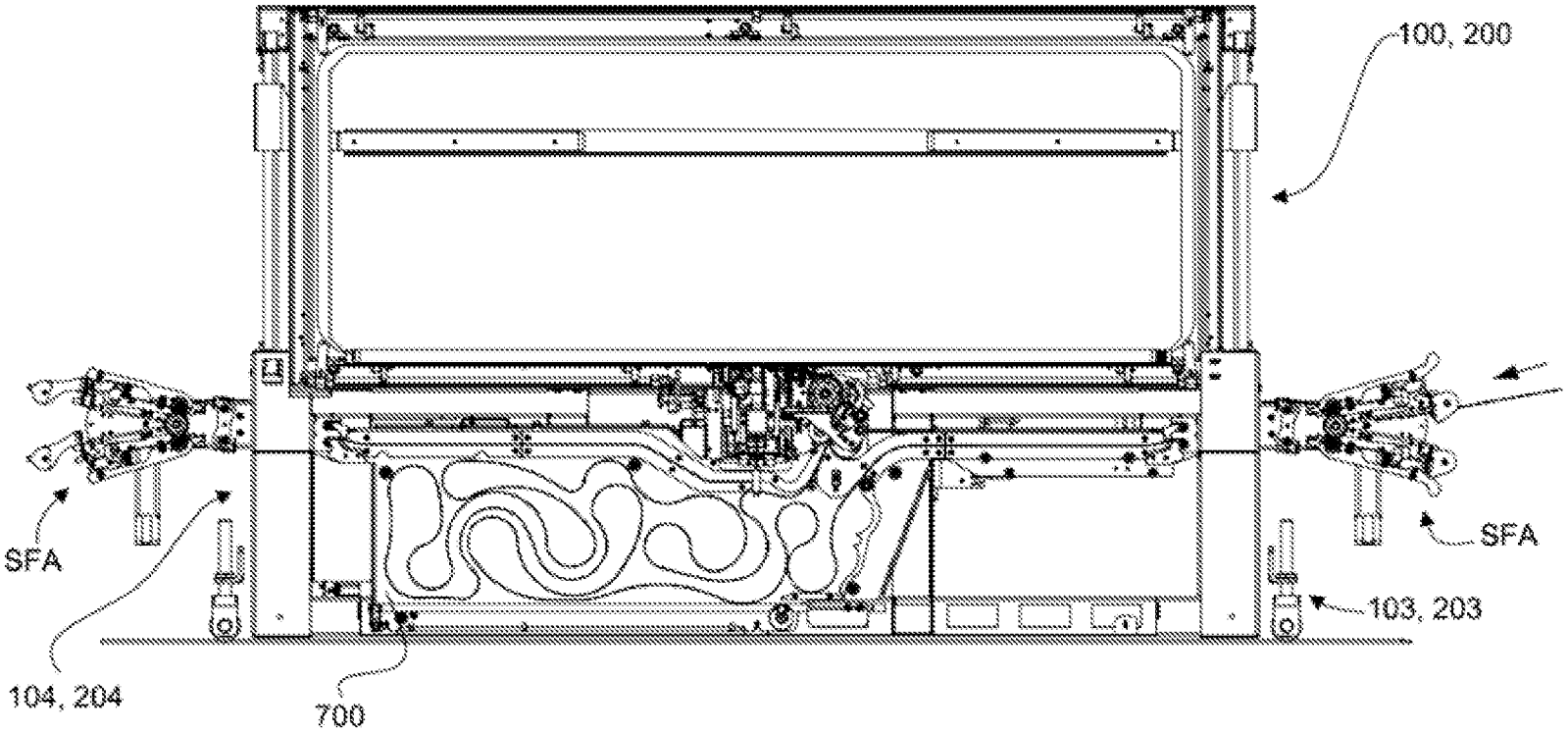

FIG. 25 depicts a system and apparatus, and also depicts an embodiment of a bidirectional strap magazine.

Figure 26A:
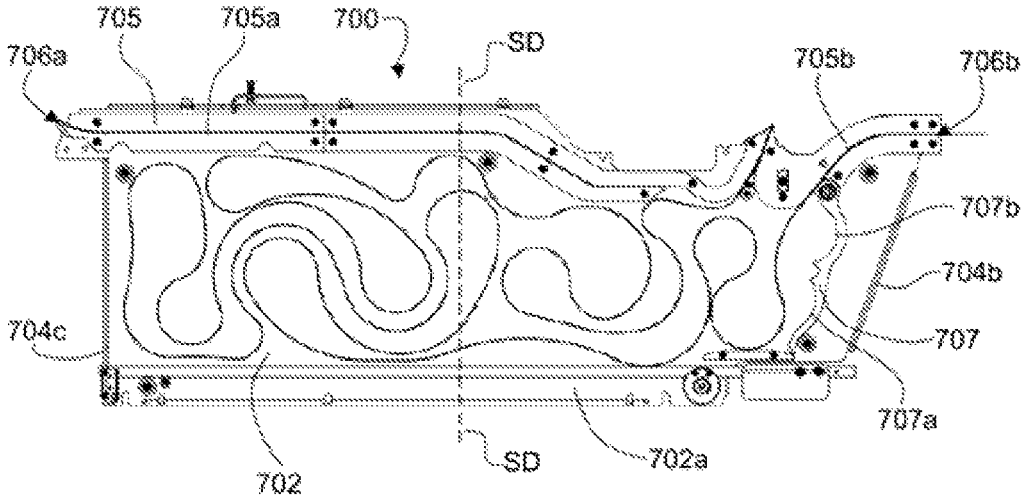
Figure 26B:
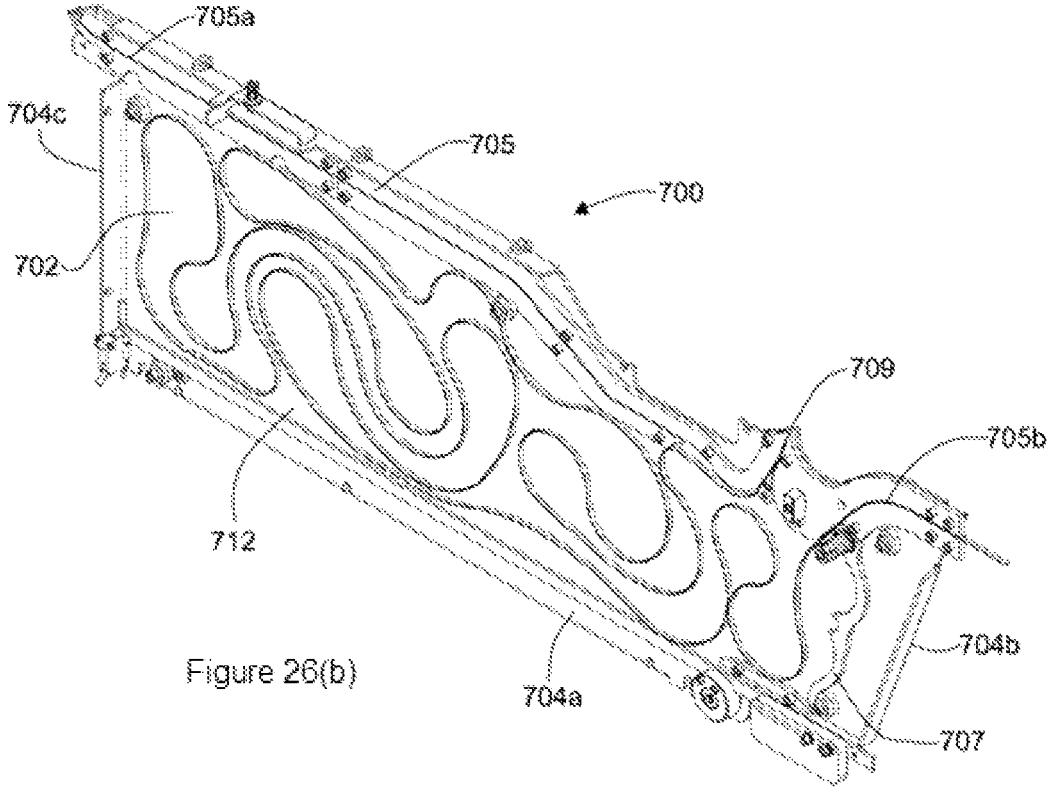

FIG. 26(*a*) provides an elevation view of the interior of a bidirectional strap magazine.

FIG. 26(*b*) shows a perspective view of the interior of a bidirectional strap magazine.

Figure 27A:
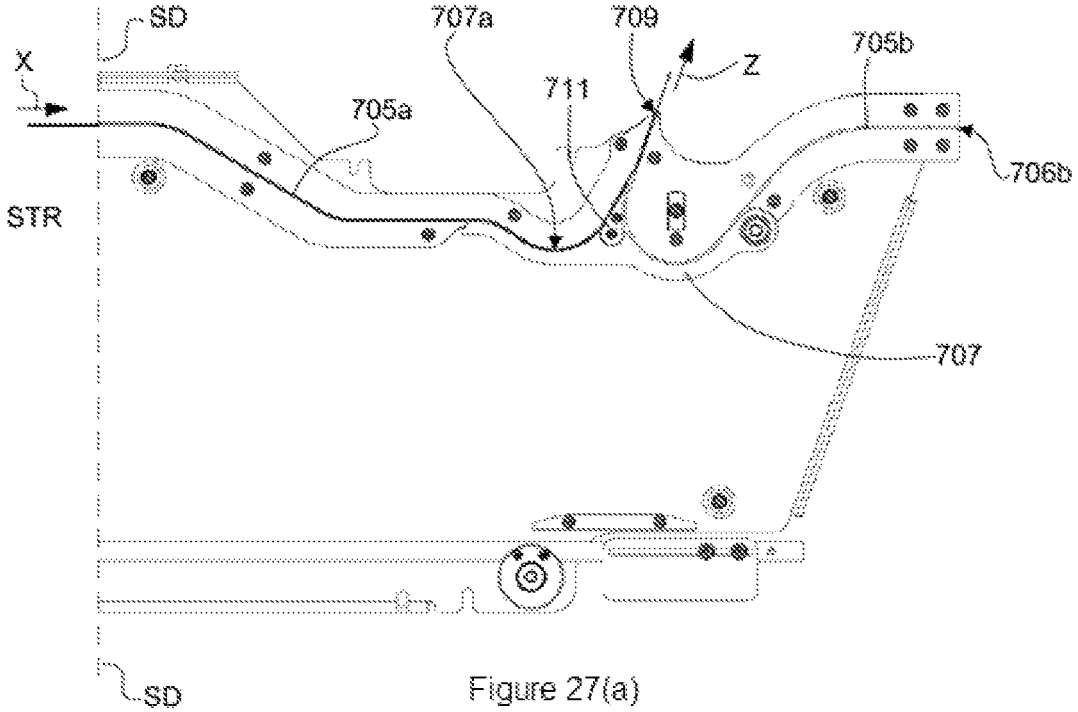
Figure 27B:
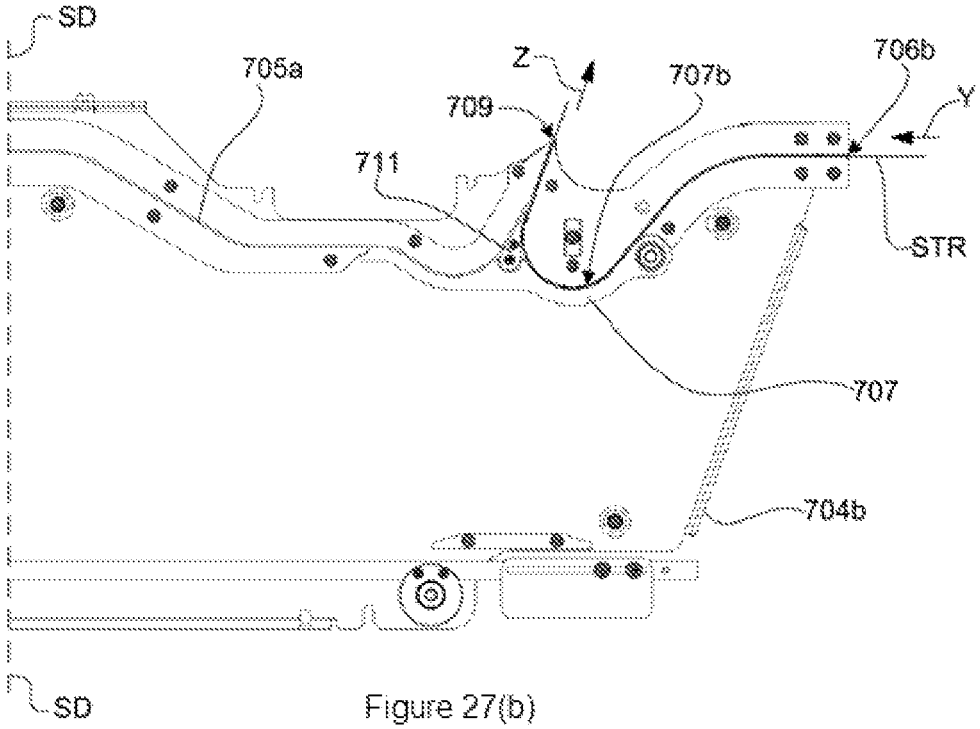
Figure 27C:
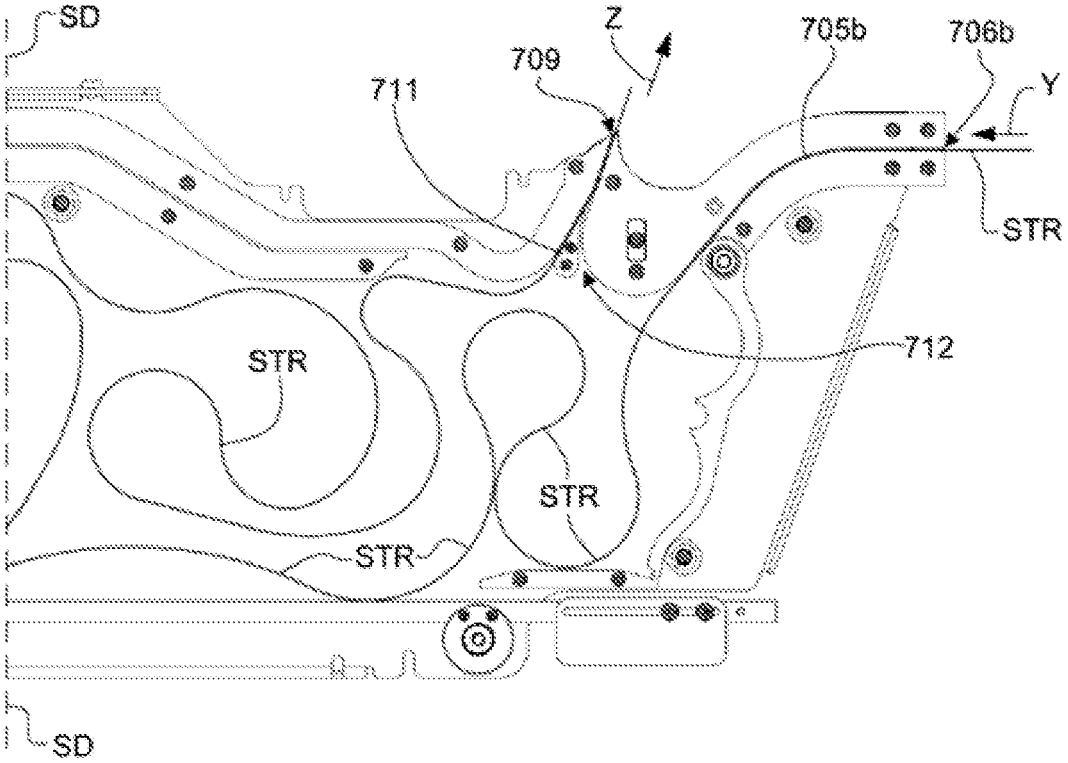

FIG. 27(*a*) illustrates an elevation view of a part of an interior of a bidirectional strap magazine.

FIG. 27(*b*) depicts an elevation view of a part of an interior of a bidirectional strap magazine.

FIG. 27(*c*) further shows an elevation view of a part of an interior of a bidirectional strap magazine.

Turning first to the prior art FIGS. 1(*a*) through 1(*f*) disclose a series of schematic depictions of a prior art tandem apparatus A which includes a first bundling apparatus B and a second bundling apparatus C, which remain in a static position with respect to each other. As is known to the prior art, and previously mentioned, each of the first bundling apparatus A and second bundling apparatus B are necessarily in a static position with respect to their lateral displacement. Also visible are a feed track D, and intermediate track E, and an exit track F respectively from an upstream to a downstream orientation. As is seen on FIG. 1(*a*) the feed track D illustrates a pair of stacks S1, S2 of planar sheets of a material, each of which may be a stack of die cut cardboard parts or layered or stacked packaging containers each in a flattened, generally two-dimensional form. These represent stacks of packaging articles. The stacks S1, S2 may be non-abutting and spaced apart, but in the depiction are shown to be abutting. In the next sequential depiction, in FIG. 1(*b*) the pair of stacks S1, S2 are shown. The upstream stack S1 is positioned on the stage STB and within the strapping line BSL of the first bundling apparatus B, while the downstream stack S2 is spaced apart with respect to the upstream stack S1 and is positioned on the intermediate track E. In the next depiction in this sequenced process, FIG. 1(*c*) illustrates the transport of the downstream stack S2 now upon the intermediate track E, where it is propelled by the intermediate track E and away from the now static, upstream stack S1. FIG. 1(*d*), illustrates the next step of the process sequence wherein the downstream stack S2 is now positioned and is static upon the stage STC of the second bundling apparatus C where it has come to a halt on the strapping line CSL of the second bundling apparatus. As this point, the first bundling apparatus B, and the second bundling apparatus C are now caused to operate, compressing and strapping their respective stacks S2, S1. Thereafter as shown on FIG. 1(*e*), the exit track F and the intermediate track E are now operated to propel respectively, the bundled, downstream stack S2 away from the second bundling apparatus C, and simultaneously the bundled, upstream stack S1 away from the first bundling apparatus B and in the direction of the second bundling apparatus C. The final figure of the sequence, FIG. 1(*f*), illustrates the spaced apart bundled downstream stack S2, and the bundled upstream stack S1 upon the exit track F and downstream of both the first B and second bundling apparatus C.

As will be appreciated from these foregoing figures, the foregoing process introduces undesirable time lags, and also increases the likelihood of vertical displacement of one or more of the stacked layers or stacked packaging materials S1, S2 due to the start-and-stop nature necessary of the feed track D, intermediate track E, which limits the overall throughput of the process. Although not shown in any of the foregoing figures, it is understood that each of the first bundling apparatus B in the second bundling apparatus C also incorporate separate orienting apparatus each of which comprises a plurality of paddles which are just prior to bundling, to orient their respective stacks immediately prior to their bundling but each of these require paddles for each of the four sides of the stacks within each of the separate bundling apparatus in order to provide verticality immediately prior to bundling. Thus the orienting apparatus operating with each of the first bundling apparatus B and the second bundling apparatus C, requires at least one paddles or sets of paddles, each of which comes into contact with each of the four sides (upstream, downstream and each of two sides between the upstream and downstream sides) of packaging article(s) present within the first bundling apparatus B and the second bundling apparatus C immediately prior to bundling. The existing tandem process is also invariable and inflexible in other ways as well, which shortcoming are overcome by the present invention.

FIG. 2 and figures following relate to the present invention, and various aspects and features thereof. It is to be understood that like elements are referred to throughout the drawings using the same reference numbers a/o letters.

Figure 3:
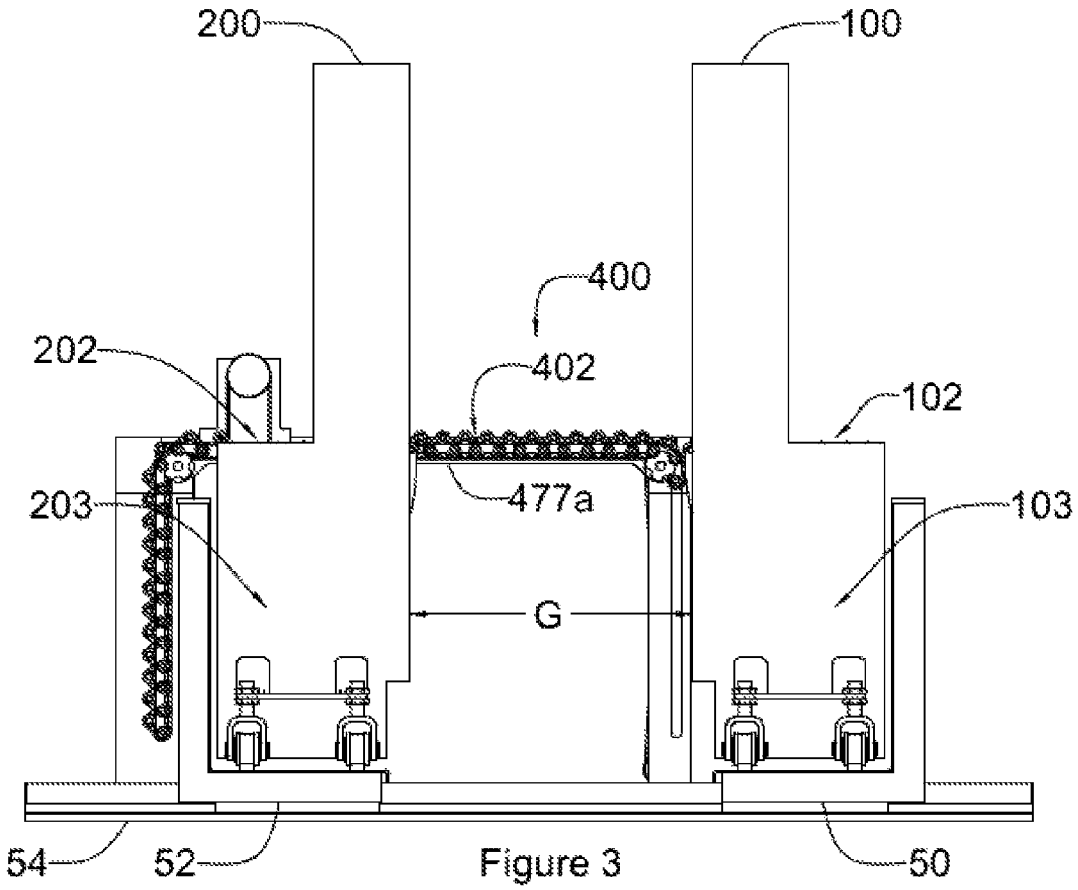
FIG. 3 is an elevation view of a first bundling apparatus, a second bundling apparatus, and a flexible bridge apparatus.

FIG. 2 depicts in a perspective view a first bundling apparatus 100 and a second bundling apparatus 200, both placed on separate moveable platforms 50, 52, and the platforms themselves are movably affixed to the spaced apart transport tracks 54, 56. As can be seen, the transport tracks 54, 56 are generally parallel to the ends of each of the first bundling apparatus 100 and the second bundling apparatus 200. The of the first bundling apparatus 100 and the second bundling apparatus 200 may be displaced laterally with respect to each other by shifting the moveable platforms 50, 52 apart from each other using the spaced apart transport tracks 54, 56. Also visible on each of the platforms 50, 52 are guide tracks 51, 53 which are transverse to the direction of the transport tracks 54, 56; each of the first bundling apparatus 100 and a second bundling apparatus 200 may be moved on the platforms 50, 52 collinearly with these guide tracks 51, 53. It is however to be noted that only one bundling apparatus is necessarily moveable, while the other may be mounted in a static position, i.e. to a floor or other non-moving support platform. In such an instance, only a single one of the moveable platforms 50, 52 is thus necessary to support only one of the bundling apparatus 100, 200 which would preferably be the downstream bundling apparatus 200. FIG. 3 depicts an elevation view of the first bundling apparatus 100 and the second bundling apparatus 200 and also now shown is an embodiment of the flexible bridge apparatus 400 having elements spanning between the first 100 and second bundling apparatus 200. In the views provided by FIGS. 2 and 3, the orienting apparatus, and the structural frame (shown in later figures) are omitted in order to provide improved clarity. As can be seen in these two figures, the flexible bridge apparatus 400 includes a reconfigurable upper transport surface 402 whose dimensions can be varied in response to the lateral positioning and changes thereto between the first bundling apparatus 100 and the second bundling apparatus changes 200. Changes to the lateral positioning can be readily accomplished by simply moving the first 100 and or second bundling apparatus 200 along the transport tracks 54, 56 to assume a desired spaced apart relationship between the stages of each of the first 100 and second bundling apparatus 200. The upper transport surface 402 can then change its dimensions to accommodate the gap "G", and thus span the horizontal distance between the two stages 102, 202 of respectively the first 100 and or second bundling apparatus 200 and thereby provide a substantially continuous support surface for any packaging articles (and/or other articles or materials). As noted previously, the flexible bridge apparatus 400 can be powered or nonpowered. In the preferred embodiment, as depicted in these figures the flexible bridge apparatus 400 is of the powered type.

The following FIGS. 4-19 depict various features and various embodiments of flexible bridge apparatus 400 according to the invention. The flexible bridge apparatus 400 may include certain parts and components not present in all embodiments. Advantageously a flexible bridge apparatus 400 is used with at least a first bundling apparatus 100 and a second bundling apparatus 200 as described herein, and as depicted amongst the drawing figures. In a preferred embodiment, the flexible bridge apparatus 400 takes the form of a reconfigurable, flexible bridge which comprises a plurality of parallel spaced apart cylindrical rollers 405, each roller 403 having a central axis 408, the central axis upon which the specific cylindrical roller 403 may rotate. Each of the cylindrical rollers 403 has two ends 408 from which extends the central axis 408 each of which are advantageously fitted into a support plate 409*a* and/or 409*b* which support plates are movable relative to a bridge support frame 475 generally shown in FIG. 6(*a*) and in FIG. 13 wherein the array 405 of parallel spaced apart cylindrical rollers 403 is omitted for purposes of illustration. The bridge support frame 475 includes horizontal guide rails 477*a*, 477*b*, and each of which respectively includes a channel 478*a*, 478*b* or groove which is intended to accommodate portions or elements of one or more of the support plates 409*a*, 409*b* and/or central axis 403, bearing 414, or other part or element. The positioning of the bridge support frame 475, and in particular the horizontal guide rails 477*a*, 477*b* is advantageously such that cylindrical rollers 403 present within the span between the stage 102 of the first bundling apparatus 100 and the stage 202 of the second bundling apparatus 200 is such that its uppermost peripheral surface 407 is substantially coincident with the generally planar surface of each of these stages 101*a*, 202. The stages are the surface upon which one or more packaging articles are placed, prior to, and subsequent to bundling within each of the bundling machines 100, 200. In accordance with a preferred aspect of the invention, such bundling occurs essentially simultaneously. In this manner, the cylindrical rollers 403 provide a contiguous horizontal support surface between the stages 102, 202. Where the cylindrical rollers 403 are propelled, such rotation imparts lateral mobility of a packaging article, or bundle thereof in the span between the stages 102, 202. Advantageously then, the placement of the horizontal guide rails relative to each of the bundling apparatus 100, 200 is such that they are preferably located outside of the ends 103, 203 of both of the first bundling apparatus 100 the second bundling apparatus 200 such that lateral displacement does not cause any interference with the bridge support frame. Other configurations are possible however, as it is only required that a bridge support frame 475 is suitably sized in order to permit for the provision of a sufficient number of cylindrical rollers 403 within the span "G" between the first bundling apparatus 100 and the second bundling apparatus 200 at the maximum lateral displacement for any particular installation or configuration of the system and apparatus according to the invention. Advantageously, the bridge support frame 475 present is suitably sized in order to permit for the provision of at least one, or no cylindrical rollers 403 within the span G extant between the first stage 102 and second stage 202 when the first bundling apparatus 100 and the second bundling apparatus 200 are at a minimum lateral displacement from one another.

In a preferred embodiment, in addition to the spaced apart, horizontal guide rails 477*a*, 477*b*, the bridge support frame 475 further includes a pair of reservoir guide rails 479*a*, 479*b* which advantageously are substantially perpendicular to the horizontal guide rails 477*a*, 477*b*, and are positioned between the first bundling apparatus 100 in the second bundling apparatus 200 when they are at a minimal displacement. The reservoir guide rails 479*a*, 479*b* are preferably substantially perpendicular, and depend downwardly from a respective horizontal guide rail 477*a*, 477*b*, and in each the channel 478*a*, 478*b* or groove present within each also extends into each of the spaced apart, reservoir guide rails 477*a*, 477*b* (and any further reservoir guide rails which may be present) such that a continuous path is formed therebetween, such that the array 405 of cylindrical rollers 403 can transit between the reservoir guide rails, and upwardly and/or downwardly and into the channels or grooves of horizontal guide rails, depending upon the displacement of the first bundling apparatus 100 with respect to the second bundling apparatus 200. In this way, parallelism of the cylindrical rollers 403 forming the span of the flexible bridge 400 between the first bundling apparatus 100 and the second bundling apparatus 200 can be maintained regardless of the lateral displacement therebetween. This ensures that at any lateral such displacement, a sufficient number of individual cylindrical rollers 403 are present, thereby bridging the gap G between these two bundling apparatus 100, 200. Thus, as a greater lateral distance is established intermediate the first bundling apparatus 100 and the second bundling apparatus 200, one or more cylindrical rollers 403 present between reservoir guide rails 477*a*, 477*b* (and any further reservoir guide rails which may be present) may be displaced therefrom and drawn upwardly and then between the horizontal guide rails 477*a*, 477*b* so to span the gap G between the stages 102, 202 of the respective apparatus, and conversely as lateral displacement between the first bundling apparatus 100 in the second bundling apparatus 200 is reduced, one or more of the cylindrical rollers 403 may be displaced or otherwise moved from between the horizontal guide rails 477*a*, 477*b* wherein they assumed a generally horizontal position, and downwardly into 479*a*, 479*b* (and any further reservoir guide rails which may be present) where they assume a vertical orientation, which is also substantially perpendicular to the horizontal position which they previously assumed. Such an operation of the flexible bridge 400 ensures that a sufficient number of individual cylindrical rollers 403 are present, and available, to satisfactorily to span the gap between the stages 102, 202 of the first 100 and the second bundling apparatus 200.

According to a further preferred embodiment in addition to the array 405 of individual rollers 403 which are present between the stages 102, 202 of the first 100 and the second bundling apparatus 200, there is also present a second pair of reservoir guide rails 476*a*, 476*b* which are also advantageously substantially perpendicular to the horizontal guide rails 477*a*, 477*b*, and are positioned downstream of the stage 202 of the second bundling apparatus 200. Such is visible in FIGS. 6 and 6(*a*), as well as FIGS. 9-13. Similarly the second pair of reservoir guide rails 476*a*, 476*b* also include channels 478*a*, 478*b* or a groove present within each which also extends into each of the spaced apart, reservoir guide rails 477*a*, 477*b* (and any further reservoir guide rails which may be present) such that a continuous path is formed therebetween, such that a second array 405*b* of cylindrical rollers 403 can transit between the reservoir guide rails, and upwardly and/or downwardly and into the channels or grooves of horizontal guide rails, depending upon the position of the second bundling apparatus 100 relative to the bridge support frame 475. In such a configuration, the flexible bridge 400 comprises two flexible bridge sections, a first flexible bridge section provided by the first array 405, and a second flexible bridge section provided by the second array 405*b*.

It is however to be noted that in its simplest embodiment the bridge support frame 475 may be fully provided by a pair of an individual horizontal guide rails with only one pair of reservoir guide rails, with one of each of the pair. Further the bridge support frame 475 may be affixed to a static structure, i.e., a floor, or may be affixed to a moveable structure, i.e., the first bundling apparatus 100 or a second bundling apparatus 200. It is also possible that the bridge support frame 475 is affixed in part, or substantially its entirety to one of the bundling machines 100, 200 and/or to a platform on which a bundling machine is mounted, e.g., one or both of the moveable platforms 50, 52. Additionally the bridge support frame 475 may additionally include further structural elements which may be ancillary. Such include mounting plates, as well as further structural rails or beams which do not interact directly with any part of the flexible bridge but rather, are used to provide mounting support and to also possibly maintained the paralleledness of the parts of the bridge support frame on opposite sides of one or both of the bundling apparatus 100, 200. It is also conceivable that further guide rails and/or reservoir guide rails may be additionally provided, and present within the bridge support frame in addition to those described above.

Advantageously, the bridge support frame 475 is affixed to a support structure, which may be one or more parts of the structural frame. It is also possible that the bridge support frame 475 is affixed in part, or substantially its entirety to one of the bundling machines 100, 200, and/or to a platform 50, 52 on which a bundling machine is mounted.

Figure 4:
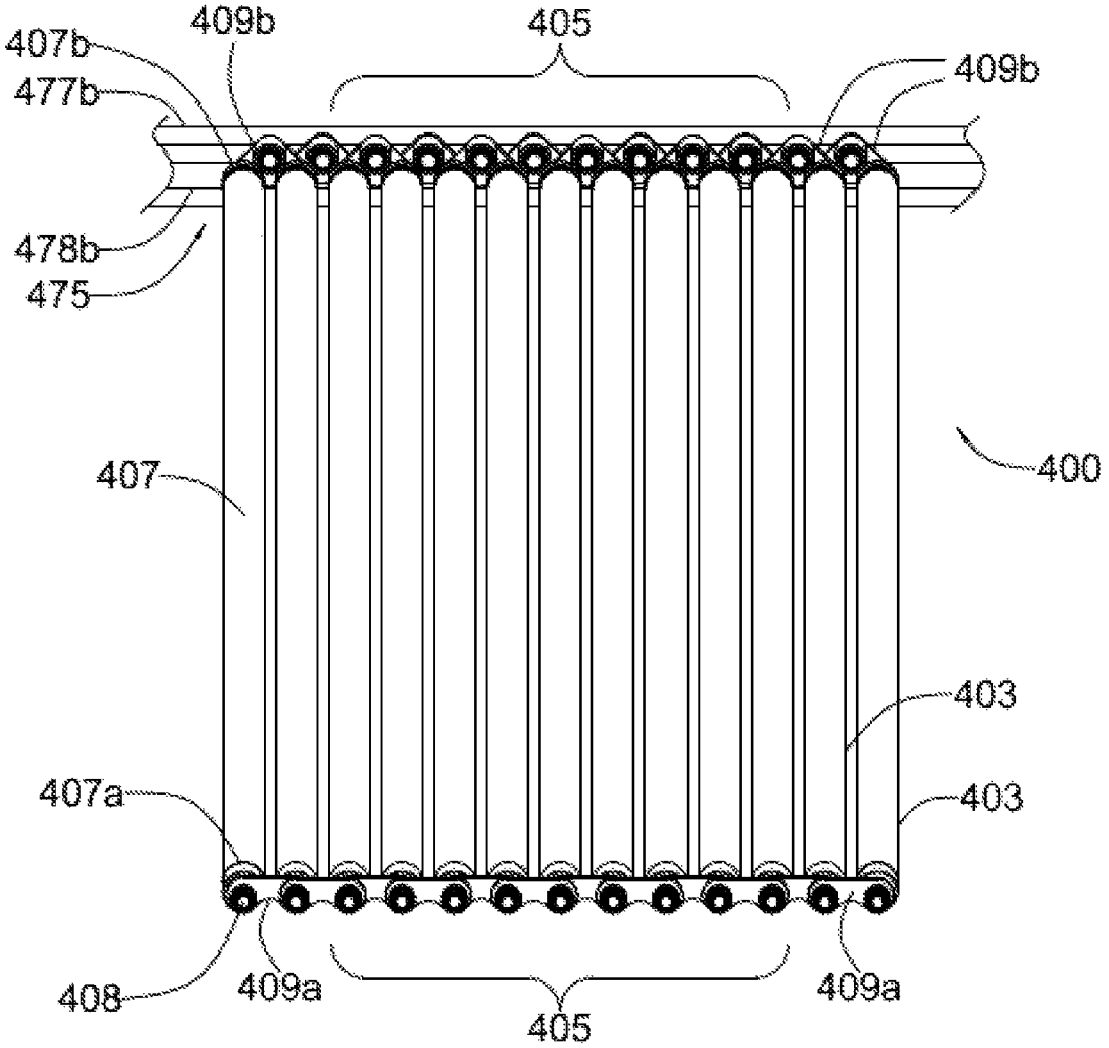
FIG. 4 depicts an embodiment of a flexible bridge apparatus.
Figure 5:
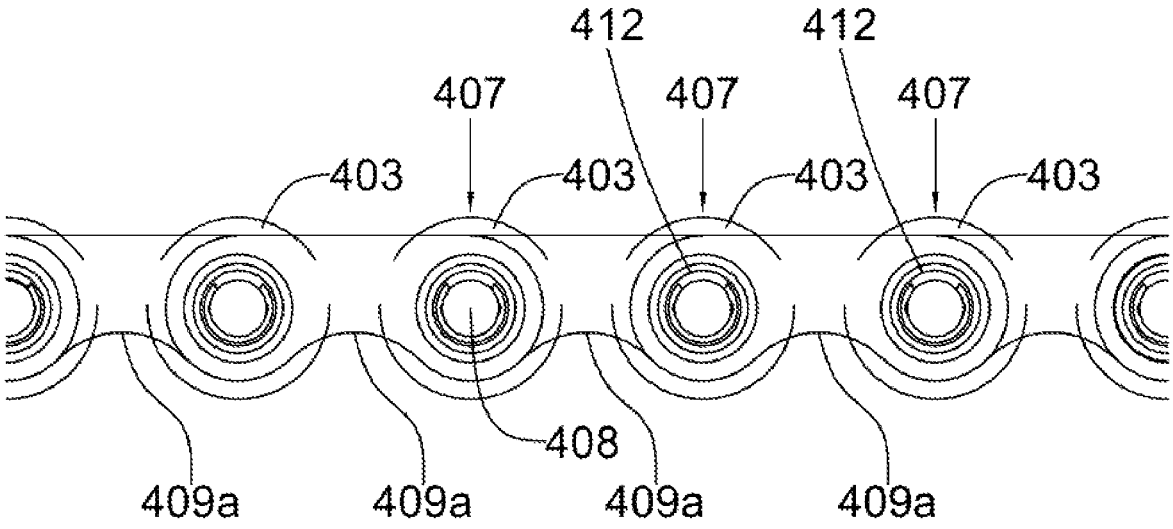
FIG. 5 illustrates a detail of an embodiment of a flexible bridge apparatus.
Figure 6:
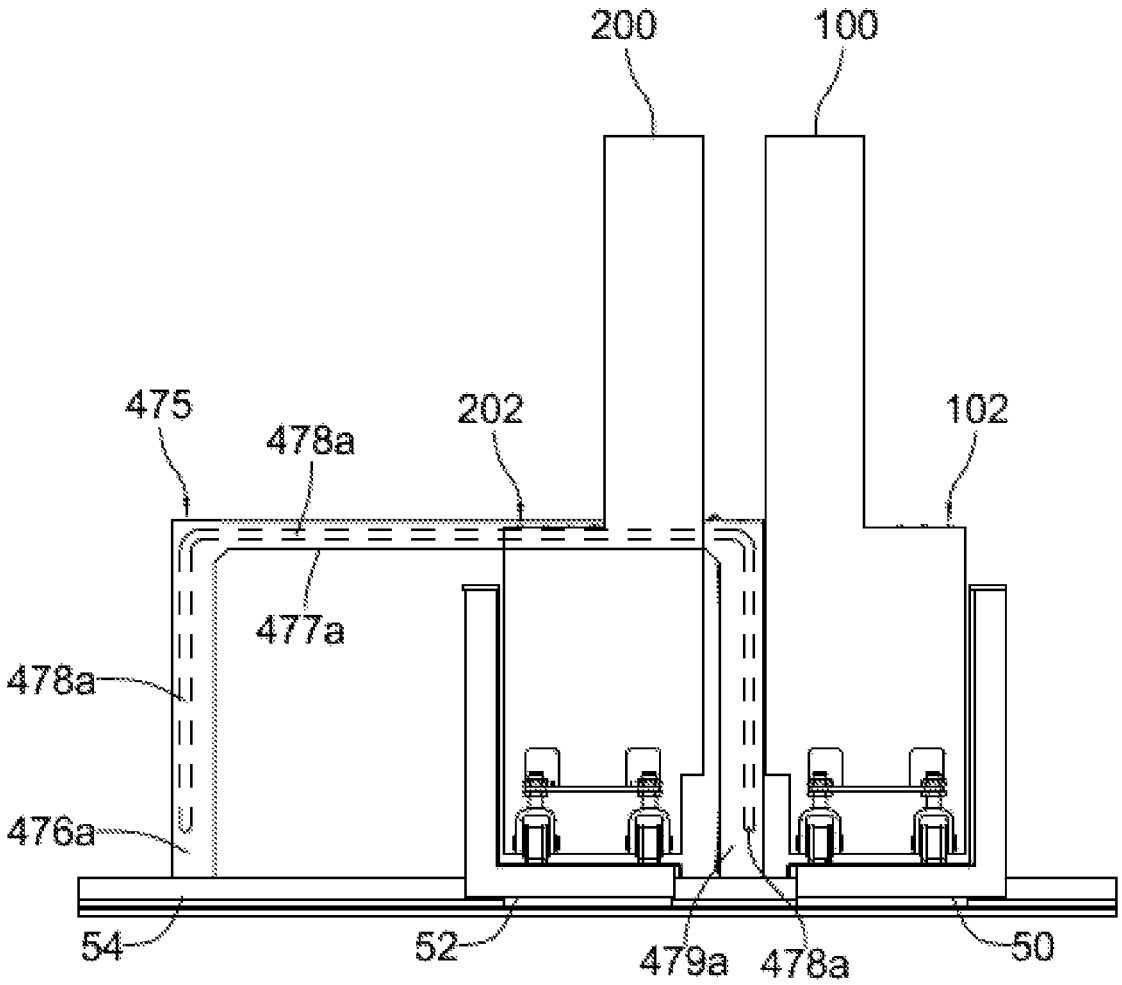
FIG. 6 depicts an elevation view of a first bundling apparatus, a second bundling apparatus, and the position of a bridge support frame.
Figure 6A:
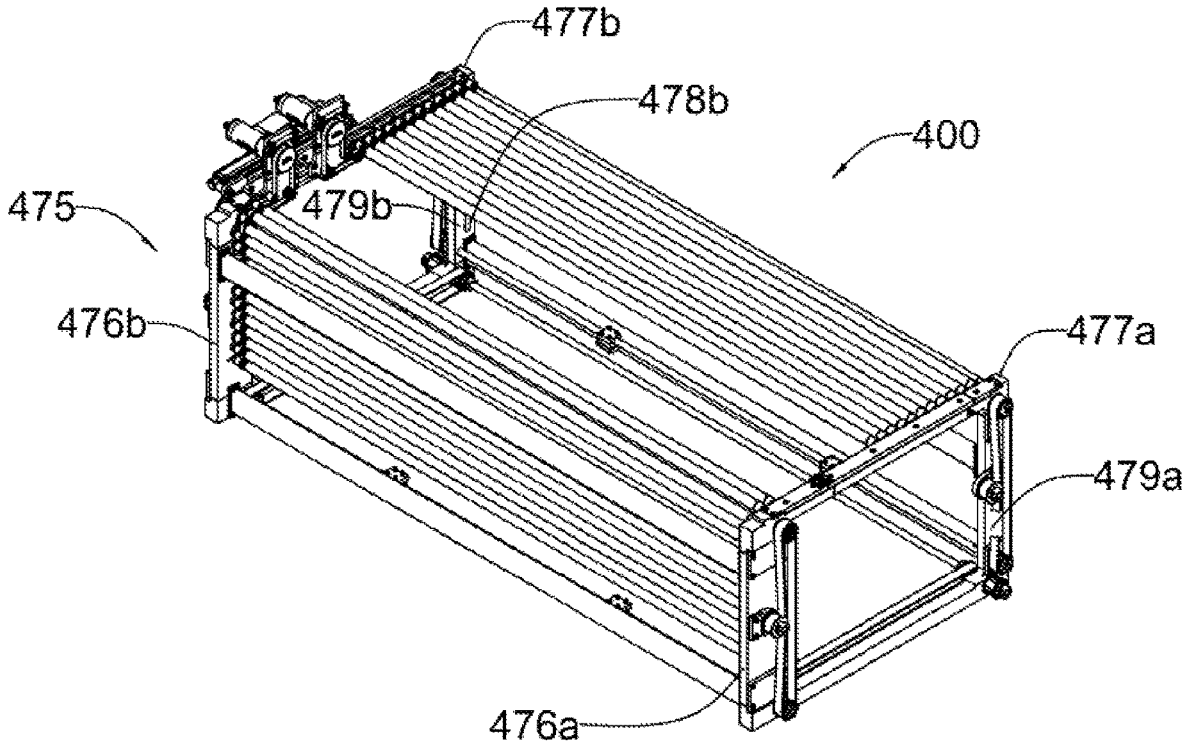

FIGS. 4, 5, 7, 8, 9, 13, 14(*a*), 14(*b*), 15(*a*), 15(*b*), 16(*a*), 16(*b*), 17(*a*) and 17(*b*) illustrate certain specific details regarding various embodiments relevant to the flexible bridge 400, and certain of the specific relating to one or more thereof. FIG. 4 provides in a perspective view and detail of ends of an array 405 of a plurality of cylindrical rollers 403, each having a central axis 408, the center axes mounted within an individual support plate, 409*a* or 409*b*. FIG. 5 illustrates in more detail in an elevational view ends of an array 405 of a plurality of cylindrical rollers 403, each of which is mounted on a support plate 409*a*, each of which having two bores 412, each receiving a part of the central axis 408 of a roller 403. Also seen is that each support plate 409*a* overlaps with at least one further support plate, thus forming a rotatable linkage therewith in a moveable, chain like configuration which facilitates transport of the array of cylindrical rollers 403 within parts of the bridge support frame 475 particularly with respect to the movement of individual rollers 403 between the horizontal guide rails 477*a*, 477*b* and reservoir guide rails. The individual support plates thus also provide a uniform spacing between the center axes 408 of adjacent cylindrical rollers 403. Also seen in FIG. 5 (as well as in FIGS. 9-12) are tri-lobed support plates 409*b* each of which include three or more bores 412, at least two of which receive a part of the central axis 408 of a roller 403 and which thus form a rotatable linkage between adjacent and overlapping tri-lobed support plates 409*b*. Such a configuration may be useful wherein the rotatable cylindrical rollers 403 are caused to rotate, which rotation may be used to propel a packaging material in contact with one or more of the rollers. Further, the rotatable linkage formed between individual tri-lobed support plates 409*b* provides a moveable, chain like configuration which facilitates transport of the array of cylindrical rollers 403 within parts of the bridge support frame 475 particularly with respect to the movement of individual rollers 403 between the horizontal guide rails 477*a*, 477*b* and reservoir guide rails. As is seen in FIG. 4, such tri-lobed support plates 409*b* may be present on only one end of each of the cylindrical rollers 403. In alternative embodiments both ends of the cylindrical rollers 403 in an array 405, 405*b* include either forms of the individual support plate, 409*a* or 409*b* as disclosed herein.

Figure 7:
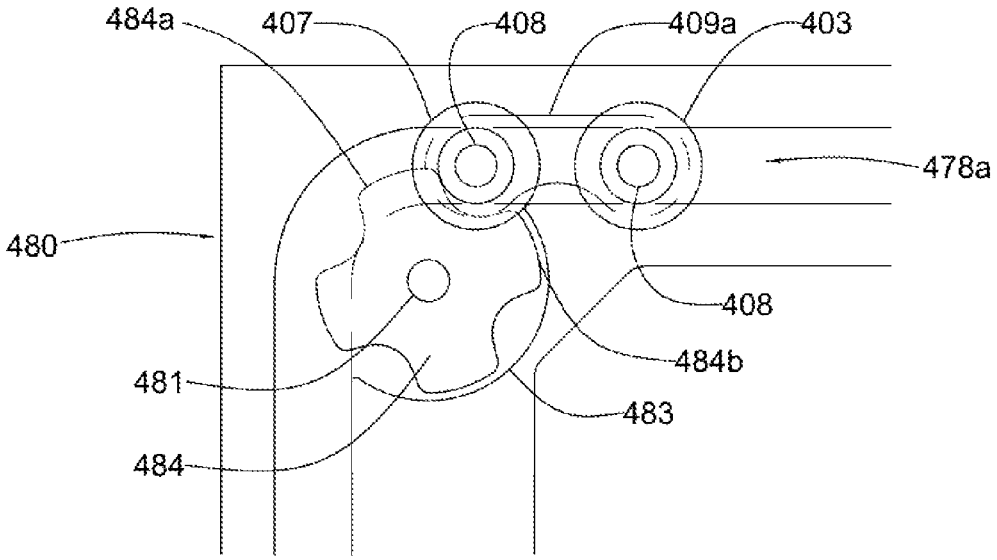
FIG. 7 depicts a detail of a part of a flexible bridge positioning apparatus, including a lobed drive wheel.
Figure 8:
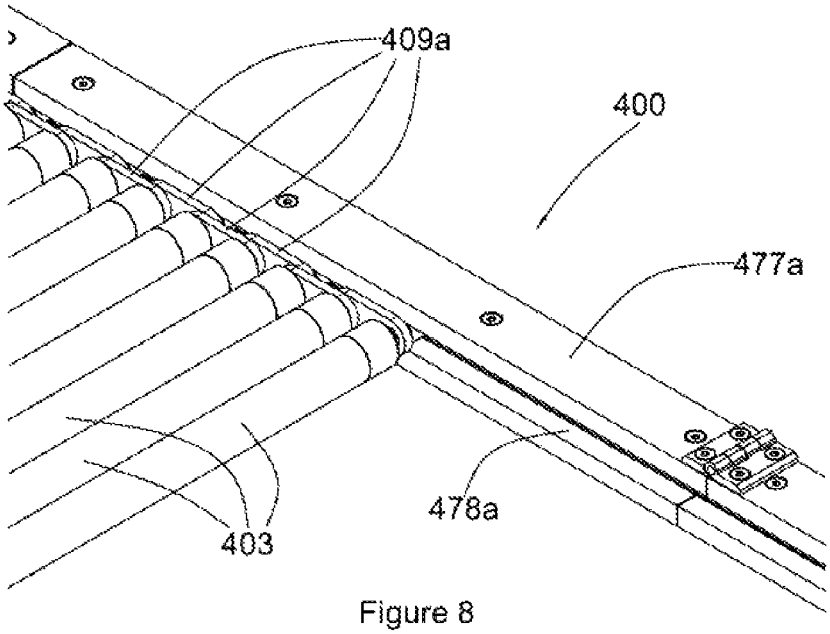
FIG. 8 illustrates in perspective view a part of a flexible bridge positioning apparatus.

Referring now to FIGS. 7 and 8 therein is depicted in a detailed, perspective view in particular preferred configuration of a part of a flexible bridge positioning apparatus. The depicted part is an indexing drive assembly 480 a part of which is present in a cylindrical cavity 483 at the intersection of a groove 478*a* of a horizontal guide rail 477*a*, and the perpendicular groove 478*a* of a reservoir guide rail 479*a*. The presence of the cylindrical cavity 483 provides a continuation of each of the aforesaid grooves, and is also used to retain a lobed drive wheel 484 of the indexing drive assembly 480. The indexing drive assembly 480 includes a central shaft 481, upon which is mounted a lobed drive wheel 484 having a plurality of lobes, i.e., 484*a*, 484*b* within the cylindrical cavity 483; a portion of the shaft 481 is shown in the figure, and while not depicted in this figure it is to be understood that the shaft extends rearwardly and out of the junction at the intersection of the horizontal guide rail 477*a* and the reservoir guide rail 479*a*, where it is affixed to a pulley 488, i.e, a toothed pulley which, in conjunction with a toothed drive belt 487 allows for very precise rotational control of the lobed drive wheel 484. Adjacent lobes, i.e, 484*a*, 484*b* of the lobed drive wheel 484 are configured to accommodate therebetween either a part of the shaft 408 of a cylindrical roller 403 but alternatively may also accommodate any other part of the cylindrical roller 403 or a part or element of a support plate 409*a* or tri-lobed support plate 409*b*; in such manner rotation of the lobed drive wheel 484 is used to transport the array 405 of individual rollers 403 forming part of the flexible bridge 400 relative to the horizontal guide rails 477*a*, 477*b* and the reservoir guide rail 479*a*, 479*b* and when present, second pair of reservoir guide rails 476*a*, 476*b* associated with a second flexible bridge section provided by the second array 405*b*.

Turning now to FIG. 13 therein is provided a perspective view of a bridge support frame 475 including the placement of the cylindrical cavities 483 at the intersections of a horizontal guide rail 477*a*, 477*b* with reservoir guide rails 479*a*, 479*b* and second reservoir guide rails 476*a*, 476*b*, the location of the cylindrical cavities 483, the location of pulleys 488, here toothed pulleys, each connected to the shaft 481 of a corresponding lobed drive wheel 484, and a toothed drive belt 487. Also visible in FIG. 13 are paired secondary pulleys 489, each of which are preferably toothed pulleys, each of the pair of secondary pulleys 489 mounted on a secondary shaft 489*d*, wherein each of the secondary pulleys is interconnected via a toothed drive belt 487 which is concurrently connected to one of the lobed drive wheels 484 via its pulley 488, while the second pulley of the secondary pair of pulleys is connected via a toothed indexing belt 489*b* to a further pulley of a further set of secondary pulleys 489, as depicted in FIG. 13. It is thus now seen that rotation of any of the pulleys 488 or any of the secondary pulleys 489 translates their rotational displacement to the other of the pulleys 488 and secondary pulleys 489 via the movement of the toothed drive belts 487 and toothed indexing belt 489*b*. Further visible in FIG. 13 is an indexing shaft 489*c* extending between the ends of the bridge support frame 475 and interconnecting one of the set of secondary pulleys 489 at one end, with another set of secondary pulleys 489 at the opposite end. Thereby, any rotation of the connected set of secondary pulleys 489 at one end, transmits its rotation to the other set of secondary pulleys 489 at the opposite end of the bridge support frame 475. This in turn causes all of the remaining interconnected pulleys 488 and secondary pulleys 489 to also rotate to the same extent.

In preferred embodiments the rollers 403 of the array 405 of the flexible bridge 400, and when present, also the rollers 403 of the second array 405*b* are powered so that the rollers 403 rotate, and thus may be used to drive a packaging article in contact with one or more of the rollers 403. Various ways to impart such rotation to rollers 403 may be used. Referring now to FIGS. 14(*a*) and 14(*b*) therein is depicted a part of the ends of rollers 403 forming part of an array 405 (and/or 405*b*) which are mounted on tri-lobed support plates 409*b* via their central axis 408. The view of FIG. 14(*a*) is a top plan view, while the view of FIG. 14(*b*) is an elevation view from the side opposite the central axis 408 of the rollers 403. FIG. 14(*a*) also clearly depicts that in addition to the central axis 408, a bearing 414 may be mounted thereon, which bearing 414 contacts and is engaged within the grooves 478*a*, 478*b* present. Such bearings 414 may be, and are preferably used in embodiments of the invention where arrays 405, 405*b* of rollers 403 with central axes 408 are used. As seen in FIG. 14(*b*), a peripheral gear 423 is present at the end of rollers 403. Also present, and mounted on the tri-lobed support plates 409*b* are cogs 421 which engage the peripheral gears 423 of adjacent rollers 403. Thereby, when rotational motion is provided to at least one of the rollers 403, or to any one of the cogs 421 and/or peripheral gears 423, this rotational motion is transferred to all interconnected rollers 403. Where a suitable motor or other drive apparatus (not shown) to provide such rotational motion as described above, rotational motion of the motor or drive apparatus is transferred to all interconnected rollers 403 forming part of an array 405, and where present, 405*b*. Turning now to FIGS. 15(*a*) and 15(*b*) therein is depicted a part of the ends of rollers 403 forming part of an array 405 (and/or 405*b*) which are mounted on support plates 409*a* via their central axis 408. The view of FIG. 15(*a*) is a top plan view, while the view of FIG. 15(*b*) is an elevation view from the side opposite the central axis 408 of the rollers 403. FIG. 15(*b*) illustrates that at the end of each of the rollers 403 is provided at least one but typically two peripheral sprockets 425, each of which are engaged with one short chains 427 which extend about one peripheral sprocket 425 of an adjacent roller 403. Thereby, when rotational motion is provided to at least one of the rollers 403, this rotational motion is transferred via the enmeshed chains 427 and peripheral sprockets 425 to all interconnected rollers 403. Where a suitable motor or other drive apparatus (not shown) to provide such rotational motion as described above, rotational motion of the motor or drive apparatus is transferred to all interconnected rollers 403 forming part of an array 405, and where present, the secondary array 405*b*. FIGS. 16(*a*) and 16(*b*) shows a part of the ends of rollers 403 forming part of an array 405 (and/or 405*b*) which are mounted on interlinked support plates 409*a* upon a bearing 414 located about their central axis 408. The view of FIG. 16(*a*) is a top plan view, while the view of FIG. 16(*b*) is an elevation view from the side opposite the central axis 408 of the rollers 403. In FIG. 16(*a*) is seen that a part of the peripheral surface 407 of the rollers 403 is removed in the depiction to illustrate that in the interior; each of the rollers 403 comprises a suitable motor 429 or other drive apparatus which causes the rotation of the surface 407 of the rollers 403 about its central axis 408. Such motor or other suitable apparatus may be any of a number of electrical or magnetic motors which may be controlled directly or by induction to cause the rotation. Advantageously, when operating, each of the rollers 403 in an array 405 (and/or 405*b*) is caused to rotate at a common speed and in the same direction as one or more adjacent rollers 403.

The view of FIG. 17(*a*) is a top plan view, while the view of FIG. 17(*b*) is an elevation view from the side opposite the central axis 408 of the rollers 403, depicting a further embodiment of an array 405 of a flexible bridge 400. Visible in FIGS. 17(*a*) and 17(*b*) a part of the ends of rollers 403 forming part of an array 405 (and/or 405*b*) which are mounted on trigonal support plates 409*b* via their central axis 408. These trigonal support plates 409*b* are overlapped such that adjacent trigonal support plates 409*b* are rotatably linked to at least one adjacent trigonal support plates 409*b*, which similar to support plates 409*a*, also include a bore for accommodating the central axes 408 of a cylindrical roller 403; in the trigonal support plates 409*b* there are provided two bores 410 through which a the central axes 408 may extend, and parts of said the central axes 408 concurrently extending through two bores 410, one of a first trigonal support plate 409*b* and one of a second trigonal support plate 409*b* provide a means to interlink adjacent support plates. Such is similar to what is show in relation to FIG. 16*b*. Also, advantageously a bearing 414 is also located about their central axis 408 as shown in FIGS. 17(*a*), 17(*b*). In this embodiment, there are also provided suitable motor 429 or other drive apparatus which causes the rotation of the surface 407 of the rollers 403 about its central axis 408. Such motor 429 or other suitable apparatus may be any of a number of electrical or magnetic motors which may be controlled directly or by induction to cause the rotation. In the embodiment depicted, a motor 429 is mounted on a part of each trigonal support plate 409*b*, such that its driveshaft 429*a* extends through a third bore 410 present; the driveshaft 429*a* may include a pulley 429*b* or a drive sheave, or alternately a part driveshaft 429*a* may be grooved to operate such as a pulley in which is present a drivebelt 429*c* which is also coupled to a part of a cylindrical roller 403. Optionally but advantageously a groove 403*a* is also present near one end of the cylindrical rollers 403. Advantageously, when operating, each of the rollers 403 in an array 405 (and/or 405*b*) is caused to rotate at a common speed and in the same direction as one or more adjacent rollers 403 by controlling the operation of the motor 429 or other suitable apparatus linked via the drivebelt 429*c*.

A preferred embodiment of a powered, flexible bridge 400 is illustrated in FIGS. 9-12, which utilizes a drive motor unit 440 which includes a drive sheave 442 about which extends a flexible sheave drive belt 446. The drive motor unit 440 is moveably mounted upon a part of the bridge support frame 475 and may be laterally moveable with respect thereto, and preferably the drive motor unit 440 is mounted using bearings or other means to the horizontal guide rails 477*a* and/or 477*b*, and/or a channel 478*a*, 478*b* or groove which is intended to accommodate portions or elements of one or more of the support plates 409*a*, 409*b* such that the drive motor unit 440 may move laterally with respect to at least one of the horizontal guide rails 477*a* or 477*b* or channels 478 or 478*b*. Such lateral movement may be effectuated by one or more further apparatus, i.e., a linear actuator 451 (see FIG. 9) or alternately, a rotating threaded screw whose rotation is used to move the drive motor unit 440 laterally or any other device or apparatus which may provide such a function. Alternative methods of providing lateral movement are discussed with reference to FIGS. 10 and 11. In certain preferred embodiments, the drive motor unit 440 may be linked, preferably by a (decouplable) mechanical link or coupling which is rotatable to either the endmost cylindrical roller 403 and/or an endmost support plate 409*a* but preferably 409*b*, in an array 405, such that as the drive motor unit 440 is repositioned relative to the bridge support frame 475, the position of the interlinked rollers 403 and support plates 409*a* may be drawn up out of, or pushed down into, the space between the reservoir guide rails 479*a*, 479*b* and into the space between the horizontal guide rails 477*a*, 477*b* thereby to establish that part of the flexible bridge 400 which provides an upper transport surface 402 whose dimensions can be varied in response to the lateral positioning and changes thereto between the first bundling apparatus 100 and the second bundling apparatus changes 200. The position of the drive motor unit 440 itself, relative to the either the first bundling apparatus 100 and/or the second bundling apparatus 200 may be established by independently controlling the position of the drive motor unit 440, or may be controlled by providing a (decouplable, detachable) mechanical link or coupling between a part of the drive motor unit 440 and to one of the first bundling apparatus 100 or to the second bundling apparatus 200 such that as the gap G between these apparatus 100, 200 is changed, the mechanically linked/coupled drive motor unit 440 will be caused to move relative to the bridge support frame 475 and concurrently the position of the interlinked rollers 403 relative to the support frame 475. Alternately a linear actuator 451 or other similar apparatus may be used instead, wherein the operation of the linear actuator 451 causes the displacement of the position of the interlinked rollers 403 and support plates 409*a*, preferably a part of the linear actuator 451 is (decouplably, detatchably) mechanically linked with a part of the motor drive unit 440. In any of these embodiments, the array 405 of rollers 403 which extend between the stage 102 of the first bundling apparatus 100 and the stage 202 of the second bundling apparatus provide the upper transport surface 402 of the flexible bridge apparatus 400 which rollers 403 are contiguous to the stages 102, 202. The provision of providing a decouplable or detachable mechanical link or coupling between a part of the drive motor unit and/or a liner actuator allows for the displacement of a roller curtain within the bridge support frame, so to allow access by an operator within the gap G; such may be advantageous in servicing either of the bundling apparatus 100, 200 such as to permit inspection of parts thereof or operation thereof, to supply or resupply strapping material, or to provide routine maintenance or cleaning. In such an instance a part of flexible bridge apparatus 400 may comprise a hinged part which may be moved away to allow physical access to the gap G by an operator such as is illustrated in FIG. 8 where is it shown that a part of horizontal guide rail 477*a* includes a hinged section which may be swung open to allow entry by an operator between the horizontal guide rails 477*a*, 477*b*.

The rollers 403 within the array 405 are, at least one and thereof, are mounted upon tri-lobed support plates 409*b* each of which include three or more bores 412, at least two of which receive a part of the central axis 408 of a roller 403, and in this embodiment, a idler roller 411 is present as well, and is placed to be coincident with an end of each of the rollers 403, which may optionally include a profile surface, or additionally include a further element such as a sheave; the flexible sheave drive belt 446 extending about the drive sheave 442 of the motor unit 440 extends about these ends of the rollers 403 and the intermediate idler rollers 411 in a serpentine manner such that when the motor unit 440 is energized, the flexible sheave drive belt 446 is caused to move and to rotate the rollers 403 at a common rotational speed and direction.

Turning now to the preferred embodiments shown in FIGS. 9, 10 and 11, therein are depicted a flexible bridge apparatus 400 according to the invention which in addition to an array 405 and the drive motor unit 440, there is also present a second array 405*b*, and a second drive motor unit 450 which includes a drive sheave 452 about which extends a flexible sheave drive belt 456. The second drive motor unit 450 is also moveably mounted upon a part of the bridge support frame 475 and may be laterally moveable with respect thereto. The operation of this second drive motor unit 450 and the second array 405*b* is substantially as described reference to the drive motor unit 440 and its array 405 but, whereas the array 405 provides the array 405 of rollers 403 which extend between the stage 102 of the first bundling apparatus 100 and the stage 202 of the second bundling apparatus provide the upper transport surface 402 of the flexible bridge apparatus 400, the rollers 403 of the second array 405*b* may be positioned relative to the bridge support frame 475 and may be laterally moveable with respect thereto to provide an outfeed transport surface 400*b* which is downstream of the second bundling apparatus 200, and which outfeed transport surface is contiguous with the downstream side of the stage 202. Optionally, the outfeed transport surface 405*b* may also be continuous with a further unit or device. With the provision of a second array 405*b* and a second drive motor unit 450, in addition to the upper transport surface 402 contiguous with the stages 102, 202 of, respectively, the first bundling apparatus 100 and the second bundling apparatus 200 there may be now provided a reconfigurable, outfeed transport surface 400*b* which is downstream of the second bundling apparatus 200 which is also contiguous with these stages 102, 202.

Referring now to FIG. 10, therein is illustrated a plan view from one end of a bridge support frame 475, having both a drive motor unit 440 and its array 405, as well a second drive motor unit 450 and its array 405*b*. It is to be understood, in this particular embodiment, the drive motor unit 440 and the second drive motor unit 450 are both moveable relative to the a bridge support frame 475, and preferably also, one or both of the drive motor unit 440 or second drive motor unit 450 may be mechanically linked to at least one of the bundling apparatus, either the first bundling apparatus 100 or the second bundling apparatus 200 and/or at least part of array 405 or second array 405*b*. An actuator 451 may be present and may also be linked to one or both of the drive motor unit 440 or second drive motor unit 450; the actuator 451 may be used to move one or both of the drive motor unit 440 or second drive motor unit 450 with respect to the position of at least one of the bundling apparatus 100, 200. In this embodiment, lateral motion (as shown as left arrow "L" and right arrow "R" depicted) of array 405 and here, also the second array 405*b*, is provided by rotation of one or more of the indexing drive assemblies 480 whose lobed wheel 484 engages a part of the array 405. Such may be seen in more detail in FIG. 12. Rotation of the lobed wheel 484, in turn is translated to the other indexing drive assemblies 480 also present and forming part of the bridge support frame 475, as has been discussed with reference to FIG. 13 and depicted thereon. In such a method, an indexing drive motor (not shown) or other apparatus is rotatably coupled to a part of the bridge support frame 475, preferably to at least one of the indexing drive assemblies 480, or paired secondary pulleys 489, or secondary pulley shafts 484, or indexing shaft 489*c*, such that rotation at any one of the foregoing is translated to the remaining indexing drive assemblies 480 and in particular their lobed wheels 484. Such a rotation also causes displacement of the array 405, and the drive motor unit 440 to which it may be mechanically linked, or via the flexible sheave drive belt 446. Such a rotation also causes displacement of the second array 405*b* (when present), and the second drive motor unit 450 to which it may be mechanically linked, or via the flexible sheave drive belt 456, as lobed wheels 484 engaging parts of the arrays 405 and 405*b* are caused to concurrently rotate at the same speed and in the same direction thereby moving the arrays 405, 405*b* by essentially the same distance, which in turn, also causes the linear displacement of the drive motor unit 440 and the second drive motor unit 450. Such motion may be provided even where there are no mechanical linkages between any bundling apparatus 100, 200 and the of the drive motor unit 440 or second drive motor unit 450 and/or any of the arrays 405, 405*b*. In this embodiment, motion of the arrays 405, 405*b* may be solely imparted by the rotation of at least one of the lobed wheels 484 within one of the indexing drive assemblies 480 which is translated to other indexing drive assemblies.

FIG. 11 illustrates an alternative to the embodiment discussed with regard to FIG. 10. In this embodiment, no indexing drive motor (not shown) or other apparatus is rotatably coupled to any one of the indexing drive assemblies 480, or paired secondary pulleys 489, or secondary pulley shafts 484, or indexing shaft 489*c* as has been discussed in reference to FIG. 13 and is depicted thereon. Rather, the drive motor unit 440 and/or its array 405, and when present, the second drive motor unit 450 and/or its array 405*b* is mechanically linked or otherwise physically coupled to a part of either the first bundling apparatus 100, but preferably to a part of these second bundling apparatus 200 and/or to one of the moveable platforms 50, 52, but preferably upon the one associated with the second bundling apparatus 200. Thus when the lateral distance between the first bundling apparatus 100 and the second bundling apparatus 200 is changed, mechanically linked elements are also caused to move by a similar lateral distance. This causes the parts of the array 405, and 405*b* (when present) to engage one or more of the lobed wheels 484 of indexing drive assemblies 480 to rotate, and this rotation is translated to the other indexing drive assemblies 480 via the elements of the bridge support frame 475, as has been discussed with reference to FIG. 13 and depicted thereon. Thus, one or both of the drive motor unit 440 and the second drive motor unit 450, and their respective arrays 405, 405*b* may be repositioned.

Alternately to the embodiments of FIGS. 10, 11 an actuator 451 may be present and may also be linked to one or both of the drive motor unit 440 or second drive motor unit 450; the actuator 451 may be used to move one or both of the drive motor unit 440 or second drive motor unit 450 with respect to the position of at least one of the bundling apparatus 100, 200. The actuator 451 may operate to position the locations of the drive motor unit 440 or second drive motor unit 450 in place of the arrangements discussed with reference to FIGS. 10, 11; in such an embodiment the drive motor unit 440 or second drive motor unit 450 need not be linked to any part of a bundling apparatus 100, 200 but each may be linked to an actuator 451, of which one or more may be present. In certain embodiments a actuator 451 is affixed to a part of the bridge support frame 475; and the piston or other moveable part of an actuator 451 is (decouplably) linked or coupled to one of the motor drive unites 440, 450 or a part of the array 405, and 405*b*(when present).

Whereas the first flexible bridge apparatus has been described in accordance with a preferred embodiment it is to be understood that certain variations and substitutions can be made thereto, without affecting the operability thereof.

The preferred embodiment described and depicted amongst many of the drawing figures, depicted are cylindrical rollers 403 forming part of the array 405, and 405*b*. In the drawings, while their peripheral surface 407 are generally smooth, they can have various degrees of roughness in order to improve interfacial friction with any stacks, bundles, or packages to which their peripheral sidewalls or surfaces, the contact with. This can be achieved by providing a chemical treatment which would increase their surface roughness or mechanical treatments or operations, such as the provision of etching, scribing, providing knurling, cross-hatching, and the like. It is also contemplated that a further material may be applied thereon, such as providing a continuous and discontinuous web, tape, or sleeve of an elastomeric material or other material having a rougher surface then provided by the bare cylindrical rollers 403.

FIG. 18 provides a perspective view of a first bundling apparatus 100, a second bundling apparatus 200, a flexible bridge apparatus 400 with an upper transport surface 402 formed from part of the array 405 spanning between the stages 102, 202 of respectively, the first 100 and second bundling apparatus 200. Also shown is the optional but preferably included second array 405*b* of the optional further flexible bridge apparatus extending from the stage 202, as well as a bridge support frame 475. The support structure is omitted for purposes of clarity, as well as the orienting apparatus which comprises a plurality of paddles which are used during the operation, but which is described more fully, hereinafter. FIG. 19 is a top plan view of FIG. 18, and additionally illustrates the position of two individual packaging articles PA1, PA2 each of which may be a single article, but advantageously are stacks of individual packaging articles. Each of PA1, PA2 may be planar sheets of a material, each of which may be individual packaging articles, or a stack of die cut cardboard parts or layered or stacked packaging containers each in a flattened, generally two-dimensional form. The direction arrow "D" indicates the 'downstream' direction. From such can be understood that each of the first 100 and the second bundling apparatus 200 comprise two ends, respectively 103, 104 and 203, 204 perpendicular to each of their entry sides (upstream) and an exit sides (downstream). The stage 102 of the first bundling apparatus 100 is substantially horizontal and planar, and includes a plurality of cylindrical rollers which are however independently operable from those of the flexible bridge apparatus 400. The first bundling apparatus 100 includes a pair of upstanding vertical support arms 111*a*, 111*b*, having spanning therebetween a transverse member 111*c* which may be vertically displaceable. These vertical support arms 111*a*, 111*b* and transverse member 111*c* define an arch coincident with the position of stage 102 and defines the directional path for the strapping tape which is used by each of the bundling apparatus to compressively bundle packaging articles to form bundles thereof. The particular process of compression and binding is conventional, and is as currently used in the art. In short, a packaging article, or stack of individual packaging articles are position upon the stage 102 and beneath the transverse member 111*c*, and thereafter is first encircled by a sufficiently long length of the strapping tape which is initially retained within the continuous band/strap, thereafter which is tensioned by the first bundling apparatus 100 which thereby imparts a degree of compression to the positioned packaging article or stack, a part of the strapping tape is fused with a free end of the strapping tape in order to form a physical bond and a continuous loop of strapping tape about the packaging article with which retains the compression, and thereafter strapping tape is cut, thus yielding a compressed packaging article, preferably a stack of packaging articles. Optionally during the above optionally the transverse member 111*c* may move towards the stage 102 to impart compression to the packaging article or stack thereof. The degree of compression may be varied, and may include minimal or no compression. The second bundling apparatus 200 independently operates in a similar manner. The second bundling apparatus 200 also includes corresponding elements, i.e. upstanding vertical support arms 211*a*, 211*b* and a transverse member 211*c* define an arch coincident with the position of its stage 202.

A particular advantage of the invention relates to the process relating to the use of the system and apparatus of the invention in simultaneous bundling of abutting packaging articles, particularly where such are stacks of individual packaging articles. Such may be especially appreciated from FIG. 19. As seen therefrom, the relative placement of the first bundling apparatus 100 to the second bundling apparatus 200 illustrates the upper transport surface 402 of the as well as a flexible bridge 400 provides a rapidly reconfigurable upper transport surface 402 which at any relative position of the first bunding apparatus 100 to the second bundling apparatus 200 provides an essentially continuous surface, viz. the transport surface 402 which extends between the outlet of the first bundling apparatus 100 and the inlet of the second bundling apparatus 200.

Such permits for the rapid processing of adjacent individual packaging articles, preferably adjacent stacks of plurality of individual packaging materials to be located as abutting one another, yet simultaneously yet within the operating space of one of the bundling apparatus 100,200; such allows for the simultaneous but separate bundling of each of the adjacent packaging articles or stacks thereof. Such differs from the process described in relation to the prior art, as also, the bundled, still adjacent packaging articles or stacks thereof may be transported downstream after bundling (see FIG. 23(*b*)). Such in improved process is unknown from the prior art, which does not provide such functionality. Further, according to the process as well as the system and apparatus of the invention, as the gap between the first bundling apparatus 100 and second bundling apparatus 200 may be linearly varied, and the flexible bridge 400 may be dynamically reconfigured to maintain the spanning of the upper transport surface 402 between the first 100 and second bundling apparatus 200, the system and apparatus may be dynamically reconfigured to accommodate adjacent individual packaging articles, preferably adjacent stacks of plurality of individual packaging materials of differing dimensions, yet maintain the ability of simultaneous but separate bundling of each of the adjacent packaging articles or stacks thereof, which provides an improved throughput of bundled adjacent packaging articles or stacks thereof per unit of time, i.e, minutes, hours. After such bundling, the adjacent packaging articles or stacks thereof may be transported further downstream and away from the first 100 and second bundling apparatus 200, i.e., such as upon a separate downstream transport track "DTT" (see FIGS. 21(*a*), 21(*b*)) which is separate from the system and apparatus of the invention. However it is to be noted that the downstream transport track may be positioned sufficiently proximate to the second array 405*b* so to be essentially coplanar therewith. In such manner an essentially continuous upper surface between the second array 405*b* and the upper surface of the downstream transport track DTT is provided. Such an optional, but preferred second flexible bridge section provided by the second array 405*b* which extends between the outlet of the second bundling apparatus 200 and a terminal end.

In many commercial operations, stacks of packaging articles to be bundled are supplied to a feed track, such as an upstream transport track "UTT" (see FIGS. 21(*a*), 21(*b*)). Frequently however, during transit, misalignment and separation between of individual packaging articles frequently occurs, and it is required to utilize an single orienting apparatus which is used to "square up" or vertically align at one or more of the vertical sides of the packaging articles in a stack, prior to initiation of the compression and strapping thereof to form a bundle therefrom. Typically one or more paddles, having one more generally vertical and flat surface are used on two or more of the four sides of the packaging articles to provide such needed vertical alignment. Hence, the prior art having spaced apart bundling machines, each separately further including its own orienting apparatus to be used separately on the individual stacks of packaging articles which were separated in order to square up the vertical sides prior to bundling. The separation of bundling apparatus thus caused separate orienting and compression and strapping to be necessary, and both the bundling apparatus and their associated orienting apparatus essentially operated independently. Such has been depicted in FIGS. 1(*a*)-1(*f*). The process, system and apparatus of the invention overcomes this prior art shortcoming.

Ultimately and in contradistinction thereto, as can be understood from considering FIGS. 21(*a*), 21(*b*), 22(*a*), 22(*b*), 23(*a*) and 23(*b*) this shortcoming is overcome by the utilization of an orienting apparatus 800 as illustrated in FIGS. 20(*a*), 20(*b*), 20(*c*) and 20(*d*) as well as in the aforesaid further figures. FIG. 20(*a*) provides a perspective view, FIG. 20(*b*) provides a side elevation view, and FIG. 20(*c*) an end elevation view. FIG. 20(*d*) provides a perspective view of an intermediate paddle assembly 820*a* from an upstream perspective. The orienting apparatus 800 is configured to be concurrently operable with both first 100 and second bundling apparatus 200 in a dynamic manner. Looking collectively at these figures the orienting apparatus 800 includes, a pair of first (upstream) paddle assemblies 802*a*, 802*b* each of the pair having a flat vertical paddle face 803 affixed to a vertical support arm 804. Each of these paddle assemblies 802*a*, 802*b* is linearly displaceable such that each of the pair of first paddle assemblies 802*a*, 802*b* can be moved, towards one another. Is a seen from the figures, each of the vertical support arms 804 depends from a first horizontal transit arm 808 positioned above the paddle assemblies 802*a*, 802*b* which may move colinearly along the direction of the first horizontal transit arm 808.

The orienting apparatus 800 further includes, a pair of second (downstream) paddle assemblies 812*a*, 812*b* each of the pair having a flat vertical paddle face 803 affixed to a vertical support arm 814. Further, optionally but preferably each of the second paddle assemblies 812*a*, 812*b* may further comprise a flat vertical end paddle assembly 805 which is positioned such that a least a part of which is perpendicular to the other flat vertical paddle faces 803 of the pair, such that the angle between the end paddle assembly 805 and the vertical paddle face 803 in each of the pair is 90°. The end paddle assembly 805 may be separate from the vertical paddle face 803 within each of the pair as is illustrated in FIG. 20(*a*) where the end paddle assembly 805 is slidably mounted on a pair of support rods 805(*a*) which allow for linear displacement of an end paddle assembly 805 with a second paddle assembly 812*a*, 812*b* from which it depends. Each of these paddle assemblies 812*a*, 812*b* is linearly displaceable such that each of the second paddle assemblies 812*a*, 812*b* can be moved, towards as well as away from one another.

Optionally also one or more of the end paddle assemblies 805 may be positioned to abut a forward face (i.e., moving in a downstream direction) of a packaging article. Optionally also paddle assemblies 805 and corresponding support rods 805(*a*) may also be present and depend from one or both of the first (upstream) paddle assemblies 802*a*, 802*b* and if present the perpendicular part is upstream and parallel to the flat vertical paddle faces 803 of the paddle assemblies 802*a*, 802*b*. As is also seen, each of the vertical support arms 814 depends from a second horizontal transit arm 816 positioned above the paddle assemblies 812*a*, 812*b* which may move colinearly along the direction of the second horizontal transit arm 816. Intermediate the first horizontal transit arm 808 and the second horizontal transit arm 816 and generally parallel with relation to each is a third horizontal transit arm 824 is a pair of third (intermediate) paddle assemblies 820*a*, 820*b* each of the pair having a flat vertical paddle face 803 affixed to a vertical support arm 822. Each of these paddle assemblies 822*a*, 822*b* is linearly displaceable such that each of the pair of third paddle assemblies 822*a*, 822*b* can be moved towards one another. As seen from the figures, each of the vertical support arms 822 depends from the third horizontal transit arm 8248 positioned above the paddle assemblies 820*a*, 820*b* which may move colinearly along the direction of the third horizontal transit arm 822. It is to be noted that, according to preferred embodiments, the orienting apparatus 800 includes no further paddle assemblies. Also, according to preferred embodiment, as is depicted in FIG. 20(*d*) the (intermediate) paddle assemblies 820*a*, 820*b* each of the pair having a flat vertical paddle face 803, each of which is oriented inwardly and are parallel to the opposite flat vertical paddle face 803 of the pair, and also has an upstream flat vertical paddle face 803*a* perpendicular thereto, and further optionally a downstream flat vertical paddle face 803*b* also perpendicular to the flat vertical paddle face 803, and preferably parallel to the upstream flat vertical paddle face 803*a* Preferably also, the (intermediate) paddle assemblies 820*a*, 820*b* exclude any perpendicular elements having perpendicular faces, such as the end paddle assembly 805.

The parallelism between the first horizontal transit arm 808, the second horizontal transit arm 816, and the third horizontal transit arm 824 is maintained by the supporting elements which are variously shown in the figures; such may include one or more support rods or bars, 840 as are generally disclosed in the drawing figures including FIGS. 20(*a*), 20(*b*) and 20(*c*). One or more such support rods or bars may be parallel to the first horizontal transit arm 808, the second horizontal transit arm 816, and the third horizontal transit arm 824, others may be perpendicular, but the orientation of such one or more support rods or bars 804, which provide a supporting frame structure to the first horizontal transit arm 808, the second horizontal transit arm 816, and the third horizontal transit arm 824 is not necessarily critical other than for permitting the functioning of the first (upstream) paddle assemblies 802*a*, 802*b*, the pair of second (downstream) paddle assemblies 812*a*, 812*b* and the third (intermediate) paddle assemblies 820*a*, 820*b* in the manner hereinafter described. In certain embodiments, one or more of the support rods or bars 804 may be configured such that they are perpendicular to one or more of the first horizontal transit arm 808, the second horizontal transit arm 816, and the third horizontal transit arm 824 to thus allow for one or more of these to move laterally with respect to another of the first horizontal transit arm 808, the second horizontal transit arm 816, and/or the third horizontal transit arm 824. The feature of linearly movement of one or more of the first horizontal transit arm 808, the second horizontal transit arm 816, and the third horizontal transit arm 824 towards and/or away from one another is a preferred embodiment, and permits for more flexible configuration of the system and apparatus of which the orienting apparatus 800 forms a part. Using such an arrangement of elements, each of the paddles may be independently moved in at least two directions relative to one or more further paddles and/or with respect to further parts of the system and apparatus of the invention.

A part of the orienting apparatus 800 may mounted upon a part of the first bundling apparatus 100, and a further part may be mounted upon the second bundling apparatus 200, such that when the first bundling apparatus 100 and the second bundling apparatus 200 are linearly displaced with regard to each other, the orienting apparatus 800 remains supported by both.

In a further configuration, a further structural frame (not illustrated), separate from the first bundling apparatus 100 and second bundling apparatus 200 which may be used to support a part of the orienting apparatus 800, while a further part of the orienting apparatus is supported by a part of one or both of the first 100 and/or second bundling apparatus 200.

Alternately the orienting apparatus 800 is supported in its position relative to the first bundling apparatus 100 and the second bundling apparatus 200 by the further structural frame which may for example affixed to vertical supporting members to a factory floor or other substrate, but which is otherwise separate from any other part of the first bundling apparatus 100 and the second bundling apparatus 200.

Returning now to FIGS. 21(*a*), 21(*b*), 22(*a*), 22(*b*), 23(*a*) and 23(*b*), the operation of the orienting apparatus 800 in conjunction with the first bundling apparatus 100, second bundling apparatus 200 and the flexible bridge apparatus 400 having elements spanning between the first 100 and second bundling apparatus 200, and a preferred process of the invention, is discussed. FIG. 21(*b*) provides a perspective view of the system and apparatus 1 of the invention depicted in the elevation view of FIG. 21(*a*). As is seen in these figures, two packaging articles, PA1, PA2 each of which is preferably a stack of individual packaging articles which are to be separately bundled are initially positioned with PA2 adjacent to, but not necessarily in abutment with PA1, with PA2 being downstream of PAL In FIGS. 21(*a*), (21(*b*) the two packaging articles, PA1, PA2 are upstream of the first bundling apparatus 100 and all of the first (upstream) paddle assemblies 802*a*, 802*b*, the pair of second (downstream) paddle assemblies 812*a*, 812*b* and the third (intermediate) paddle assemblies 820*a*, 820*b* are positioned such that the distance between each of the pairs of each of these paddle assemblies is greater than the maximum transverse width of the two packaging articles, PA1, PA2 which are positioned to enter the first bundling apparatus 100, and the second bundling apparatus 200.

Turning now to FIGS. 22(*a*) and 22(*b*), therein is depicted a next step of a process according to the invention. FIG. 22(*b*) provides a perspective view of the system and apparatus of the invention 1 depicted in the elevation view of FIG. 22(*a*). It is to be understood that were necessary, previously to the entry of the two packaging articles, PA1, PA2 the lateral position of the first bundling apparatus 100 and the second bundling apparatus 200 may have been moved to appropriately configure the gap G therebetween, and concurrently, or consequently also the position of the flexible bridge apparatus 400 and its elements (part of array 405) spanning between the first 100 and second bundling apparatus 200 to thereby provide the upper transport surface 402. The flexible bridge apparatus 400, when of the powered type, may be used to propel the two packaging articles, PA1, PA2 to their final positions prior to binding/strapping. Also, either prior to, during or after the positioning of the two packaging articles, PA1, PA2 as is hereinafter described, and/or is depicted in FIGS. 22(*a*) and 22(*b*), the first (upstream) paddle assemblies 802*a*, 802*b*, the pair of second (downstream) paddle assemblies 812*a*, 812*b* and the third (intermediate) paddle assemblies 820*a*, 820*b* are positioned or repositioned as well. As visible in the relevant drawing figures, the two packaging articles, PA1, PA2 have been moved from their prior position shown in FIG. 21(*b*), and are positioned such that packaging article PA1 is a least partially positioned between the upstanding vertical support arms 111*a*, 111*b* and a transverse member 111*c* and coincident with the position of the stage 102. Thus, at least a part of packaging article PA1 is positioned to be bundled with the strapping tape, but a part thereof extends over and upon the upper transport surface 402. Not dissimilarly the downstream packaging article PA2 is a least partially positioned between the upstanding vertical support arms 211*a*, 211*b* and a transverse member 211*c* and coincident with the position of the stage 202, and a part of packaging article PA2 is positioned to be bundled with the strapping tape, but a part thereof extends over and upon the upper transport surface 402. Preferably also a part of the flat vertical paddle face 803 of each of the third (intermediate) paddle assemblies 820*a*, 820*b* is simultaneously in interfacial contact with parts of both of the packaging articles PA1, PA2. Thereafter, immediately prior to operation of the first bundling apparatus 100, and second bundling apparatus 200 immediately prior to their operation and bundling of their respective packaging articles, PA1, PA2 the orienting apparatus is caused to function, whereby the first (upstream) paddle assemblies 802*a*, 802*b*, the pair of second (downstream) paddle assemblies 812*a*, 812*b* and the third (intermediate) paddle assemblies 820*a*, 820*b* are first moved to ensure that packaging article PA1 and packaging article PA2 is first initially "squared up" and also that the packaging article or stack PA1 and the second packaging article or stack PA2 are also in abutment, as is particularly seen in the perspective view of FIG. 22(*b*). It also be noted that the abutting faces of PA1 and PA2 is coincident with and extends between the third (intermediate) paddle assemblies 820*a*, 820*b*. Thereafter the first bundling apparatus 100 and second bundling apparatus 200 operate to encircle each of the packaging article or stack PA1 and the second packaging article or stack PA2 to form separate bundled the packaging article or stack PA1 and the second packaging article or stack PA2 preferably while the first (upstream) paddle assemblies 802*a*, 802*b*, the pair of second (downstream) paddle assemblies 812*a*, 812*b* and the third (intermediate) paddle assemblies 820*a*, 820*b* remain in contact with the vertical sides of the packaging article or stack PA1 and the second packaging article or stack PA2. Thereafter, the orienting apparatus 800 operated in retract or otherwise withdraw the first (upstream) paddle assemblies 802*a*, 802*b*, the pair of second (downstream) paddle assemblies 812*a*, 812*b* and the third (intermediate) paddle assemblies 820*a*, 820*b* away from the two bundles PA1, PA2 in order to remove any obstruction to their exit. Advantageously the encirclement of each of the packaging article or stack PA1 and the second packaging article or stack PA2 to form separate bundled packaging article or stack PA1 and second packaging article or stack PA2 occurs substantially simultaneously, i.e. preferably within 15 seconds of one another, more preferably (in order of increasing preference) within: 15. 14. 13, 12, 11, 10, 9, 8, 7, 6, 5, 4, 3, 2, 1, and 0.5 seconds of each other. Most preferably bundling occurs concurrently.

With reference now to FIGS. 23(*a*) and 23(*b*), in which FIG. 23(*b*) provides a perspective view of the system and apparatus 1 depicted in the elevation view of FIG. 23(*a*), the use of the optional, but preferably also present, second flexible bridge 405(*b*) section provided by the second array 405*b* is depicted. As can be seen, while most of rollers 403 of the second array 405*b* are contained between the second pair of reservoir guide rails 476*a*, 476*b* (i.e., see FIG. 6) at least one of the rollers 403 may be present and contiguous to the exit edge of the stage 202. As seen, each of the packaging article or stack PA1 and the second packaging article or stack PA2, each now individually bound by a strap ST, exit stage 202 preferably in abutment in a downstream direction.

FIG. 24 illustrates in a further perspective view an alternative process of the present invention operated by the system and apparatus 1 of the invention wherein only a single packaging article or stack PA1 is squared up, compressed and bundled using only the bundling apparatus 100. According to this alternate process the stack PA1 the third (intermediate) paddle assemblies 820*a*, 820*b* are positioned such that their upstream flat vertical paddle faces 803*a* are positioned to come into interfacial contact with a downstream side of the packaging article PA1, while the vertical faces 803 of the first (upstream) paddle assemblies 802*a*, 802*b* are positioned to come into contact with opposite sides of the packaging article PA1, which operation of these paddle assemblies imparts satisfactory verticality in to the parts of the packaging article PA1.

Thereafter the bundling apparatus is operated to encircle the packaging article or stack PA1 compress and strap the packaging article. Subsequently, the orienting apparatus 800 operated in retract or otherwise withdraw the first (upstream) paddle assemblies 802*a*, 802*b* and the third (intermediate) paddle assemblies 820*a*, 820*b* away from the bundle PA1 in order to remove any obstruction to its exit from the system and apparatus 1 as generally described with reference to FIGS. 23(*a*) and 23(*b*). It is to be noted, that during this process, the pair of second (downstream) paddle assemblies 812*a*, 812*b* are in a position to provide no obstruction to the direction of the bundle PA1 or the operation of the first (upstream) paddle assemblies 802(*a*), 802(*b*) and the third (intermediate) paddle assemblies 820*a*, 820*b*.

FIG. 25 depicts a preferred embodiment of an "omnidirectional fed" bundling apparatus 100, 200 which may be used as one or more of the bundling apparatus described previously. In the elevation view provided there is present within such an omnidirectional fed bundling apparatus a bidirectional strap magazine 700 which is configured such that it may be supplied by a strap feed apparatus SFA which may be present at either end the ends 103, 203 or 104, 204 of a bundling apparatus 100, 200. The provision of at least one omnidirectional fed bundling apparatus which operates with a bidirectional strap magazine 700 as discussed in more details with respect to FIGS. 26(*a*), 26(*b*), 27(*a*), 27(*b*) and 27(*c*) facilitates the operation of the system and apparatus of the invention in that it allows for the readily positioning and repositioning of a supply of the strapping material at either end of a bundling apparatus 100, 200, which is particularly advantageous wherein the bundling apparatus 100, 200 are linearly displaceable with respect to one another as has been previously described.

It is however also to be appreciated that the provision of a bidirectional strap magazine 700 as discussed in more details with respect to FIGS. 26(*a*), 26(*b*), 27(*a*), 27(*b*) and 27(*c*) may also be used with a system which includes only a single bundling apparatus. Thus, such a bidirectional strap magazine 700 and a bundling apparatus which may accommodate such, and operate to receive strapping material from either of its ends constitutes a further inventive aspect; and such may be used even in the absence of a flexible bridge 405.

FIG. 26(*b*) is a perspective view showing the interior of a bidirectional strap magazine 700, of which FIG. 26(*a*) is a plan view thereof. It is to be understood that a front plate (not shown) has been omitted for clarity in these and in the further drawing figures related to the bidirectional strap magazine 700, but it is to be understood that such a front plate is advantageously present and parallel to rear plate 702 which is shown, and both are of similar dimensions. Extending perpendicularly to the rear plate 702 and at the margins thereof are respectively a base wall 704*a*, and two sidewalls 704*b*, 704*c* which define an interior, along with a guide block 705 which substantially closes the top margin of the rear plate 702. The guide block 705 defines a first guide channel 705*a* which is configured to receive the strap STR which may enter from a first feed end 706*a* and which continues to a strap exit 709, The guide block 705 also defines a second guide channel 705*b* which is configured to receive the strap STR which may enter from an opposite, second feed end 706*b* and which continues to the strap exit 709. Also present is a strap feed gate 707 which is advantageously rotatable at one end thereof and which in a first 'open' position as is shown in FIGS. 26(*a*), 26(*b*) allows for entry of strap STR into the interior cavity 712 wherein a length of which may be collected in a serpentine configuration prior to exiting via the strap exit 709. In such manner the bidirectional strap magazine 700 functions as a reservoir to temporarily contain part of the strap STR in an untensioned state which greatly facilitate its deployment to the bundling apparatus. FIGS. 27(*a*) and 27(*b*) illustrate in more detail, respectively the initial supply of strap STR to the bidirectional strap magazine 700 from either the first feed end 706*a* or the second feed end 706*b*. The reference line "SD" of FIGS. 27(*a*) and 27(*b*) correlate to line "SD" of FIG. 26(*a*), thus allowing for a more detailed depiction of this part of the dual-feed cassette 700. Turning first to FIG. 27(*a*) therein is shown the supply of strap STR from an external supply source (not shown, but see FIG. 24) which enters via the first feed end 706*a* in the direction of arrow "x", wherein it transits within the first guide channel 705*a* towards the diverter 711 within the tapered throat 712 adjacent to the strap exit 709. Also visible is the strap feed gate 707 which is now in a second 'closed' position wherein one of its two arcuate guide surfaces 707*a* is in close proximity to a corresponding part of the first guide channel 705*a*; in this position the terminal end (not shown) of the strap STR is guided from the first guide channel 705*a*, past one side of the diverter 711 and out of the bidirectional strap magazine 700 via the strap exit 709, wherein the strap moves in the direction of arrow "z". Where the strap STR is fed into the bidirectional strap magazine 700 from the second feed end 706*b*, the terminal end thereof (not shown) enters the second feed end 706*b* in the direction of arrow "y". wherein it transits within the second guide channel 705*b* towards the diverter 711 within the tapered throat 712 adjacent to the strap exit 709. Again the strap feed gate 707 is now in its second 'closed' position wherein one of its two arcuate guide surfaces 707*b* is in close proximity to a corresponding part of the second guide channel 705*b*; in this position the terminal end (not shown) of the strap STR is guided from the second guide channel 705*b*, past a further side of the diverter 711 and out of the bidirectional strap magazine 700 via the strap exit 709, wherein the strap now moves in the direction of arrow "z". From this direction "z', strap STR exiting the bidirectional strap magazine 700 now may be fed to the bundling apparatus. With reference now to FIG. 27(*c*), therein is illustrated that, subsequent to the initial treading of strap STR into the bidirectional strap magazine 700 as described with reference to FIG. 27(*a*) or FIG. 27(*b*), advantageously the strap feed gate 707 may be moved to its first 'open' position which allows for a length of strap STR may be collected in a serpentine configuration prior to exiting via the strap exit 709. As can be understood from the foregoing the use of a bidirectional strap magazine 700 provides for an "omnidirectional fed" bundling apparatus.

The provision of the system and apparatus of the invention, particularly in the preferred embodiments shown illustrates that during and after bundling both the first stack, and the second stack may remain in abutment as illustrated, or at most may be slightly separated. Such stacks, while remaining in abutment, and are driven in the direction of the exit track wherein they are ultimately palletized. The retention of the orientation of a first, unbundled stack with a second abutting, unbundled stack during the bundling and strapping step, preferably which is practiced simultaneously, allows for retention of orientation of the two resultant stacks throughout the process, and even after post bundling. Such as not been possible according to any apparatus of the prior invention.

Also, while not illustrated in the one or more of the Figures, the principles of the invention may be extended to systems and apparatus which comprise three or more bundling apparatus of the type illustrated as 100 and 200 where such three or more bundling apparatus are positioned serially in a linear sequence. In which case, there would be required an extension of the above inventive principles whereby it would be necessary to include a flexible bridge apparatus between the exit side of an upstream bundling apparatus, and the inlet side of a successive and downstream bundling apparatus, with the exception of the exit side of the last bundling apparatus in the series or sequence of three or more such bundling apparatus, in which case the provision of a still further flexible bridge apparatus would be optional, although such would be preferred.

The system and apparatus of the invention can also be utilized in the practice of an alternative processes. Accordingly, it is understood that orienting apparatus 800 may operated to be used only in conjunction with either the first bundling apparatus 100 or the second bundling apparatus 200 and remain inoperative to the other of the bundling apparatus. Such an order of operation may be advantageous, or necessary wherein one of the two bundling apparatus 100, 200 is necessarily disengaged from production, such as might be occasioned due to mechanical, or other fault. In which case, only a single stack of packaging articles may be bundled using either the first bundling apparatus 100 or the second bundling apparatus 200 while the other of which is removed from production or is idle.

The invention claimed is:

1. An apparatus for bundling packaging articles, which comprises:

a first bundling apparatus, at least a second bundling apparatus, wherein the relative linear displacement of the first bundling apparatus and the at least second bundling apparatus is variable, a reconfigurable bridge between the first bundling apparatus and the second bundling apparatus which spans between an exit edge of the first bundling apparatus and an entrance edge of the second bundling apparatus, wherein the span of the bridge may be re-dimensioned in order to maintain a substantially contiguous and continuous transport surface between the exit edge of the first bundling apparatus and the entrance edge of the second bundling apparatus whose dimensions can be varied in response to the lateral positioning and changes thereto between the first bundling apparatus and the second bundling apparatus.

2. The apparatus of claim 1, wherein the reconfigurable bridge is powered and provides propulsive effect to packaging articles present on its generally planar upper surface extending therebetween.

3. The apparatus of claim 2, wherein the reconfigurable bridge includes a motor or other drive means to impart the propulsive effect to packaging articles present on its generally planar upper surface extending between the exit edge of the first bundling apparatus and the entrance edge of the second bundling apparatus.

4. The apparatus of claim 1, wherein the apparatus further comprises a second reconfigurable bridge apparatus which provides and includes a reconfigurable upper transport surface which is preferably substantially coplanar and coincident with the stage of the second bundling apparatus, opposite to the side of the stage which is coincident with the reconfigurable bridge apparatus which spans between the first bundling apparatus and the second bundling apparatus.

5. The apparatus of claim 4, wherein the second reconfigurable bridge is powered and provides propulsive effect to packaging articles present on its generally planar upper surface extending between.

6. The apparatus of claim 5, wherein a motor or other drive means to provides the propulsive effect to packaging articles present on its generally planar upper surface.

7. The apparatus of claim 1, wherein the apparatus further comprises:

an orienting apparatus concurrently operable with both the first bundling apparatus and the at least second bundling apparatus, which includes:

a first pair of paddle assemblies each of the pair having a flat vertical paddle face affixed to a vertical support arm, such that each of the pair are moveable with respect to each other and with respect to further paddles present in the orienting apparatus;

a second pair of a first pair of paddle assemblies each of the pair having a flat vertical paddle face affixed to a vertical support arm, and optionally each of the pair further includes an end paddle perpendicular to the flat vertical paddle face, such that each of the second pair are moveable with respect to each other and with respect to further paddles present in the orienting apparatus;

a third pair of paddle assemblies intermediate the each of the pair having a flat vertical paddle face affixed to a vertical support arm, such that each of the pair are moveable with respect to each other and with respect to further paddles present in the orienting apparatus, and wherein the third pair of paddle assemblies omit a end paddle perpendicular to the flat vertical paddle face.

8. The apparatus of claim 1, wherein at least one bunding apparatus is an omnidirectional fed bundling apparatus, which apparatus includes a bidirectional strap magazine having a configuration such that configured such that it may be supplied by a strap feed apparatus SFA which may be present at either end of the bundling apparatus.

9. The apparatus of claim 1 which further comprises a bidirectional strap magazine having:

an interior reservoir to temporarily contain part of the strap in an untensioned state, a guide block defining a first guide channel configured to receive a strap which enters from a first feed end, a second guide channel configured to receive a strap from an opposite, second feed end, wherein the first and second guide channels continue to a strap exit, and a strap feed gate which, when in a first position allows for entry of a length of strap into the interior reservoir and therein to be held in an untensioned state, but when in a second position guides strap within the first guide channel or second guide channel towards a diverter adjacent to the strap exit.

10. A process of concurrently bundling a first packaging article or stack and a second packaging article or stack to form a first bundled packaging article or stack and a second bundled packaging article or stack utilizing the apparatus according to claim 1.

11. A bidirectional strap magazine having:

an interior reservoir to temporarily contain part of the strap in an untensioned state, a guide block defining a first guide channel configured to receive a strap which enters from a first feed end, a second guide channel configured to receive a strap from an opposite, second feed end, wherein the first and second guide channels continue to a strap exit, and a strap feed gate which, when in a first position allows for entry of a length of strap into the interior reservoir and therein to be held in an untensioned state, but when in a second position guides strap within the first guide channel or second guide channel towards a diverter adjacent to the strap exit.

12. The bidirectional strap magazine of claim 11, which further includes a front plate, a rear plate, a base wall and two sidewalls which define an interior.

13. The bidirectional strap magazine of claim 11, wherein the guide block substantially closes a top margin of the rear plate.

14. The bidirectional strap magazine of claim 11, wherein the strap feed gate is rotatable.

15. The bidirectional strap magazine of claim 11, which further includes a diverter within a tapered throat adjacent to the strap exit.

16. The bidirectional strap magazine of claim 11, which further includes two guide surfaces.

* * * * *